US008992037B2

(12) United States Patent
Rycyna, III

(10) Patent No.: US 8,992,037 B2
(45) Date of Patent: Mar. 31, 2015

(54) MODULAR VARIABLE PRESENTATION SYSTEM

(71) Applicant: Cirrus Systems, Inc., San Rafael, CA (US)

(72) Inventor: Stephen David Rycyna, III, Corte Madera, CA (US)

(73) Assignee: Cirrus Systems, Inc., Emeryville, CA (US)

( * ) Notice: Subject to any disclaimer, the term of this patent is extended or adjusted under 35 U.S.C. 154(b) by 221 days.

(21) Appl. No.: 13/667,434

(22) Filed: Nov. 2, 2012

(65) Prior Publication Data

US 2013/0271973 A1 Oct. 17, 2013

Related U.S. Application Data

(60) Provisional application No. 61/555,173, filed on Nov. 3, 2011.

(51) Int. Cl.

| | |
|---|---|
| ***G09F 13/04*** | (2006.01) |
| ***G09F 13/08*** | (2006.01) |
| ***F21V 19/00*** | (2006.01) |
| ***F21K 99/00*** | (2010.01) |
| ***G09F 9/302*** | (2006.01) |
| ***G09F 9/33*** | (2006.01) |

(52) U.S. Cl.

CPC . *F21V 19/00* (2013.01); *F21K 9/00* (2013.01); *G09F 9/3026* (2013.01); *G09F 9/33* (2013.01); *Y10S 362/812* (2013.01)

USPC ..... 362/97.1; 362/812

(58) Field of Classification Search

USPC ..... 362/97.1–97.3, 249.02, 602–605, 612, 362/632–634, 812; 40/451–452, 544, 549, 40/563–564, 605

See application file for complete search history.

(56) References Cited

U.S. PATENT DOCUMENTS

| | | | | |
|---|---|---|---|---|
| 6,267,462 | B1 * | 7/2001 | Krause et al. | 312/111 |
| 6,314,669 | B1 * | 11/2001 | Tucker | 40/448 |
| 6,741,222 | B1 * | 5/2004 | Tucker | 345/1.1 |
| 2002/0122134 | A1 * | 9/2002 | Kalua | 348/383 |

OTHER PUBLICATIONS

Barco, "Fixed DLite Display Installation Manual" pp. 1-51, Jul. 9, 2004.

* cited by examiner

*Primary Examiner* — Jason Moon Han

(57) ABSTRACT

A modular variable presentation device system is described which, in one embodiment, may be produced and assembled to display and/or view information.

20 Claims, 45 Drawing Sheets

200

960 (H= 320 x n° module)
L
1600 (L= 320 x n° module)

212a
H
212a
T1
T2

212a
203
204
212b
208
210
214
216
212a
218

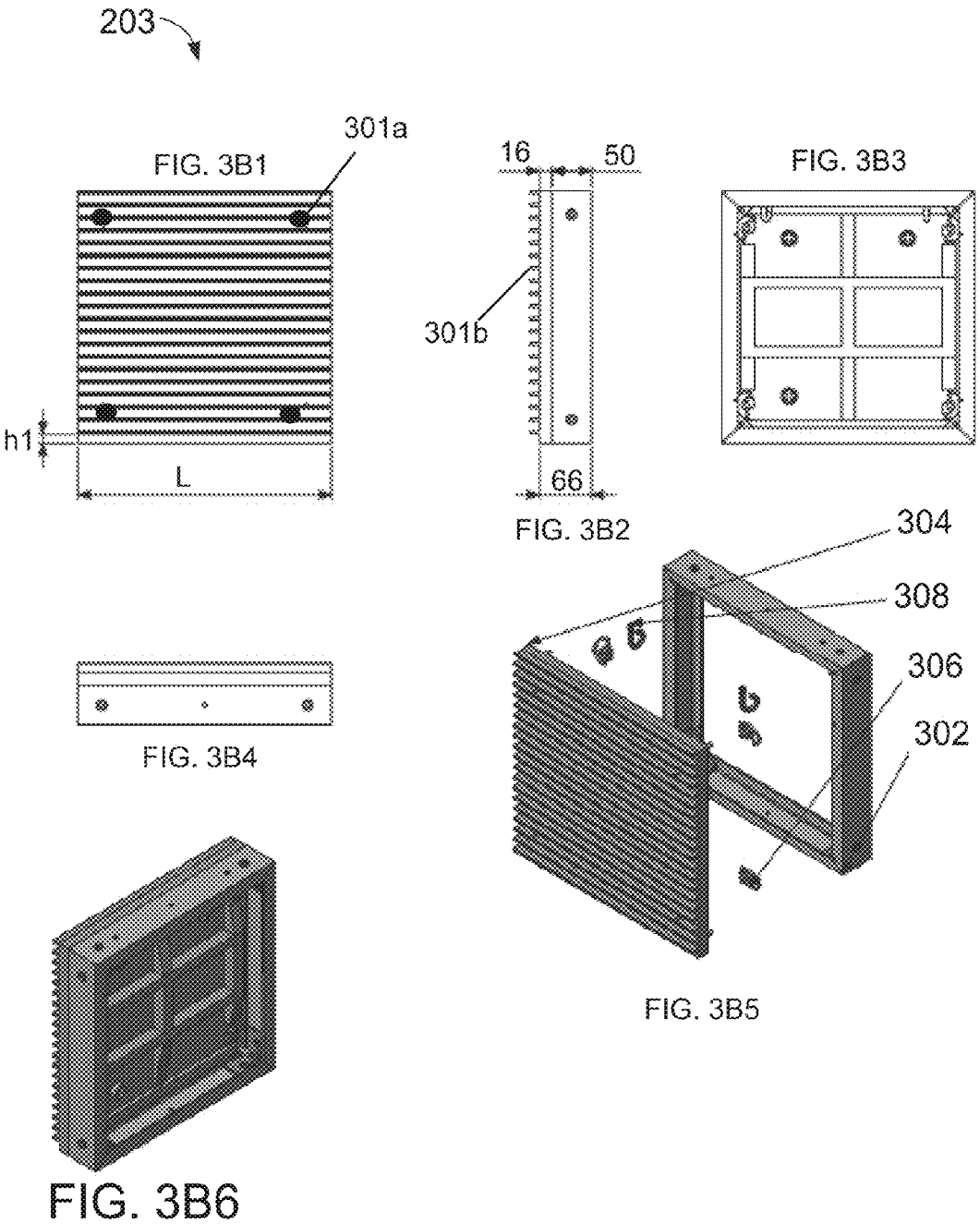
203
301a
FIG. 3B1
h1
L
16
50
301b
66
FIG. 3B2
FIG. 3B3
FIG. 3B4
304
308
306
302
FIG. 3B5
FIG. 3B6

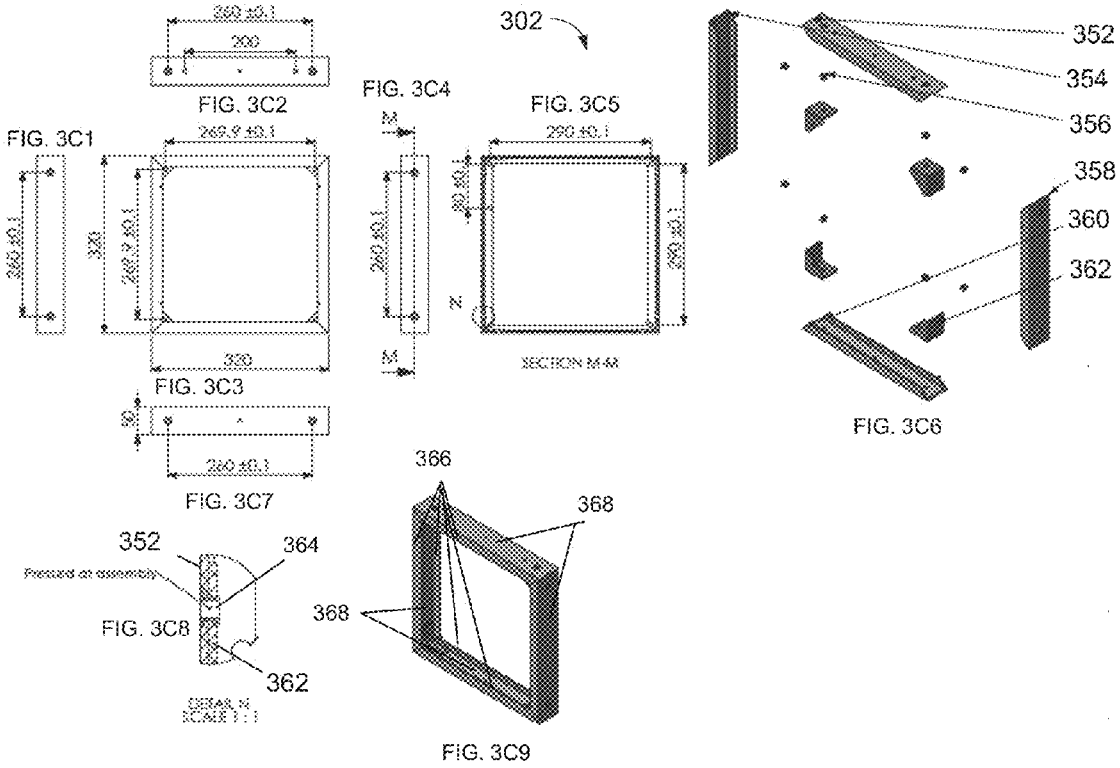
FIG. 3C1
FIG. 3C2
FIG. 3C3
FIG. 3C4
FIG. 3C5
FIG. 3C6
FIG. 3C7
FIG. 3C8
FIG. 3C9
302
352
354
356
358
360
362
364
366
368

352
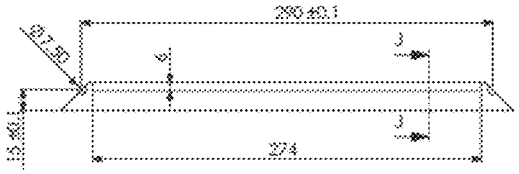
FIG. 3D3
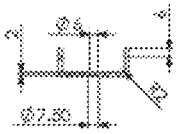
FIG. 3D4
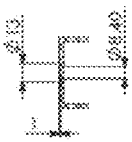
FIG. 3D2
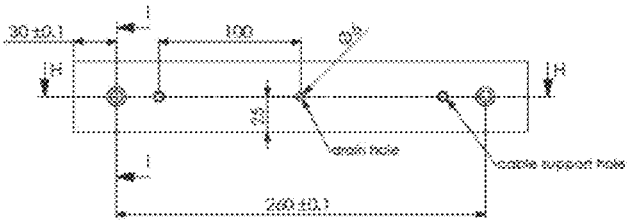
FIG. 3D1
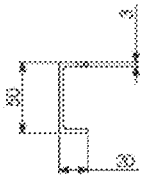
FIG. 3D5
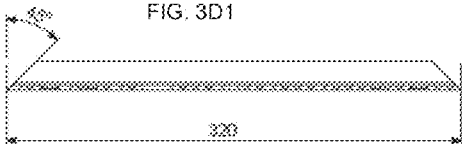
FIG. 3D6
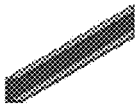
FIG. 3D7

354
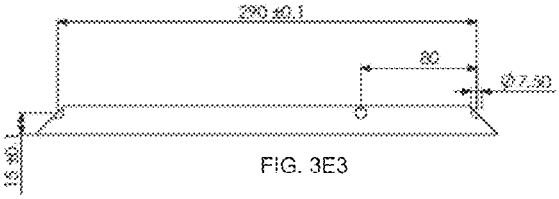
FIG. 3E3
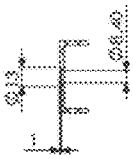
SECTION C-C
FIG. 3E2
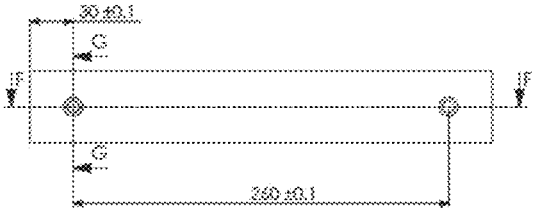
FIG. 3E1
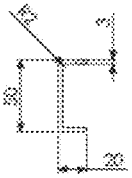
FIG. 3E4
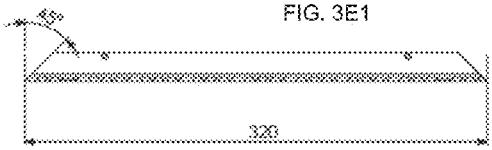
SECTION F-F
FIG. 3E5
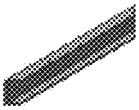
FIG. 3E6

358
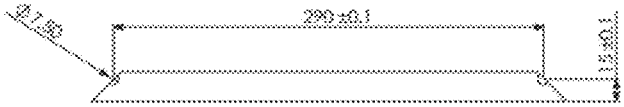
FIG. 3F3
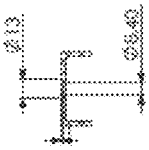
SECTION D-D
FIG. 3F2
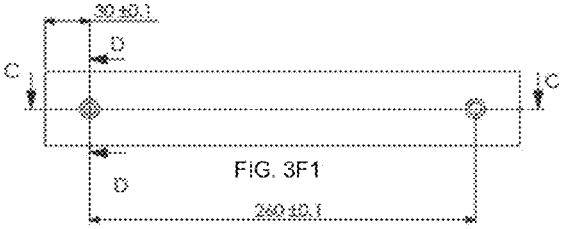
FIG. 3F1
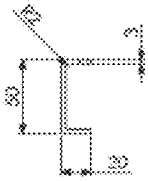
FIG. 3F4
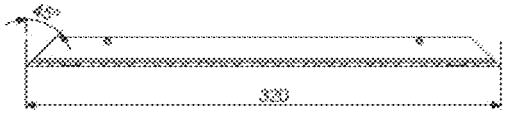
SECTION C-C
FIG. 3F5
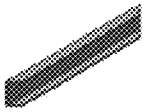
FIG. 3F6

360
FIG. 3G3
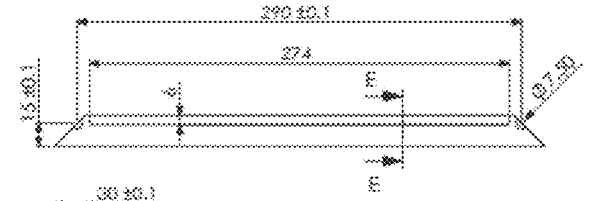
FIG. 3G4
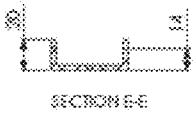
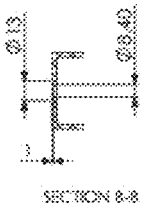
FIG. 3G2
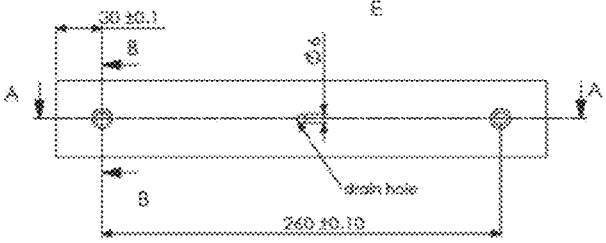
FIG. 3G1
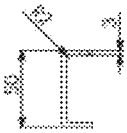
FIG. 3G5
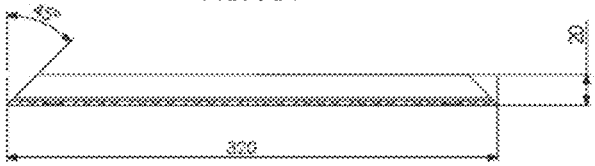
FIG. 3G6
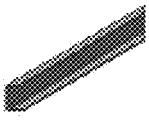
FIG. 3G7

356

362

210

212

800

306

1002

1010
1020
1030
1040
1050

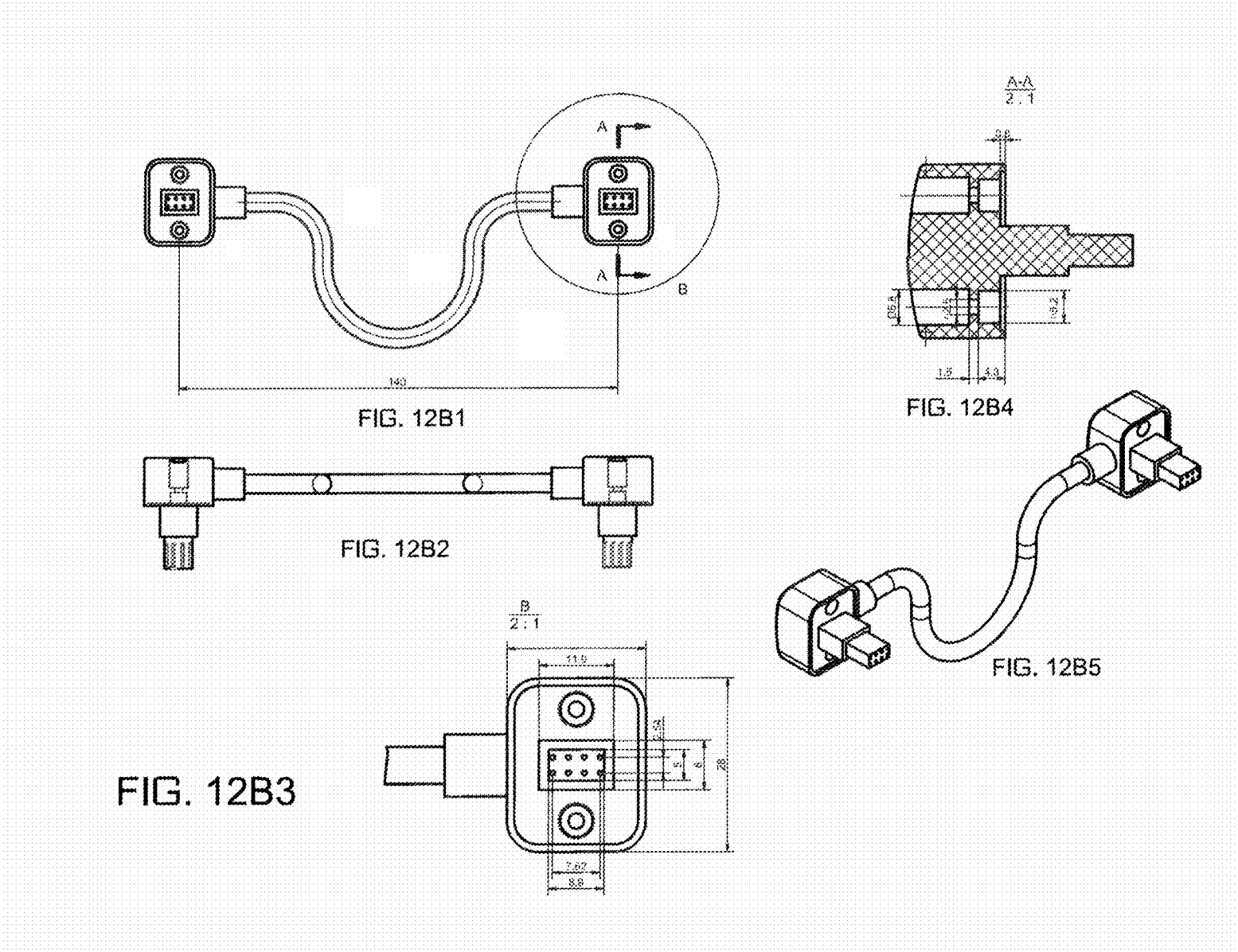
A-A
2:1
FIG. 12B4
FIG. 12B5
A
A
B
140
FIG. 12B1
FIG. 12B2
B
2:1
FIG. 12B3

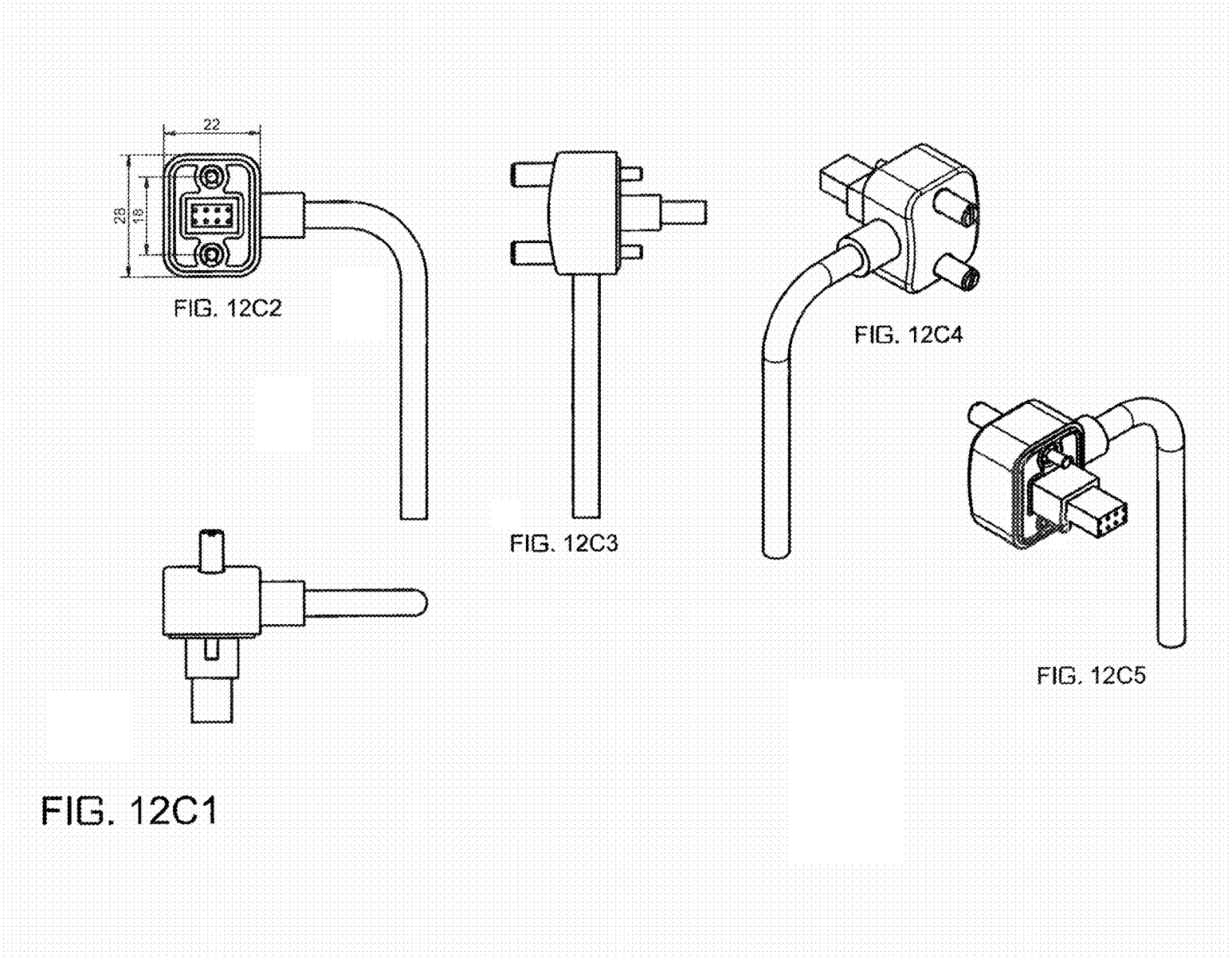
FIG. 12C1
FIG. 12C2
FIG. 12C3
FIG. 12C4
FIG. 12C5

| Tag | Direction | Angle | Inner Radius |
|---|---|---|---|
| A | DOWN | 90° | 0.05 |
| B | DOWN | 90° | 0.05 |
| C | DOWN | 90° | 0.05 |
| D | DOWN | 90° | 0.05 |
| E | DOWN | 90° | 0.05 |
| F | DOWN | 90° | 0.05 |
| G | DOWN | 90° | 0.05 |
| H | DOWN | 90° | 0.05 |
| J | DOWN | 90° | 0.05 |
| K | DOWN | 90° | 0.05 |
| L | DOWN | 90° | 0.05 |
| M | DOWN | 90° | 0.05 |

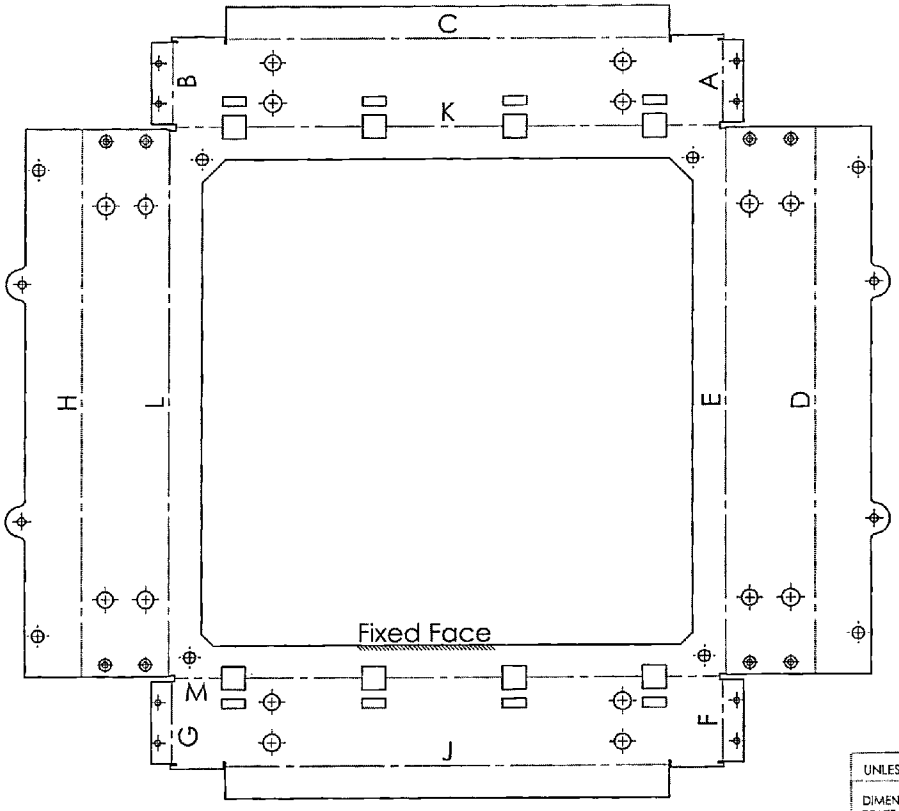

UNLESS OTHERWISE SPECIFIED:
DIMENSIONS ARE IN INCHES
TOLERANCES:
FRACTIONAL ±1/32" BEND ± 1
ANGULAR: MACH ± TWO PLACE DECIMAL ± 0.010
THREE PLACE DECIMAL ± 0.005
INTERPRET GEOMETRIC TOLERANCING PER:
MATERIAL 5052-Al
FINISH
DO NOT SCALE DRAWING
SCALE: 1:3 WEIGHT:
SHEET 4 OF 9

FIG. 12H

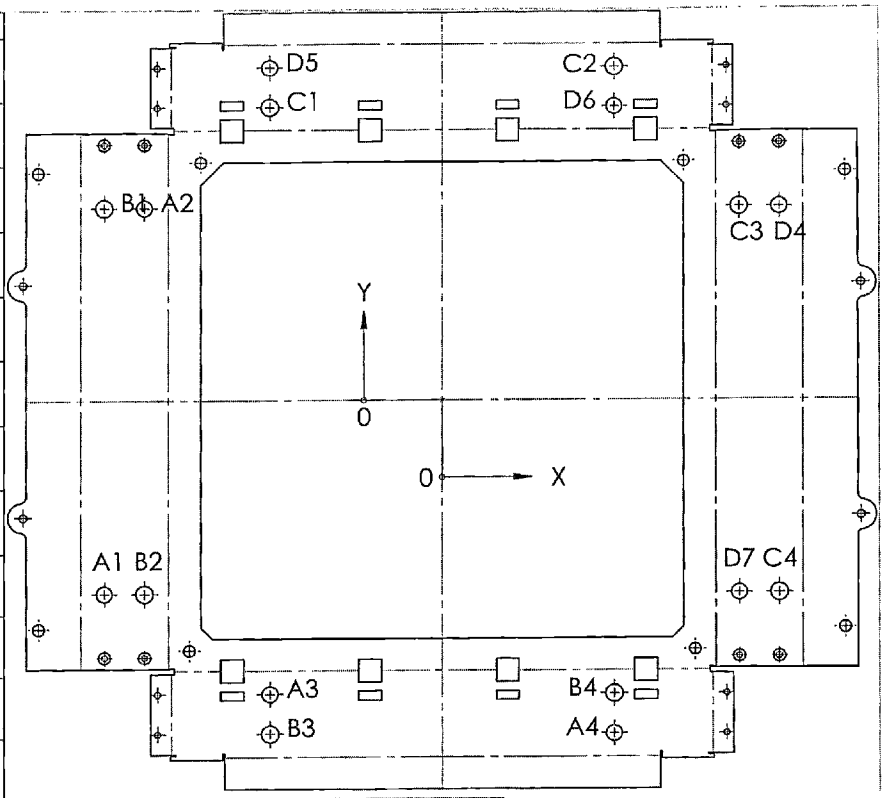

| TAG | X LOC | Y LOC | SIZE |
|---|---|---|---|
| A1 | -7.339 | -4.250 | ∅ 0.344 +0.003 0.000 THRU |
| A2 | -6.464 | 4.250 | ∅ 0.344 +0.003 0.000 THRU |
| A3 | -3.750 | -6.464 | ∅ 0.344 +0.003 0.000 THRU |
| A4 | 3.750 | -7.339 | ∅ 0.344 +0.003 0.000 THRU |
| B1 | -7.339 | 4.250 | ∅ 0.375 +0.003 0.000 THRU |
| B2 | -6.464 | -4.250 | ∅ 0.375 +0.003 0.000 THRU |
| B3 | -3.750 | -7.339 | ∅ 0.375 +0.003 0.000 THRU |
| B4 | 3.750 | -6.464 | ∅ 0.375 +0.003 0.000 THRU |
| C1 | -3.750 | 6.464 | ∅ 0.375 +0.003 0.000 THRU |
| C2 | 3.750 | 7.339 | ∅ 0.375 +0.003 0.000 THRU |
| C3 | 6.464 | 4.250 | ∅ 0.375 +0.003 0.000 THRU |
| C4 | 7.339 | -4.250 | ∅ 0.375 +0.003 0.000 THRU |
| D5 | -3.750 | 7.339 | ∅ 0.344 +0.003 0.000 THRU |
| D6 | 3.750 | 6.464 | ∅ 0.344 +0.003 0.000 THRU |
| D7 | 6.464 | -4.250 | ∅ 0.344 +0.003 0.000 THRU |
| D4 | 7.339 | 4.250 | ∅ 0.344 +0.003 0.000 THRU |

UNLESS OTHERWISE SPECIFIED:
DIMENSIONS ARE IN INCHES
TOLERANCES:
FRACTIONAL ± 1/32" ANGULAR: MACH ± BEND ± 1
TWO PLACE DECIMAL ± 0.010
THREE PLACE DECIMAL ± 0.005
INTERPRET GEOMETRIC TOLERANCING PER:
MATERIAL 5052-Al
FINISH
DO NOT SCALE DRAWING
SCALE: 1:3 WEIGHT:
SHEET 5 OF 9

FIG. 12I

| TAG | X LOC | Y LOC | SIZE |
|---|---|---|---|
| A1 | -7.339 | -5.650 | ∅ 0.129 THRU ∅ 0.260 X 120° |
| A2 | -7.339 | 5.650 | ∅ 0.129 THRU ∅ 0.260 X 120° |
| A3 | -6.464 | -5.650 | ∅ 0.129 THRU ∅ 0.260 X 120° |
| A4 | -6.464 | 5.650 | ∅ 0.129 THRU ∅ 0.260 X 120° |
| A5 | 6.464 | -5.650 | ∅ 0.129 THRU ∅ 0.260 X 120° |
| A6 | 6.464 | 5.650 | ∅ 0.129 THRU ∅ 0.260 X 120° |
| A7 | 7.339 | -5.650 | ∅ 0.129 THRU ∅ 0.260 X 120° |
| A8 | 7.339 | 5.650 | ∅ 0.129 THRU ∅ 0.260 X 120° |
| B1 | -6.184 | -7.339 | ∅ 0.129 THRU |
| B2 | -6.184 | -6.464 | ∅ 0.129 THRU |
| B3 | -6.184 | 6.464 | ∅ 0.129 THRU |
| B4 | -6.184 | 7.339 | ∅ 0.129 THRU |
| B5 | 6.184 | -7.339 | ∅ 0.129 THRU |
| B6 | 6.184 | -6.464 | ∅ 0.129 THRU |
| B7 | 6.184 | 6.464 | ∅ 0.129 THRU |
| B8 | 6.184 | 7.339 | ∅ 0.129 THRU |

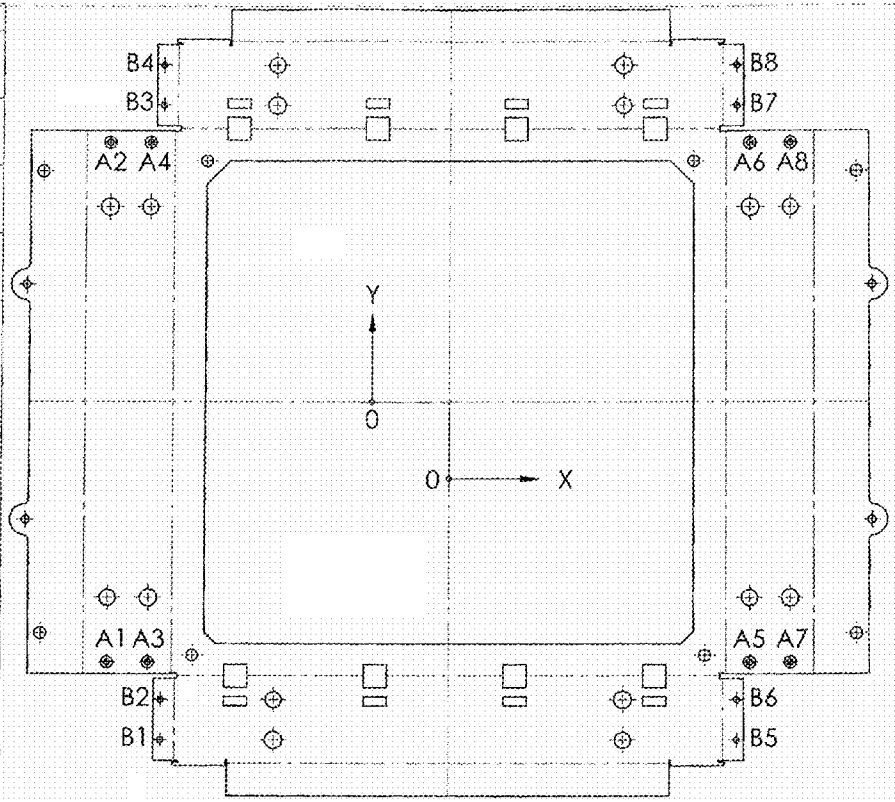

UNLESS OTHERWISE SPECIFIED:
DIMENSIONS ARE IN INCHES
TOLERANCES:
FRACTIONAL ± 1/32"
ANGULAR: MACH ± BEND ± 1
TWO PLACE DECIMAL ± 0.010
THREE PLACE DECIMAL ± 0.005

INTERPRET GEOMETRIC TOLERANCING PER:

MATERIAL
5052-Al

FINISH

DO NOT SCALE DRAWING | SCALE: 1:3 | WEIGHT: | SHEET 6 OF 9

5 4 3 2 1

FIG. 12J

| TAG | X LOC | Y LOC | SIZE |
|---|---|---|---|
| A1 | -9.117 | -2.559 | Ø 0.170 THRU |
| A2 | -9.117 | 2.559 | Ø 0.170 THRU |
| A3 | 9.117 | -2.559 | Ø 0.170 THRU |
| A4 | 9.117 | 2.559 | Ø 0.170 THRU |
| B1 | -8.777 | -5.025 | Ø 0.257 THRU |
| B2 | -8.777 | 5.025 | Ø 0.257 THRU |
| B3 | 8.777 | -5.025 | Ø 0.257 THRU |
| B4 | 8.777 | 5.025 | Ø 0.257 THRU |
| C1 | -5.500 | -5.500 | Ø 0.250 THRU |
| C2 | -5.250 | 5.250 | Ø 0.250 THRU |
| C3 | 5.250 | 5.250 | Ø 0.250 THRU |
| C4 | 5.500 | -5.500 | Ø 0.250 THRU |

MODULAR VARIABLE PRESENTATION SYSTEM

CROSS-REFERENCE TO RELATED APPLICATIONS

This application claims priority benefit of U.S. Provisional Patent Application No. 61/555,173, entitled "Modular Variable Presentation System," filed Nov. 3, 2011, by Stephen David Rycyna III, which is incorporated herein by reference.

FIELD OF THE INVENTION

This specification generally relates to presentation systems.

BACKGROUND OF THE INVENTION

The subject matter discussed in the background section should not be assumed to be prior art merely as a result of its mention in the background section. Similarly, a problem and the understanding of the causes of a problem mentioned in the background section or associated with the subject matter of the background section should not be assumed to have been previously recognized in the prior art. The subject matter in the background section merely represents different approaches, which in and of themselves may also be inventions.

Presentation systems are used extensively to advertise and/or present products and ideas to the general public. Presentation systems using light can be expensive to produce and can be less than optimally energy efficient. Therefore, new presentation systems are needed.

BRIEF DESCRIPTION OF THE FIGURES

In the following drawings like reference numbers are used to refer to like elements. Although the following figures depict various examples of the invention, the invention is not limited to the examples depicted in the figures.

The present invention is illustrated by way of example, and not by way of limitation, in the figures of the accompanying drawings and in which like reference numerals refer to similar elements and in which:

FIGS. 3B1-3B6 illustrate an embodiment of a modular presentation device as described with reference to FIG. 3A;

FIGS. 3C1-3C9 illustrates an embodiment of a frame as described with reference to FIGS. 3B1-3B6;

FIGS. 3D1-3D7 illustrates an embodiment of a top frame wall of a frame as described with reference to FIGS. 3C1-3C9;

FIGS. 3E1-3E6 illustrates an embodiment of a left frame wall of a frame as described with reference to FIGS. 3C1-3C9;

FIGS. 3F1-3F6 illustrates an embodiment of a right frame wall of a frame as described with reference to FIGS. 3C1-3C9;

FIGS. 3G1-3G7 illustrates an embodiment of a bottom frame wall of a frame as described with reference to FIGS. 3C1-3C9;

FIGS. 12A1-12A4 illustrates an embodiment of a communication cable;

FIGS. 12B1-12B5 illustrates another embodiment of a communication cable;

FIGS. 12C1-12C5 illustrates another embodiment of a communication cable;

FIGS. 12E-12M show the dimensions of an embodiment of an intermediate product for making the frame of a display panel;

Unless otherwise indicated illustrations in the figures are not necessarily drawn to scale.

DETAILED DESCRIPTION OF THE FIGURES

Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Block Diagram of the System

FIG. 1

Figure 1:
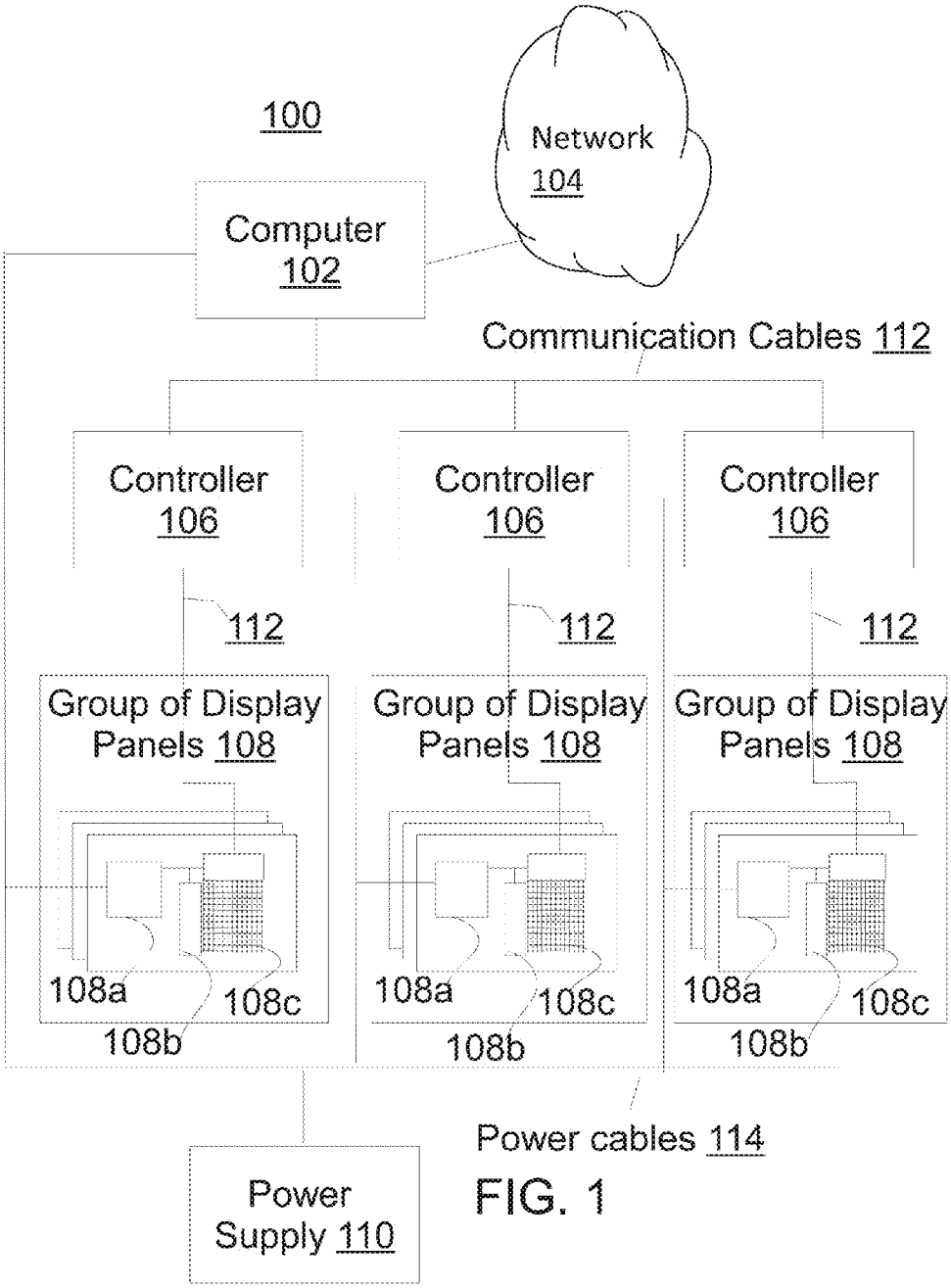
FIG. 1 illustrates a block diagram of an embodiment of a modular presentation device system.

FIG. 1 illustrates a block diagram of an embodiment of a system 100 which may include embodiments of computer(s) 102, network(s) 104, controller(s) 106, group of display panels 108, AC/DC converter 108*a*, multiplexer 108*b*, array of lights 108*c*, power supply(s) 110, communication line 112, and power line 114. The elements previously listed will be discussed in detail subsequently in the specification. In other embodiments, system 100 may not have all of the elements or components listed above and/or may have other elements or components instead of or in addition to those listed.

System 100 is a modular presentation system, which may be assembled into display devices of many different sizes constructed from panels having frames that lock together to create a display. Locking the frames together makes system 100 easier and less expensive to assemble. Because system 100 is modular, it is not necessary to produce a whole new display for each different size or type of presentation. Changing the size or shape of the presentation device only requires a change in the number of frames or modules. Thus, any type of presentation from a small office display or sign to a large billboard can be produced. The smaller modules or frames can be attached together as needed to create different sizes and shapes. Thus, the system 100 allows for ease of construction. The modularity of system 100 results in less variability in the production process. The producer need only create one type of display panel in large numbers that are attached together into a desired configuration, rather than to create a whole new display for each size and/or type of order.

Many current presentation systems emit vast amounts of heat and require fans incorporated within the presentation systems. In addition, the components of the current presentation systems are difficult to access and are not reconfigurable. Since conventional presentation systems are not reconfigurable a custom presentation device needs to be designed for each particular application.

System 100 may be configured and controlled, via a computing device. Computing device executes instructional codes for operating system 100. In at least one embodiment, following assembly of system 100, a user communicates the size of the modular cabinet system to the computing device, which then uses the information for presenting information for viewing.

Computers 102 communicate a portion of an image to view to the respective controllers 106. The controllers 106 receive and process the received image information and communicate the processed information to the presentation devices for viewing. System 100 may have one or more computers 102. Computer(s) 102 may include an output system, an input system, a memory system, a processor system, and/or an input/output system. In other embodiments, computer 102 may include additional components and/or may not include all of the components listed above. The computer(s) 102 are discussed in more detail in FIG. 16. However, computers 102 send instructions to the panels of system 100 causing different patterns of lights to, which may depend on the configuration of system 100. Computer information is communicated between presentation panels, via communication cables (e.g., cords) that may also allow for providing power to each of the display panels 108. Various embodiments of communication cables are discussed in more detail with respect to FIGS. 11A-D. In at least one embodiment, computer(s) 102 may communicate bi-directionally with controller(s) 106. In at least one embodiment, the computer has an output that is divided into parallel signals. In at least one embodiment, the computer controls a multiple controllers, in which each controller controls a different subset of one or more panels of system 100. the number of controllers may depend on the number of panels used in the configuration in which system 100 is arranged. Depending on the number of panels and the number of panels each controller controls, it may only be necessary to have one controller or there may be many controllers.

Network 104 may include a server system, an input system, an output system, a plurality of client systems, a communications network, and a hand-held device. In other embodiments, network 104 may include additional components and/or may not include all of the components listed above. Network 104 is discussed in more detail in FIG. 17.

System 100 may have one or more controllers 106. The one or more controllers 106 may communicate bi-directionally with other controllers 106 and computer(s) 102 via a communication cable. System 100 may automatically reconfigure when additional presentation devices are added or presentation devices are removed. Controllers 106 detect their (controllers) location with respect to the other controllers 106. Controllers communicate respective location with regard to other controllers to computer(s) 102. Although three controllers 106 are illustrated in the drawings, there may be any number of controllers 106 in system 100.

System 100 may have one or more groups of display panels 108. The terms "panel," "presentation device," and "display device" may be used interchangeably throughout the specification and may be substituted one for another to obtain different embodiments. Display panels 108 may, for example, include an array of a light emitting diodes (LEDs). System 100 may provide an assembly for securing one or more display panels 108 for displaying and/or viewing information. Display panels 108 may receive power from power supply 110. Each controller 106 may control more than one display panel 108. Each controller 106 may control a different number (or the same number) of display panels 108. AC/DC converter 108*a* converts the electrical power from the form (e.g., AC) that the power is available at the power source to the form needed by the display panel (e.g., DC). Multiplexer 108*b* selects which lights to light, based on signals from controller 106. Array of lights 108*c* includes an array of lights (e.g., LEDs) that are lit according to the signals from controller 106, via multiplexer 108*b*.

System 100 may have one or more power supplies 110. In operation, power is supplied via power supplies 110 through one or more conduits to each display device. Power supply 110 may be the source of the of the power. Communication line 112 communicatively couples computer 102, controllers 106, and panels 108 to one another. Computer 102 sends instructions, communication line 112 to controllers 106, and controllers 106 send signals, via communications line 112 to display panels 108, causing the lights in display panel 108 to light up in the pattern determined by computer 102. Power line 114 electrically couples power supply 110 to computer 102, controls 106, and display panels 108, causing current to flow from power supply 110 to computer 102, controls 106, and display panels 108, thereby powering computer 102, controls 106, and display panels 108.

Components of the System

FIGS. 2*a*-2*e*

Figures 2A, 2B, 2C, 2D, 2E:
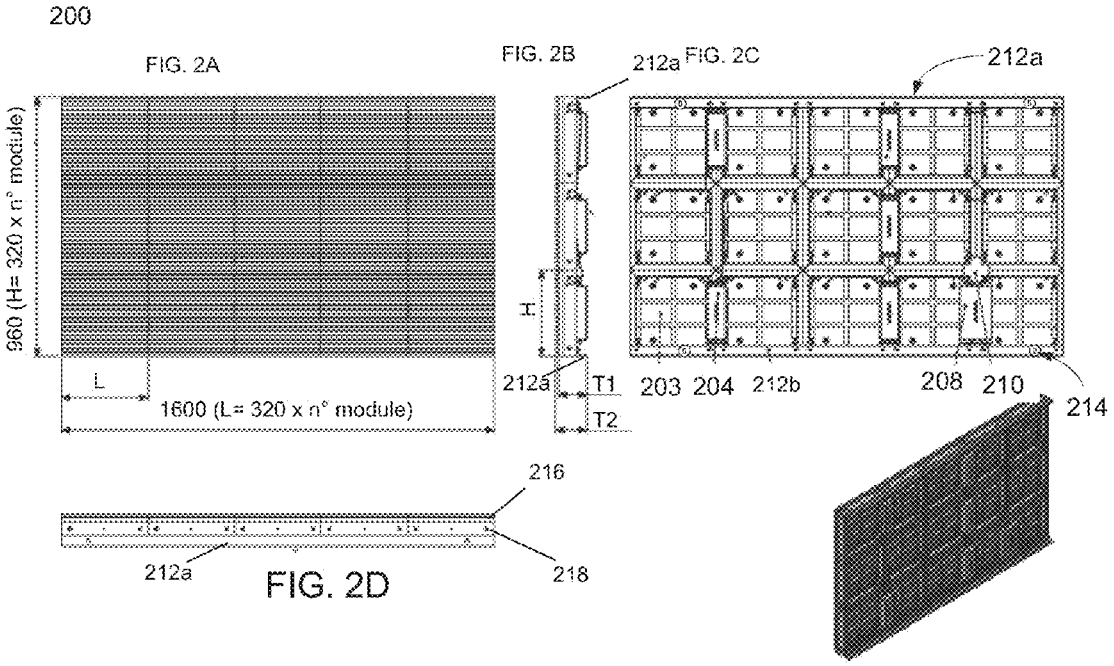
FIGS. 2A-2E illustrate an embodiment of a modular cabinet system.

FIGS. 2A-2E illustrate an example modular system 200. FIGS. 2A-2E will be discussed together. FIG. 2A shows front view of an embodiment of modular system 200, FIG. 2B shows a side view of an embodiment of modular system 200, FIG. 2C shows a back view of an embodiment of modular system 200, FIG. 2B shows a bottom view of an embodiment of modular system 200, and FIG. 2E shows a perspective view of an embodiment of modular system 200. system 200 FIGS. 2A-2E illustrate an embodiment of a modular system 200 which may include embodiments of back 202 having power supply 204, controller 208, connecting plate 210, connecting bracket 212, and back mounting device 214. In other embodiments, modular system 200 may not have all of the elements or components listed above and/or may have other elements or components instead of or in addition to those listed.

Referring to FIG. 2A, modular system 200 may include a plurality of panels of length L. Referring to FIG. 2B, the height of each panel may be H and thicknesses T1 and T2, which may be 106 mm and 108 mm, respectively. Referring to FIGS. 2A and 2B, the height of modular system 200 is the number of panels times the height of each panel, and the length of modular system 200 is the number of panels times the length of each panel. In an embodiment in which the height H and the length L are both 320 mm and in which the modular system 200 is built to be 3 panels high and 5 panels wide, modular system will be 960 mm high and 1600 mm wide, as in the embodiment of modular system 200 of FIGS. 2A-2E. In other embodiments, L and H may have other values and may not necessarily be equal to one another.

Referring to FIG. 2C, modular system 200 is an embodiment of system 100. Modular system 200 may be secured by a frame and connecting plates where display panels powered by power supplies and controlled by controllers present information for viewing. In an embodiment, system 100 is energy efficient (e.g., due to the use of LEDs instead of light bulbs, and consequently uses lower electrical currents, resulting in less resistive heating, as compared to prior art displays. As a result of the energy efficiencies, system 100 does not require the use of a fan for cooling system 100.

Modular system 200 may provide an assembly for securing a presentation device for viewing information indoors or outdoors. system 200 Back 202 is an embodiment of the back of modular system 200. Back 202 may have various cables, controllers, and power supplies attached (as shown in FIG. 2C). Alternatively, the cables, the controllers, and the power supplies may be located within modular system 200.

Panel 203 is one panel of the modular system 200. Panel 203 may be an embodiment of one of display panels 108. Modular system 200 is constructed from a collection of identical panels 203. A portion of an image is presented by each panel 203. In an embodiment, the multiplicity of panels 203 operate to present an image for viewing. Each panel 203 may have multiple picture elements (pixels). Each pixel may include one red, one yellow, and one green light or three other colored lights that may be used to produce or approximate a full spectrum of visible colors (e.g., magenta, cyan, and yellow; or red, blue and green). In an embodiment, each panel 203 has 256 pixels arranged in an array having 16 pixels along the length and 16 pixels along the width. In an embodiment, each light of each pixel of panel 203 may be individually addressed, and the brightness of each LED may be individually controlled. As a consequence of being able to control the brightness of each light individually, modular system 200 may display a wide variety of patterns and colors. In an alternative embodiment, the pixels of each panel 203 may be grouped together into groups that are addressed together. For example, in an embodiment all of the lights of a particular color of one panel 203 are all sent the same signal, placing all of the lights of a particular color in the same state. In another embodiment, the pixels of each panel may be grouped into four groups in which the lights of each group of a particular color must all be set to the same state. In another embodiment, the controller can only control whether a given light is on or off, but cannot further control the brightness of any given light.

In an embodiment, above each pixel is a small flange that projects from panel 203, which acts as a visor to reduce glare that may result from light reflecting of the front of panel 203. For example, the flange may extend one or two millimeters away from the surface of the front of panel 203. In an embodiment, the front of each panel has a black color and horizontal ridges that form the background for the pixels, which further reduces glare that may otherwise result from reflections from the Sun. In FIG. 2A each panel is illustrated with horizontal black lines, which represent the ridges and flanges on the front of panels 203 for preventing glare.

Power supply 204 can be any power supply, but, in at least on embodiment, the power supply 204 may include a number of power supplies that act in a "daisy chain" from one module to the next to power modular system 200. In an embodiment, power supplies 210 include a 5V DC a power source (e.g., collection of batteries) in each panel 203. Including a power supply 204 makes the presentation display devices easier to put together and cheaper to construct the power supply 204. The power supply 204 can be attached via a typical power cable.

The controller(s) 208 can be any type of controllers that allow for communicating to the display devices what type of display should be produced at what time. In at least one embodiment, the controller(s) 208 work as a "daisy chain" connecting to the first module in a row and communicating down the row. Thus, one or more controllers may be used depending on the number of rows of modules or display devices. The controllers communicate with the display devices via communication cables. In at least one embodiment, the communication cables used will be discussed later in conjunction with FIGS. 12A1-12C5.

Returning to FIG. 2C, connecting plate 210 may be a device for connecting portions of modular system 200 together. Connecting plate 210 may be placed at the point where the corners of four panels 203 meet, and connecting plate 210 may aid in holding the four panels 203 together giving added strength to modular system 200 once assembled. Connecting plate 210 functions to reinforce the frame(s). When four panels 203 are connected together, the center corner of the respected frames forms a connection point which can accommodate a reinforcing connecting plate.

Connecting bracket 212 functions to attach one or more frames together to create a row. Connecting bracket 212 contains holes that allow for attachment to the frames. Connecting bracket 212 may also allow connection of one or more power supplies and/or controllers. Connecting bracket 212 may be used for supporting and connecting devices associate with modular system 200. For example, connecting bracket 212 may be used on the top, bottom, and/or middle of modular system 200.

Back mounting device 214 may secure modular system 200 to an external device. Back mounting device 214 may be a hook, loop, or other structure for securing modular system 200 to a structure, such as to a pole, a wall, a building, a sign, a billboard, etc.

Modular system 200 may be fabricated using modular frame and presentation components. Furthermore, modular frame and presentation components may be interchangeable across the assembly to reduced inventory and costs. The height and width of modular system 200 is variable by adding and removing panels 203. Panels 203 may be removed from the front or the rear of modular system 200, for economical access. Modular system 200 enables custom configuring the device in a multiplicity of configurations with respect to height and width. Furthermore, modular system 200 is economical to operate and maintain, as components may be removed and/or added in any time frame. Components of modular system 200 are waterproof and weatherized for operating in harsh weather environments and conditions. Components for modular system 200 may be delivered and assembled at the installation site. Frame 206 may be configured in variable heights and widths. In an embodiment, power supplies, controllers, and computing device of modular system 200 may be assembled in waterproof containment devices. In an embodiment, modular system 200 may be configured for indoor or outdoor installations and may be used for mobile applications where modular system 200 is disassembled and reassembled as needed. Furthermore, system may be assembled in a multiplicity of sizes (e.g. height and width).

In order to more easily install and maneuver modular system 200, modular system 200 may be installed without presentation devices thereby reducing the weight of the system. After installing modular system 200 without the presentation device, the presentation devices of each panel 203 is connected to individual frames.

In an embodiment, modular system 200 does not have moving parts (e.g., does not need a fan), so there is less maintenance needed over a conventional system.

Modular system 200 is protected by using marine grade components, and consequently modular system 200 does not require covering of the rear portion of the modular system 200 system, in contrast to a traditional cabinet. Furthermore, in an embodiment, each panel of modular system 200 is sealed to resist water from penetrating, and the electrical connectors connecting to each panel 203 is resistant to water penetration. As a result, modular system 200 is also resistant to dust, dirt and other particulate matter.

Referring to FIG. 2D, the bottom view shows connecting bracket 212, frame 218, and presentation device 220. In other embodiments, the bottom of modular system 200 may not have all of the elements or components listed above and/or may have other elements or components instead of or in addition to those listed.

Each panel 203 includes a frame 218 and presentation device 220. Frames 218 may be bolted or otherwise attached to one another and to connecting bracket 212. Modular system 202 and can be scaled to support a multiplicity of sizes and shapes. In at least one embodiment, the frames 218, can be assembled together to create the correct size and shape of desired the display. Then the heavier presentation devices 220 of panels 203 (also referred to as modules), can be placed in and locked either from the front or the back.

Exploded View of the System

Figure 3A:
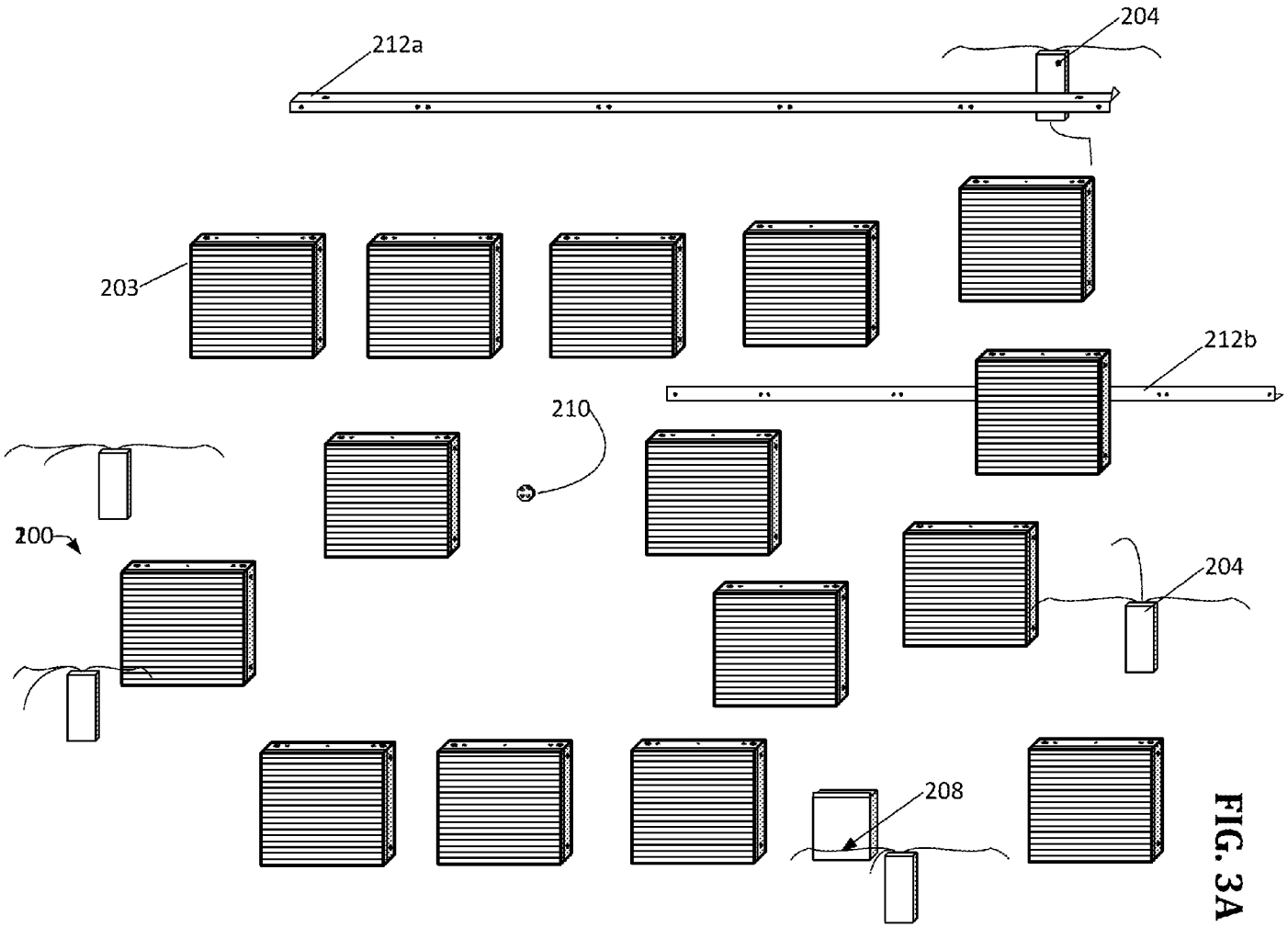
FIG. 3A illustrates an exploded view of an embodiment of a modular cabinet system.

FIG. 3A illustrates an exploded view of an example of modular system 200 of FIGS. 2A-2E. FIG. 3A illustrates an embodiment of a modular system 200 which may include embodiments of modular system 202, power supply 204, controller 208, connecting plate 210, and connecting bracket 212. In other embodiments, modular system 200 may not have all of the elements or components listed above and/or may have other elements or components instead of or in addition to those listed.

FIG. 3A shows how the different components of modular system 200 fit together.

As illustrated in FIG. 3A, panels 203 are connected side to side with the connectors providing connections for communication and power between the devices without needing wires for providing power and communications between the devices. The assembly of panels 203 are attached to top bracket 112A1-12A4 and bottom bracket 112B1-12B5, to help hold panels 203 together, via one set of fasteners (e.g., screws). Connection plates 210 are connected to the backs of panels 203 at the point of where the corners of four panels meet to aid in holding the panels together, via another set of fasteners (e.g., screws). Controllers 204 and power supplies 208 are attached to the backs of panels 203. Data and/or power connections are attached to the backs of panels 203 communicatively and/or electrically connecting panels 203 to one another and to controller 204 and power supply 208. The power connectors and communication lines may connect, via the backs of panels 203 to a single PCB board on which LEDs are mounted. The PCB board has printed wires and that connect to the LEDs, which power and control the LEDs.

A Display Panel

FIGS. 3B1-3B6

FIGS. 3B1-3B6 will be discussed together. FIGS. 3B1-3B6 illustrate an embodiment of the modular system 200 as described with reference to FIGS. 2A-2E. Modular system 200 does not require a cooling device (fan) for operation. Modular system 200 includes panel 203 having holes 301*a*, flanges 301*b*, a frame 302, a presentation device 304, a locking device 306 a cable support 308. In other embodiments, modular system 200 may not have all of the elements or components listed above and/or may have other elements or components instead of or in addition to those listed.

FIG. 3B1 is a front panel of panel 203. FIG. 3B2 is a side view of panel 203. FIG. 3B3 is a back view of panel 203. FIG. 3B4 is a bottom view of panel 203. FIG. 3B5 is an exploded view of panel 203. FIG. 3B6 is a perspective view of panel 203.

Holes 301*a* are holes in the display side of the presentation device, via which a screw driver or Allen wrench may be inserted to turn a locking device mounted on the back side of the presentations device. Flanges 301*b* protrude from the display side of the presentation device. There is one flange 301*b* above each pixel, which reduces glare. Each flange may be the same length as the pixel or slightly shorter than the width of the pixel. Alternatively, there may be one long flange 301*b* above each row or pixels. Frame 302 may be an embodiment of frame 218. Frame 302 provides support for devices associated with modular system 202. Frame 302 may be connected to other frames so that panels 203 may be connected to one another. Frame 302 connects to presentations device 304, which may be an embodiment presentation device 216. Frame 302 may be connected to other frames that are above, below and left or right of the presentation device to form a complete system 100 (FIG. 1). Although in the embodiment shown in the FIG. 3B1-3B6 panel 203 has an open back, in an alternative embodiment, panel 203 has a back cove to protect panel 203.

In at least one embodiment, the frame 302 may include a top frame wall, a left frame wall, a bottom frame wall, a right frame wall, a corner bracket and a grommet. The frame 302 and the components of frame 302 are discussed in more detail in FIG. 3C1 through FIGS. 5A-5E. While the frame 302 and presentation device may be fabricated separately, in an alternative embodiment, frame 302 and presentation device are fused together with frame 302 and presentation device assembly fabricated as one piece.

Presentation device 304 presents an image for viewing. In at least one embodiment, presentation device 304 has a display side having a series of light-emitting diodes (LEDs) that can be controlled in such a way that they can create displays (words, pictures, movement, flashing, and other visual displays). In at least one embodiment, optionally the display may also have an audio portion. In at least one embodiment, the display may change with time. In at least one embodiment, one or more separate displays may be produced on the same display device. For example, a billboard might have a single advertisement, or might have multiple advertisements that are each shown for a given time. Presentation device 304 has holes 301*a* that extend from the display side of the presentation device to the backside of presentation device 304, via which a screwdriver or Allen wrench may be inserted to turn a locking device mounted on the backside of the presentations device. Presentation device 304 has flanges 301*b* that protrude from the display side of the presentation device to reduce glare.

Locking device 306 holds presentation device 304 to frame 302, holding presentation device 304 in place. Although in the embodiment of FIG. 3 there are 4 locking devices (one near each corner of frame 302 and presentation device 216), in other embodiments, there may be a different number of locking devices 306. The locking device 306 can be operated from the front or the back, making the attachment and detachment of the frames easy. In an embodiment, there is a hexagonal shaped recessing the bottom of locking device 306 (the hole is in the side facing the presentation device 304). Holes 301*a* extends from the display side of presentation device 304 to the back of presentations device 304, allowing an Allen wrench to be inserted and engage with the recess in the bottom of locking device 306, via which, locking device 306 may be turned by turning the Allen wrench. Providing access to locking device 304 from the display side (which is the side on which the lights are mounted) of presentation device 304, allows for ease of assembly and maintenance of system 100. The locking device 306, is discussed in more detail in FIGS. 10, 11A and 11C.

Cable support 308 provides support for communication and/or power cables. Cable support 308 keeps the cables organized. Cable support 308 provides support for communication and power cables associated with modular system 202. Cable support 308 is discussed in more detail in FIG. 8A-8D. Cable support 308 is optional.

The Frame of a Display Panel

FIGS. 3C1-3C9

FIGS. 3C1-3C9 illustrates the frame 302, as described with reference to FIGS. 3B1-3B6, in accordance with an embodiment of the present invention where top, bottom and side components are connected via corner brackets and grommets to form the frame. FIGS. 3C1-3C9 illustrates frame 302, which may include a top frame wall 352, a left frame wall 354, a right frame wall 358, a bottom frame wall 360, one or more corner brackets 362 and one or more fasteners 356 grommet 362. In other embodiments, frame 302 may not have all of the elements or components listed above and/or may have other elements or components instead of or in addition to those listed.

FIG. 3C1 shows a left side view of the frame 302. FIG. 3C2 shows a top view of frame 302. FIG. 3C3 shows a front view of frame 302. FIG. 3C4 shows a right sideview of frame 302. FIG. 3C5 shows a cross section of frame 302 along line M-M of FIG. 3C4. FIG. 3C6 shows an exploded view of frame 302. FIG. 3C7 shows a bottom view of frame 302. FIG. 3C8 shows a blowup of detail N, which is a cross section of a screwhole. Detail N is circled and shown in FIG. 3C5 in the bottom left corner of frame 302. FIG. 3C9 is a perspective view of frame 302.

Referring to FIG. 3C5, top frame wall 352 is the piece of material used for one wall of frame 302. Left frame wall 354 is the piece of material used for one wall of frame 302. Fasteners 356 attach the walls of frame 302 to brackets that hold frame 302 together. Fasteners 356 may be grommets, rivets, bolts, and/or other fastening devices. In an embodiment, faster 356 is a grommet, through which a screw may be inserted to connect tow frames 302 to one another. In other words, in addition to securing a frame wall to a corner bracket, the grommet also reinforces the hole that remains after the corner bracket is attached to the frame wall so that a screw may be inserted to attach tow adjacent frames to one another. Right frame wall 358 is the piece of material used for one wall of frame 302, and bottom frame wall 360 is the piece of material used for one wall of frame 302. Top frame wall 352, left frame wall 354, right frame wall 358, and bottom frame wall 360 may be identical or very similar to one another. In an embodiment, each of top frame wall 352, left frame wall 354, right frame wall 358, and bottom frame wall 360 may be have two side flanges extending the length of the frame wall, which are folded to be perpendicular the main body of the frame wall and to the outer surface of the frame wall. The main body of the frame wall and the two flanges form a channel. In an embodiment, top frame wall and/or bottom frame wall 360 may have a drain hole that is not present in left frame wall 354 and right frame wall 358. Top frame wall 352, left frame wall 354, right frame wall 358, and bottom frame wall 360 may be connected, via corner brackets 362, and fasteners 356 to form frame 302. Frame walls 352, 354, 358 and 360 each connect via two bolts/rivets per side and can be connected on the four sides. Assembly of frame 302 may be initiated by creating a square frame composed of the four frame walls (top frame wall 352, a left frame wall 354, a right frame wall 358, a bottom frame wall 360). In at least one embodiment, the frame walls may be made from aluminum. In at least one embodiment, frame wall may be made by bending aluminum sheets. In at least one embodiment, the frame walls may be of equal length. In at least one embodiment, the frame walls may be connected together at the corners by a molded aluminum brackets 362.

Corner brackets 362 may attach the frame walls (352, 354, 358, and 360) together. In at least one embodiment, corner brackets 362 are made of molded aluminum. Corner brackets 362 may be attached to the corners of the frame, via fasteners 356. Corner brackets 362 may have holes in order to accommodate screws, grommets, or rivets via which connection places 210 may be attached to corner brackets 362.

As discussed in FIG. 3A, the frame 302 then connects to other frames 302 via grommets and/or screws in holes located towards the edges of frame walls 352, 354, 358 and 360.

Once the frame 302 has been assembled, the presentation devices 216 and/or 304 may be attached to frame 302 to form panel 203.

Presentation devices 216 may be attached, via locking devices. Locking devices 306 may be opened or closed (locked) from the front of the system 100 or from the rear of the system 100 by twisting the lock to the open position.

Referring to FIG. 3C8, detail N includes frame wall 354, corner bracket 362, and grommet 364. In other embodiments, frame Detail N may not have all of the elements or components listed above and/or may have other elements or components instead of or in addition to those listed. Frame wall 354 and corner bracket 362 were discussed in FIG. 3C5. The holes in frame wall 354 and corner bracket 362 are aligned, prior to being pressed together, and a grommet 364 is inserted into the aligned holes. The grommet 364 is pressed to press frame wall 354 and corner bracket 362 together. Grommet 364 is an embodiment of fastener 356. The grommets 364 reinforce the holes through which screws are placed to hold the frames together. Optionally, the grommet 364 may have threads that engage screws. Each frame wall may have two grommets one at each end. In another embodiment, each frame wall has four grommets two at each end or has another number of grommets. In another embodiment, not all frame walls have grommets. Instead, a frame wall having grommets of one frame is placed adjacent to a frame wall not having grommets of another frame to attach the two frames to one another.

FIGS. 3C1-3C9 also provides specific dimensions for an embodiment of each of the parts of the frame 302. In FIGS. 3C1-3C9, dimensions for the frame 302 are provided with specific examples of how the frame 302 can be constructed. In at least one embodiment, frame walls 352, 354, 358, and 360 can be connected using any means. However, in at least one embodiment, the frame walls are connected to form the frame 302 using grommets.

In at least on embodiment, frame walls 352, 354, 358 and 360 may be made from any material that will not be changed by the heat produced from running system 100 (if any is produced). In at least one embodiment, the aluminum can be shaped in any way. But, in at least one embodiment, the aluminum is bent aluminum.

In at least one embodiment, the frame walls 352, 354, 358 and 360 may be connected together at the corners by any means. However, in at least one embodiment, the frame walls are connected together using a connecting corner bracket (which may also be molded aluminum). The frames 302 can then be interlocked and scaled to support a multiplicity of sizes and shapes. In this way, display devices of a wide variety of sizes and shapes can be produced by attaching frames together as needed. FIGS. 4A-4D The perspective view of FIG. 3C9 show the flanges 366 of the frame walls and the main bodies 368. The flanges 366 are at a 90 degree angle to main bodies 368. Locking devices 306 engage the flanges 366 that face presentation device 216 to hold frame 302 to presentation device 216.

The Sidewalls of the Frame

FIGS. 3D1-3G7

FIGS. 3D1-3D7 illustrates the top frame wall as described with reference to FIGS. 3C1-3C9, in accordance with an embodiment of the present invention. FIG. 3D1 is a top view of the of top frame wall 352. FIG. 3D2 is a cross sectional view of top frame wall 352 taken along line I-I of FIG. 3D1. FIG. 3D3 is a side view of top frame wall 352. FIG. 3D4 is a cross sectional view of top frame wall taken along line J-J of FIG. 3D3. FIG. 3D5 is a view of top frame wall 352 from one end of top frame wall 352. FIG. 3D6 is a cross sectional view of top frame wall 352 taken along line H-H of FIG. 3D1. FIG. 3D7 is a perspective view of top frame wall 352. In FIGS. 3D1-3D7, specific dimensions are provided for an embodiment of the top frame wall 352, including the positioning of the holes for the fasteners (grommets or rivets), hooks for cable supports and holes for drains (to allow rain water to escape through the bottoms and tops of the frames). If frame 302 is part of a panel that has another panel above the current frame 302, water from the upper frame may escape via a drain hole in the bottom of the upper frame through the drain hole in the top of the current frame 302, which collects in the bottom frame wall and drains through a drain hole in the bottom frame wall.

FIGS. 3E1-3E6 illustrates the left frame wall as described with reference to FIGS. 3C1-3C9, in accordance with an embodiment of the present invention. FIG. 3E1 is a side view of the of left frame wall 354. FIG. 3E2 is a cross sectional view of left frame wall 354 taken along line G-G of FIG. 3E1. FIG. 3E3 is a view of another side that is perpendicular to that of FIG. 3E1 of left frame wall 354. FIG. 3E4 is a view of left frame wall 354 from one end of left frame wall 354. FIG. 3E6 is a cross sectional view of left frame wall 354 taken along line F-F of FIG. 3E1. FIG. 3E7 is a perspective view of left frame wall 354. FIGS. 3E1-3E6 provide specific dimensions for an embodiment of the left frame wall 354, including the positioning of the holes for grommets, rivets, or screws.

FIGS. 3F1-3F6 illustrates the right frame wall as described with reference to FIGS. 3C1-3C9, in accordance with an embodiment of the present invention. FIG. 3F1 is a side view of the of right frame wall 358. FIG. 3F2 is a cross sectional view of right frame wall 358 taken along line D-D of FIG. 3F1. FIG. 3F3 is a view of another side that is perpendicular to that of FIG. 3F1 of right frame wall 358. FIG. 3F4 is a view of right frame wall 358 from one end of right frame wall 358. FIG. 3F6 is a cross sectional view of right frame wall 358 taken along line C-C of FIG. 3F1. FIG. 3F7 is a perspective view of right frame wall 358. FIGS. 3F1-3F6 provides specific dimensions for an embodiment of the right frame wall 358, including the positioning of the holes for the grommets, rives or screws.

FIGS. 3G1-3G7 illustrates the bottom frame wall as described with reference to FIGS. 3C1-3C9, in accordance with an embodiment of the present invention. FIG. 3G1 is a bottom view of the of bottom frame wall 360. FIG. 3G2 is a cross sectional view of bottom frame wall 360 taken along line B-B of FIG. 3G1. FIG. 3G3 is a side view of bottom frame wall 360. FIG. 3G4 is a cross sectional view of bottom frame wall 360 taken along line E-E of FIG. 3G3. FIG. 3G5 is a view of bottom frame wall 360 from one end of bottom frame wall 360. FIG. 3G6 is a cross sectional view of bottom frame wall 360 taken along line A-A of FIG. 3G1. FIG. 3G7 is a perspective view of bottom frame wall 360. FIGS. 3G1-3G7 provides specific dimensions for an embodiment of the bottom frame wall 360, including the positioning of the holes for the grommets, holes for screws, holes for rivets, and/or holes for drains.

The Grommet

FIGS. 4A-4D

Figure 4A:
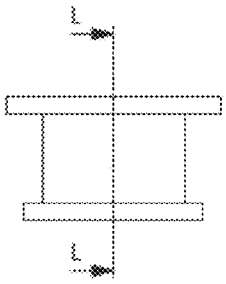
FIGS. 4A-4D illustrates an embodiment of the grommet as described with reference to FIGS. 3C1-3C9.
Figure 4B:
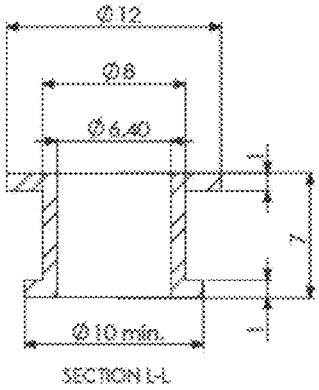
Figure 4C:
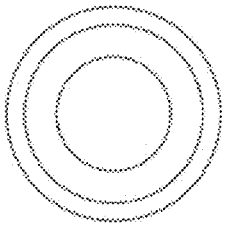
Figure 4D:
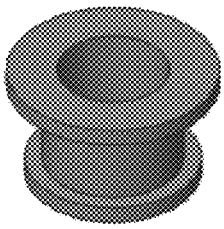

FIGS. 4A-4D illustrates a grommet 356 as described with reference to FIGS. 3C1-3C9, in accordance with an embodiment of the present invention. FIG. 4A is a side view of grommet 356. FIG. 4B is a cross sectional view of grommet 356. FIG. 4C is a bottom view of grommet 356 in which the end of grommet 356 with the smaller flange faces the page. FIG. 4D is a perspective view of grommet 356. FIGS. 4A-4D provides specific dimensions for an embodiment of the grommet 356. The grommet 356 can be used to attach the parts of the frame together, including the frame walls and the corner brackets 362. The rivet or screws may also be used to attach the connecting plate 210 (which will be discussed further in conjunction with FIGS. 6A-6D), top bracket 212*a* and bottom bracket 212*b* (which will be discussed further in conjunction with FIGS. 7A-7E), back mounting device 214 (which will be discussed further in conjunction with FIGS. 9A-9D), locking device 306 (see FIGS. 10A-10F) to each other and/or to the presentation device 216.

The Corner Bracket

FIGS. 5A-5E

Figure 5A:
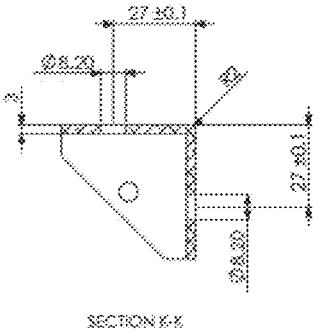
FIGS. 5A-5E illustrates an embodiment of a corner bracket as described with reference to FIGS. 3C1-3C9.
Figure 5B:
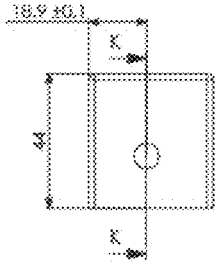
Figure 5C:
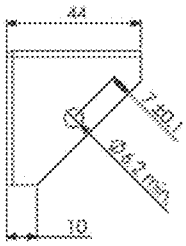
Figure 5D:
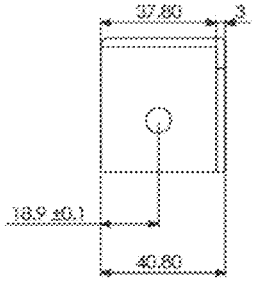
Figure 5E:
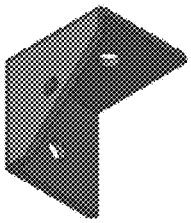

FIGS. 5A-5E illustrates the corner bracket as described with reference to FIGS. 3C1-3C9, in accordance with an embodiment of the present invention. FIG. 5A is a cross sectional view of corner bracket 362 taken along line K-K of FIG. 5B. FIG. 5B is a side view of corner bracket 362 taken (showing line K-K). FIG. 5C is view of another side of corner bracket 362. FIG. 5D is a view of yet another side of corner bracket 362. FIG. 5E is a perspective view of corner bracket 362. FIGS. 5A-5E provides specific dimensions for an embodiment of the corner bracket 362. With reference to FIGS. 3C1-3C9, the corner bracket can be used to attach the frame walls to each other. In at least one embodiment, the corner bracket has holes for grommets. These holes are also found in the appropriate position on the frame walls and allow attachment of the corner brackets to the frame walls. In at least one embodiment, the holes allow for attachment using a grommet as shown in FIGS. 4A-4D.

The Connecting Plate

FIGS. 6A-6D

Figure 6A:
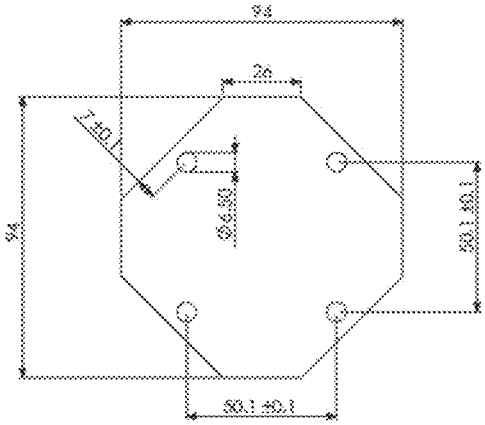
FIGS. 6A-6D illustrates an embodiment of a connecting plate as described with reference to FIG. 3A.
Figure 6B:
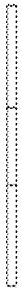
Figure 6C:
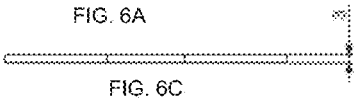
Figure 6D:
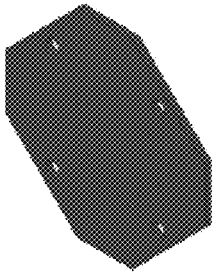

FIGS. 4A-4D FIGS. 6A-6D illustrates the connecting plate as described with reference to FIGS. 2A-2E, in accordance with an embodiment of the present invention. FIG. 6A shows a top view of connection plate 210. FIG. 6B is a side view of connection plate 210. FIG. 6C is a side view of another side of connection plate 210. FIG. 6D is a perspective view of connection plate 210. FIGS. 6A-6D provides specific dimensions for an embodiment of the connecting plate 210. Connecting plate 210 (see FIG. 3A1-3A9) can be used to reinforce the attachment of the frames. When four frames 302 are connected together, the center corner of the respected frames forms a connection point, which can accommodate connecting plate 210.

The Top Bracket

FIGS. 7A-7E

Figure 7A:
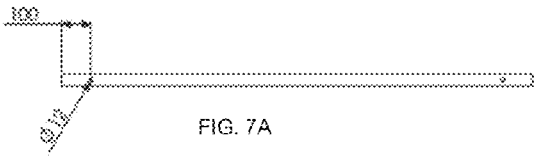
FIGS. 7A-7E illustrates an embodiment of a connecting bracket with reference to FIG. 3A.
Figure 7B:
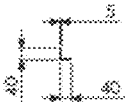
Figure 7C:
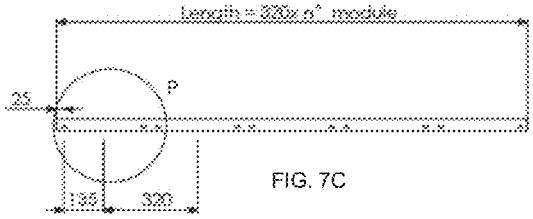
Figure 7D:
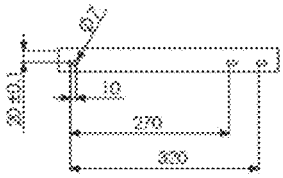
Figure 7E:
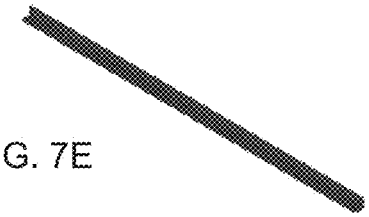

FIGS. 7A-7E illustrates the top bracket 212*a* as described with reference to FIGS. 2A-2E. FIG. 7A is a side view of top bracket 212*a*, which shows the portion of top bracket 7A that lies flat on the top back portions of the frames 302 at the top of system 100. The two holes may be used of attach bracket 212*a* to the top back portion of an array of frames 302. FIG. 7B shows a view from an end of top bracket 212*a*. FIG. 7C is a view of another side of top bracket 212*a*, which shows the portion of top bracket 212*a* that extends away from system 100 to which hooks may be attached for supporting cable. FIG. 7D shows a blowup of the portion of top bracket within circle P of FIG. 7C. FIG. 7E shows a perspective view of top bracket 212*a*. FIGS. 7A-7E provides specific dimensions for an embodiment of the top bracket 212*a*. With reference to FIG. 3A, the top bracket 212*a* (see FIG. 3A) allows for attachment of the frames together and/or to the power supply. The top bracket 212*a* allows for inclusion of wires that attach the power supply to each presentation device (see 202 in FIG. 3A). The top bracket 212*a* also includes holes for attachment of the power supply 110 and 208, frames 302, and/or brackets 212*a* and 212*b*. In an embodiment bottom bracket 212*b* is identical to top bracket 21*a*.

The Cable Support

FIGS. 8A-8D

Figure 8A:
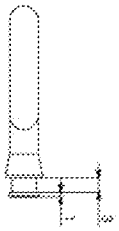
FIG. 8A-8D illustrates an embodiment of a cable support with reference to FIGS. 3B1-3B6.
Figure 8B:
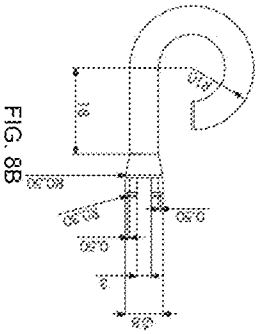
Figure 8C:
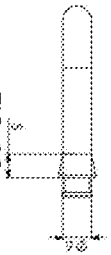
Figure 8D:
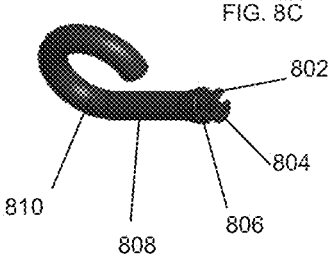

FIGS. 8A-8D illustrates the cable support as described with reference to FIGS. 3B1-3B6, in accordance with an embodiment of the present invention. FIG. 8A shows the front of cable hook 800. FIG. 8B shows the side of cable hook 800. FIG. 8C shows the back of cable hook 800. FIG. 8D a perspective view of cable hook 800. FIGS. 8A-8D provide specific dimensions for an embodiment of the cable support 308. With reference to FIGS. 3B1-3B6, the cable support (see 308 in FIGS. 3B1-3B6) provides support for communication and power cables.

FIG. 8D shows an embodiment of a cable hook 800 having legs 802 and 804, skirt 806, straight portion 808, and hook 810. In other embodiments, cable hook 800 may not have all of the elements or components listed above and/or may have other elements or components instead of or in addition to those listed.

Legs 802 and 804 engage a hole in frame 302. Skirt 806 aids legs 802 and 804 engage the hole in the frame 302. Straight portion 808 places the hook at a desired length from the point at which cable hook 800 attaches to frame 302. Hook 810 is a curved portion that supports a cable. Cable hood 800 may be an embodiment of cable hook 308 (FIG. 3B5).

Back Mounting Device

FIGS. 9A-9D

Figure 9A:
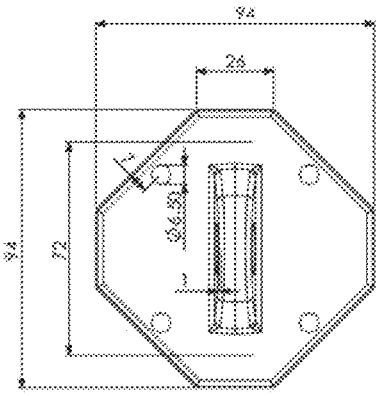
FIGS. 9A-9D illustrates an embodiment of a back mounting device with reference to FIGS. 2A-2E.
Figure 9B:
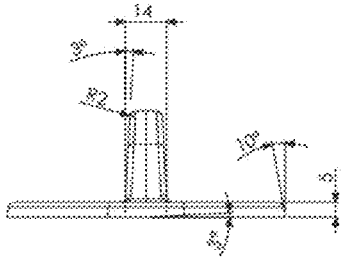
Figure 9C:
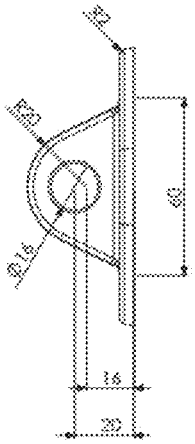
Figure 9D:
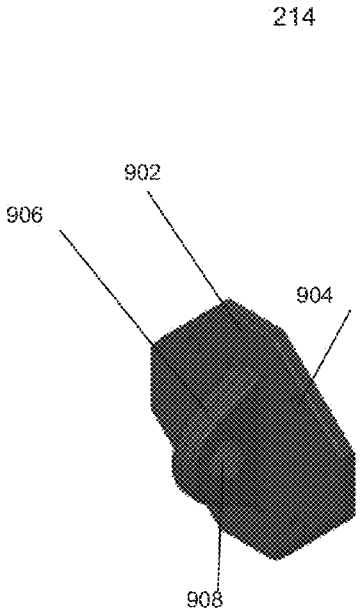

FIGS. 9A-9D illustrates the back mounting device as described with reference to FIGS. 2A-2E, in accordance with an embodiment of the present invention. FIG. 9A is a top view of mounting device 214. FIG. 9B is a front view of mounting device 214. FIG. 9C is a side view of mounting device 214. FIG. 9D shows a persepctive view of back mounting device 214. Back mounting device 214 may have plate 902, holes 904, handle 906 and handle hole 908. Plate 902 connects to the back of presentation device 216. Holes 904 accept screws and attach back mounting device 214 to frame 302. Handle 906 may be used to attach frame 302 to another structure. Handle hole 908 is a hole in handle 906, through which a rope may be inserted to hold the frame to a structure. FIGS. 9A-9D provide specific dimensions for an embodiment of the back mounting device 214. With reference to FIGS. 2A-2E, the back mounting device (see 214 in FIGS. 2A-2E) allows for attachment of the presentation display device assembly onto the support. For example, a support for a wall mounted display device assembly would be a wall. A support for a billboard display device assembly would be a billboard. One or more mounting devices (e.g., brackets) may provide physical connections between presentation devices and other supporting structures and assemblies. Mounting devices enable connecting presentation devices in a multiplicity of configurations.

Presentation device 304 is supported via mounting devices (e.g. mounting brackets) 214 connected to a rear panel. The rear panel provides sufficient support for the presentation device and mounting devices (e.g. mounting brackets).

The Locking Device

FIGS. 10A-10F

Figures 10A, 10B, 10C, 10D, 10E, 10F:
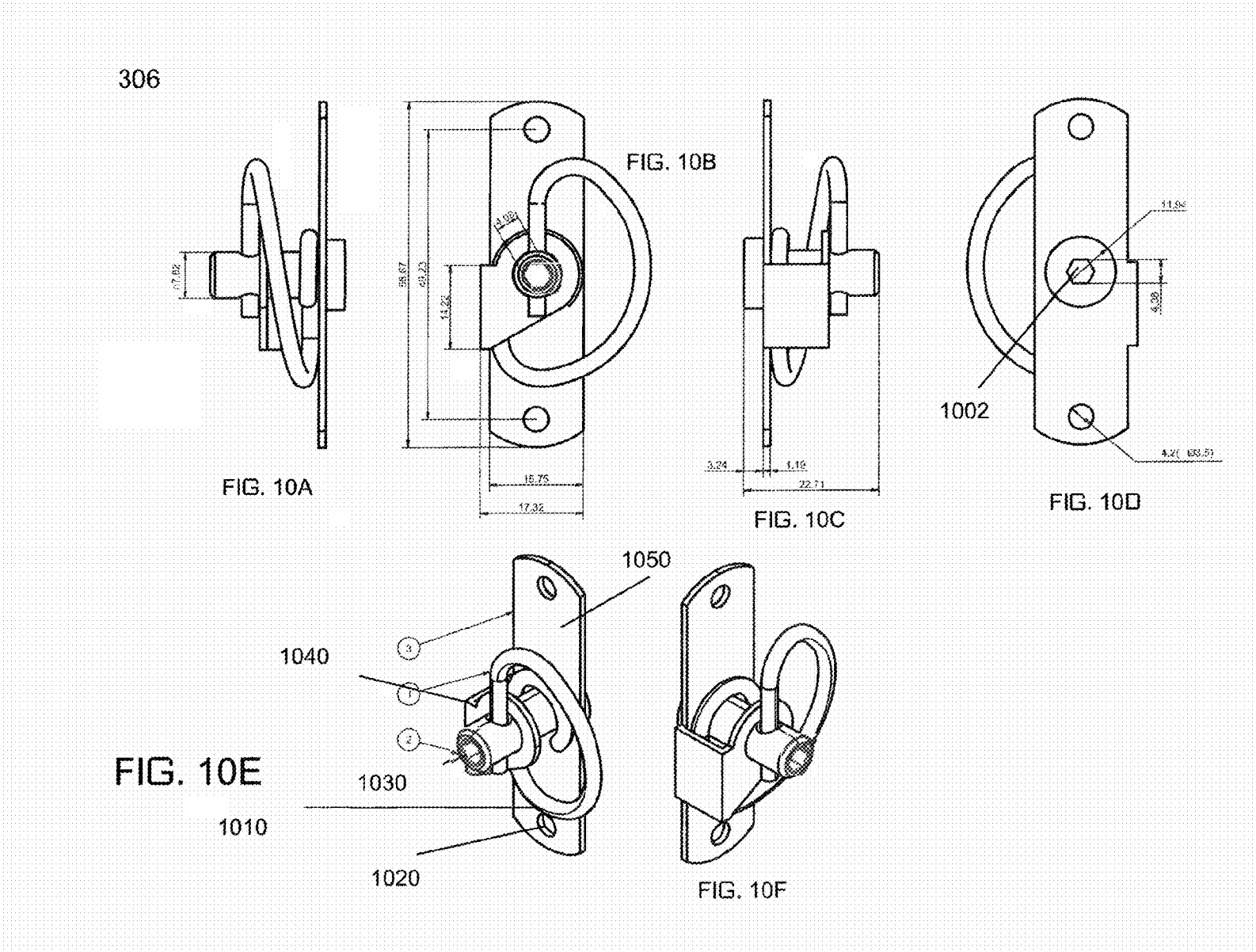
FIGS. 10A-10F illustrates an embodiment of a locking device with reference to FIGS. 3B1-3B6.

FIGS. 10A-10F illustrates an embodiment of a locking device 306 with reference to FIGS. 3B1-3B6. FIG. 10A is a right side of locking device 306. FIG. 10B is a top view of locking device 306. FIG. 10C is a left side of locking device 306. FIG. 10D is a bottom view of locking device 306. FIG. 10E is a perspective view of locking device 10E with the locking device angled to the left showing a portion of the right side of locking device 306. FIG. 10F is a perspective view of locking device 306 with the locking device angled to the right showing a portion of the left side of locking device 306. Referring to FIG. 10D, locking device 306 may include recess 1002. Referring to FIG. 10E, locking device 306 may also include a loop 1010, one or more holes 1020, a bolt 1030, a casing 1040 and a backing 1050. In other embodiments, locking device 306 may not have all of the elements or components listed above and/or may have other elements or components instead of or in addition to those listed.

FIGS. 10A-10F provides specific dimensions for an embodiment of the locking device 306. The locking device functions to lock the frames together and/or to lock the display devices together to create a larger display device as needed. Locking device 306 is essentially a screw with an extended head. The locking device can be manipulated from the front or the back to lock or unlock frames from each other. Being able to access locking device 306 from the display side of panel 203 allows for easier manipulation when creating the display device or taking the display device apart.

In other embodiments, locking device 306 may not have all of the elements or components listed above and/or may have other elements or components instead of or in addition to those listed.

Recess 1002 is a well or recess in the bottom locking device 306. In the embodiment of FIGS. 10A-10F, recess 1002 has a hexagonal shape for engaging with an Allen wrench. However, a slot for screwdriver or a four-pointed star shaped recess for accepting a Philips head screwdriver can be substituted. By inserting a tool (e.g., an Allen wrench or screwdriver) through a hole in the display side of the panel 203, recess 1002 may be access and engaged, thereby allowing the tool to rotate locking device 306 from the display side of the panel 203, locking or unlocking locking device, by rotating the tool.

The loop 1010 can be configured to form a coil or loop that allows for turning and attaching to an attachment on a second display device locking them together. Loop 1010 is rigid and/or resilient. The loop 1010 forms a semicircular extension of the head of locking device 306. Locking device 306 screws into the back of presentation device 216 at a location near where a flange frame 302 meets the back of presentation device 216. In the locked position loop 1010 rests on top of the flange holding the flange against the back of the presentations device 216. In the unlocked position, loop 1010 covers a region of the back of presentation device 216, which does not have the flange. In an embodiment, there are four locking devices 306, one near each corner of presentations device 203, which is also near a corner of frame 302. When all four locking devices 306 are in the unlocked position, presentation device 216 detaches from frame 302 and may be removed from frame 302. Although FIG. 3A3 show four locking devices on the display device, any number of locking devices can be included at different locations where frame 302 meets presentations device 216. In at least one embodiment, two or more locking devices 306 are included. In at least one embodiment, end pieces or display devices that are fit onto the outsides of the rows may only need one or more locking devices on one side.

The one or more holes 1020 in the backing of the locking device function to allow attachment of the locking device to the back of the presentation device 216. The one or more holes allow for the use of rivets, nails, snaps or any type of fastener that can fit through the hole and attach the locking device to the back of the presentation device 216.

The bolt 1030 functions to attach the loop to the backing and can be used to turn the loop 1010 so that loop 1010 fits over a flange of frame 302. The bolt 1030 has threads for screwing into the back of presentation device 216. Recess 1002 is at an end facing the viewing of system 100, and is accessible via a hole in presentation device 216. Bolt 1030 may also have a recess on the end facing a viewer of the back of the system 100, which may also be used by an Allen wrench or screwdriver to screw in or unscrew locking device 306.

The casing 1040 holds the bolt 1030 and loop 1010 onto the backing 1050 so that the locking device can function. Casing 1040 helps keep bolt 1030 straight while being screwed in and prevents bolt 1030 from being removed from the rest of the assembly and being misplaced. In other words, once locking device 306 is attached to the back of presentation device 306, there is no need to remove locking device 306. Frame 302 may be attached or detached from presentation device 216 by turning locking device 306, without removing locking device 306 from presentation panel 216.

The backing 1050 allows has holes 1020 for attachment of the locking device to the back of the display device. Backing 1050 may have a thickness that is the same as or slightly less than the thickness of the flanges of frame 302, so that locking device engages the flanges in a firm manner when in the locked position.

The Presentation Device

FIGS. 11A-11D

Figure 11A:
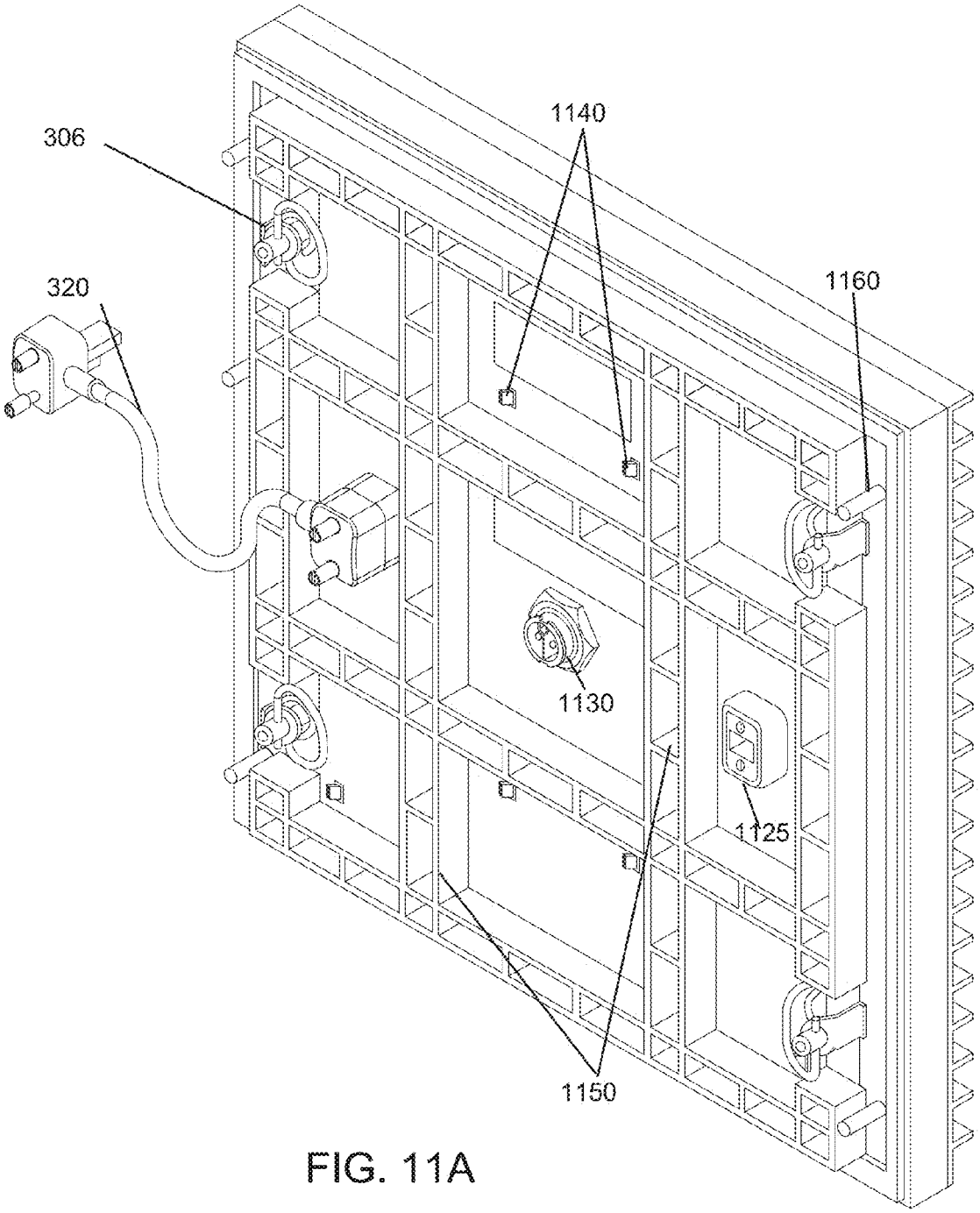
FIG. 11A illustrates a back angular view of another embodiment of a modular presentation device with an example of a communication cable attached.
Figure 11B:
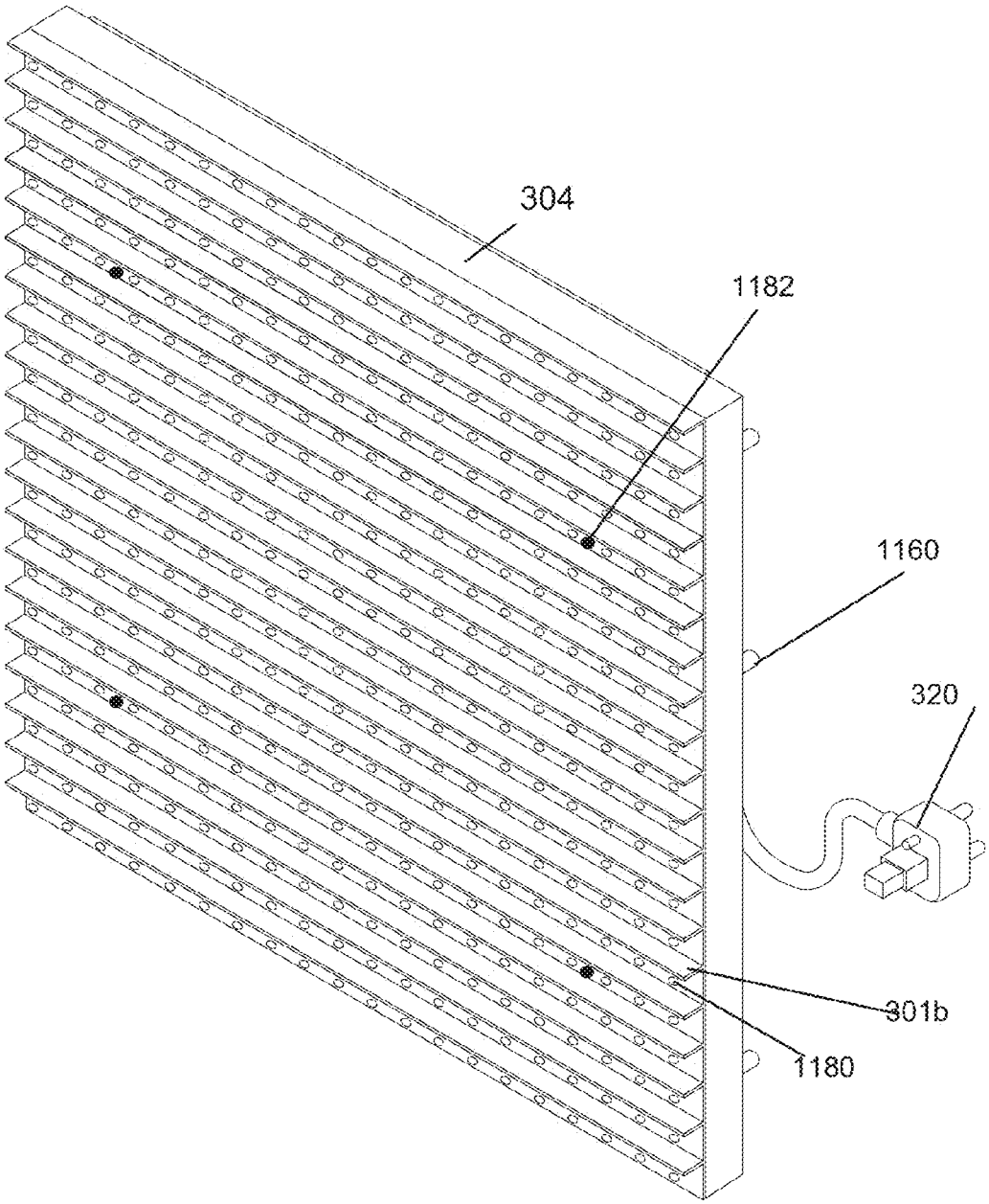
FIG. 11B illustrates a front angular view of another embodiment of a modular presentation device with an example of a communication cable attached.
Figure 11C:
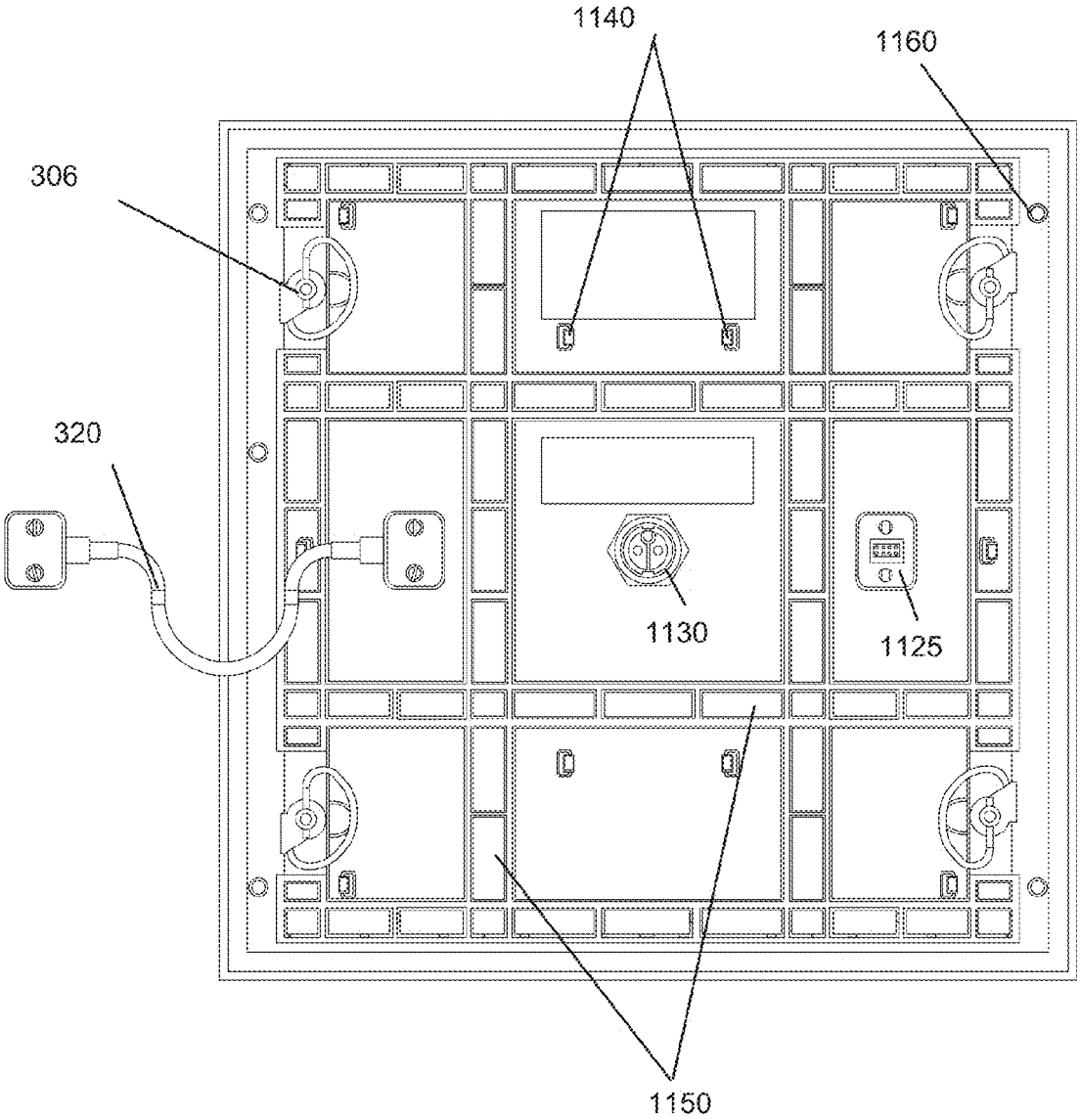
FIG. 11C illustrates a back view of another embodiment of a modular presentation device with an example of a communication cable attached.

FIGS. 11A and 11C illustrate back views of another embodiment of a modular presentation device 304 with an example of a communication cable 320 attached. FIG. 11A is an angular view and FIG. 11C. Modular presentation device 304 may include locking device 306, communication cable 320, communication cable port 1125, power cable connector 1130, connector(s) 1140, ribs 1150, and dowels 1160. In other embodiments, presentation device 216 may not have all of the elements or components listed above and/or may have other elements or components instead of or in addition to those listed.

Locking device 306 can be any device that allows for locking the display to the frames. In at least one embodiment, locking device is the locking device shown in FIGS. 10A-10F. Locking device 306 functions to lock the frames to the display devices. The locking device can be manipulated from the front or the back to lock or unlock frames from display devices as needed. This allows for easier manipulation when creating the modular presentation device or taking the modular presentation device apart.

Communication cable 320 allows communication with a display device and/or between display devices (see also FIGS. 12A1-12C5). The communication cable 320 may allow the controller to communicate bi-directionally with other controllers and/or computer(s). In at least one embodiment, communication cable also provides power to the display devices.

Communication cable port 1125 allows attachment of a communication cable that allows communication between display devices. In at least one embodiment, communication cable port 1125 allows attachment of one of the communication cables shown in FIGS. 12A1-12A4-12C1-12C5. Power cable connector 1130 allows for connection of a power supply.

Connector(s) 1140 hold presentation device 304 together. Connectors 1140 are optional. Presentation device 304 maybe held together in other manners. Presentation device 304 includes a multiplicity of connectors 1140 in the rear of the device. Connectors 1140 may provide power and/or communications to presentation device 304. As a non-limiting example, connectors 1140 may be waterproof. In at least one embodiment, presentation device 304 includes a multiplicity of connectors 1140 in the side of the presentation device. Connectors 1140 may provide power and/or communications to presentation device assembly 102. Placing presentation device assembly 102 next to another presentation device assembly enables power and communication between the devices via connector. Furthermore, wires providing power and communications are not needed for this configuration.

Ribs 1150 separate parts of the display device and provide space for the locking device, communication cable port (and cable), power cable connector, and dowels to rise above the surface of the display device. In at least one embodiment, this allows for a cover to be placed over the back of the display device. In at least one embodiment, a rear cover is attached to the rear of presentation device assembly 102 for covering the rear of the device. As a non-limiting example, rear cover may be configured as solid aluminum.

The dowels 1160 engage holes in frame 302 to aid is firmly securing presentation device 304 to frame 302 once locking devices 306 are in the locked position. In at least one embodiment, the locking device is that shown in FIGS. 10A-10F.

FIG. 11B illustrates a front angular view of another embodiment of a modular presentation device 304 with an example of flanges 301*b*, a communication cable 320 attached. Presentation device 304 may include communication cable 320, dowels 1160, LEDs 1180, and holes 1182. In other embodiments, modular presentation device 304 may not have all of the elements or components listed above and/or may have other elements or components instead of or in addition to those listed.

Flanges 301*b* act as visors, shading the LEDs below flanges 301*b* from Sun light, which reduces glare, making it easier to see the pattern of LEDs that are lit during the daytime. Communication cable 320 allows communication between display devices (cable 320 will be discussed further in conjunction with FIGS. 12A1-12C5).

The dowels 1160 function to allow attachment to other display devices (those that are positioned on either side of the first display device) to create a row. The dowels can be used to attach to and/or lock into a locking device. In at least one embodiment, the locking device is that shown in FIGS. 10A-10F.

LEDs 1180 allow for production of an image on the display device. Depending on which LEDs 1180 are lit, a different pattern is produced to produce images and/or text. In other embodiments, other lights may be substituted for LEDs 1180. Flanges 301*a* shade LEDs 1180, reducing the amount of glare.

Holes 1182 penetrate through presentation device 304 extending to the bottom of locking device 306. By sticking an Allen wrench or screw driver to turn the locking device 306, locking device 306 may be turned from the locked position to the unlocked position or turned from the unlocked position to the locked position.

Figure 11D:
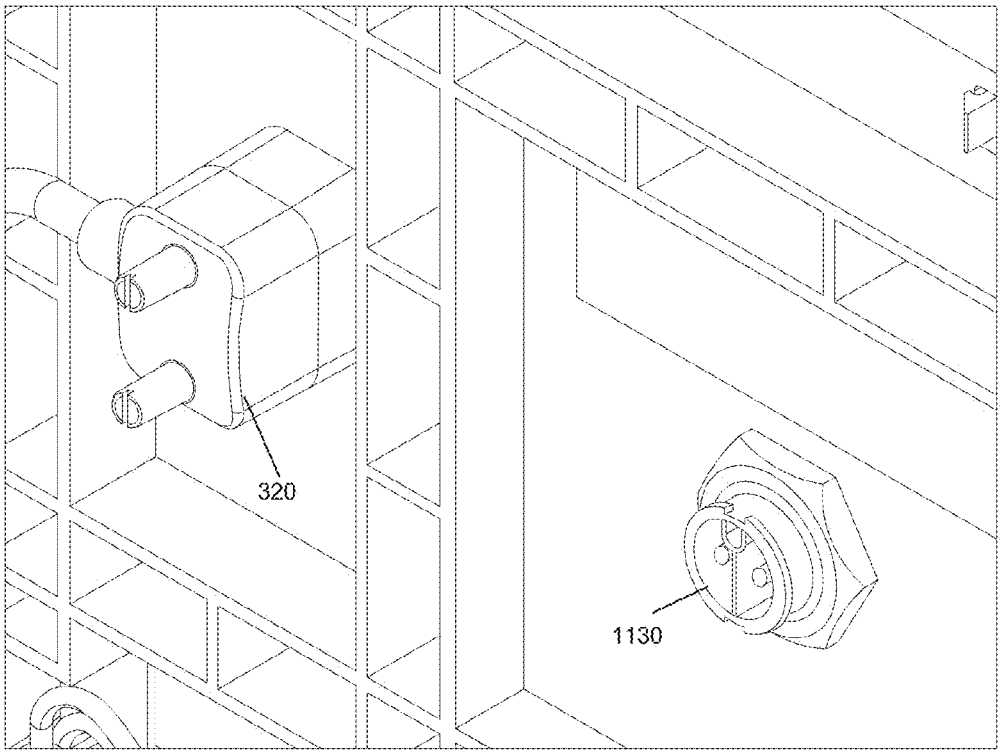
FIG. 11D illustrates a close up view of an example of a communication cable connection and an example of a power cable connector located on the back side of an embodiment of a modular presentation device.

FIG. 11D illustrates a close up view of an example of a communication cable connection and an example of a power cable connector located on the back side of an embodiment of a modular presentation device. Communication cable connection may allow attachment of any type of communication cable. However, in at least one embodiment, the communication cable connection allows attachment of the communication cable shown in FIGS. 12A1-12C5.

Communication Cable

FIGS. 12A-12C5

Figure 12A:
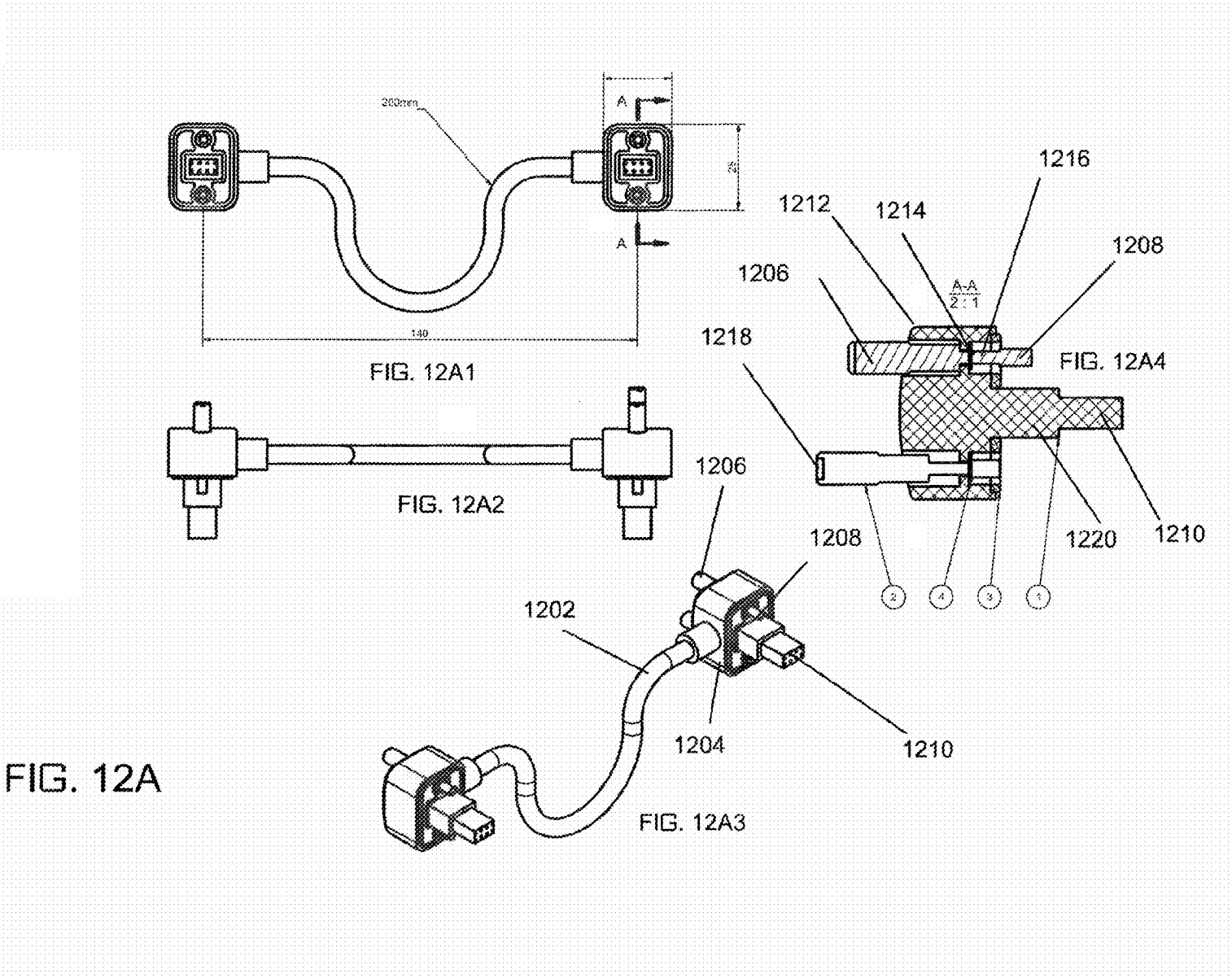

FIGS. 12A1-12A4 and 12B1-12B5 illustrate an embodiment of a communication cable 320. FIGS. 12A1-12A4 show cable 320 with screws and FIGS. 12B1-12B5 show cable 320 without screw. FIGS. 12A1 and 12B1 shows the bottom of cable 320. FIGS. 12A2 and 12B2 shows the side of cable 320. FIG. 12A3 shows a perspective view of cable 320, and FIG. 12B3 shows the bottom of the head of cable 320. FIGS. 12A4 and 12B4 show a cross sectional view of the head of cable 320 taken along the A-A line of FIGS. 12A1 and 12B1, respectively. FIG. 12B5 shows a perspective view of cable 320 without the screws.

Referring to FIG. 12A3, cable 320 has cord 1202, head 1204 (also referred of as plug 4), screws 1206 (also referred to as screws 2), and electrical connector 1208. In other embodiments, cable 320 may not have all of the elements or components listed above and/or may have other elements or components instead of or in addition to those listed.

Cord 1202 carries the electrical wires for carrying the signal to the lights. Head 1204 is connected to cord 1202 and houses the connection between the wires in the cord and the wires in the connector. Screws 1206 fasten head 1204 to the back of presentation device 216 at one of communication cable ports 1125. In an embodiment, once screw 1206 are tightened, head 1204 forms a seal that is at least water resistant preventing water from contacting the electrical connectors in cable 320 or communication cable port 1125. Thread 1208 engage screw holes that are part of communication cable port 1125 to hold cable 320 to communications port 1125. Electrical connector 1210 electrically connects cable 320 to presentation device 216.

Referring to FIG. 12A4, cord 320 may also include screw hole 1212 (also referred to as screw aperture with threading 3), screw 1206, narrow channel portion 1214. narrow neck portion 1216, recess 1218, and base 1220. In other embodiments, cable 320 may not have all of the elements or components listed above and/or may have other elements or components instead of or in addition to those listed.

Screw hole 1212 holds screw 1206 and may include threading for engaging the threading on screw 1206. Narrow channel portion 1214 holds screw 1206 in screw hold 1212. Narrow neck portion 1216 slides within narrow channel portion 1214. Narrow neck portion is narrower than the portion having threads 1208 and the head of screw 1206. The portion having threads 1208 and the head of screw 1206 are too wide to slide through narrow channel portion 1214. Recess 1218 is a recess in the head of screw 1208. Recess 1218 may be a slot for encaging a screwdriver, a hexagonal hole for engaging an Allen wrench, a recess of the shape to engage a Philip's head screwdriver, or a another shaped recess for engaging another tool. Base 1220 is the base of connector 1210.

FIG. 12C1 shows a side view of the head 1204. FIG. 12C2 shows the back of head 1204. FIG. 12C3 is a top view of head 1204. FIG. 12C4 shows a perspective view of head 1204 in which the front of head 1204 is visible. FIG. 12C5 shows a perspective view of head 1204 in which the back of head 1204 is visible.

Communication cable 320 may have two ends having cable connections that are female plugs that plug into pins in the male portion on the circuit board (see FIG. 11A communication cable port 1125, which contains the male connector that engages female connector of cable 320). One end of the communication cable attaches to one communication cable port 1125 on one display device 304 and the other end of the communication cable 320 attaches to a separate communication cable port 1125 on the display device to the right or left. This creates a row of display devices 304 that can communicate to one another. The two plugs are connected to each other via a cable or cord that contains wires that allow for the electronic communication. In at least one embodiment, the cord is short so it can connect between display devices without a lot of unused cord that has to be stored.

The communication cable 320 may also have a screw 2, threading 4, screw aperture with threading 3, and plug 4 that allows for locking the communication cable onto the display device. Thus, there is a plug that fits into the male communication port that allows electronic connection. In addition, there is one or more screws 2 that have threading at the bottom end 4 that can be screwed onto the male port to lock the communication cable onto the communication cable port. In other embodiments, communication cable connection may not have all of the elements or components listed above and/or may have other elements or components instead of or in addition to those listed.

FIGS. 12C1-12C5 illustrates another embodiment of a communication cable. In this embodiment only a single plug is shown. In at least one embodiment, the communication cable has only one plug and is used at either end of the row of display devices. In this way space is not taken up by an unnecessary plug and/or cord and the communication series is ended at the last display device.

Intermediate Product for an Alternative Embodiment of the Frame

FIG. 12D-12M

Figure 12D:
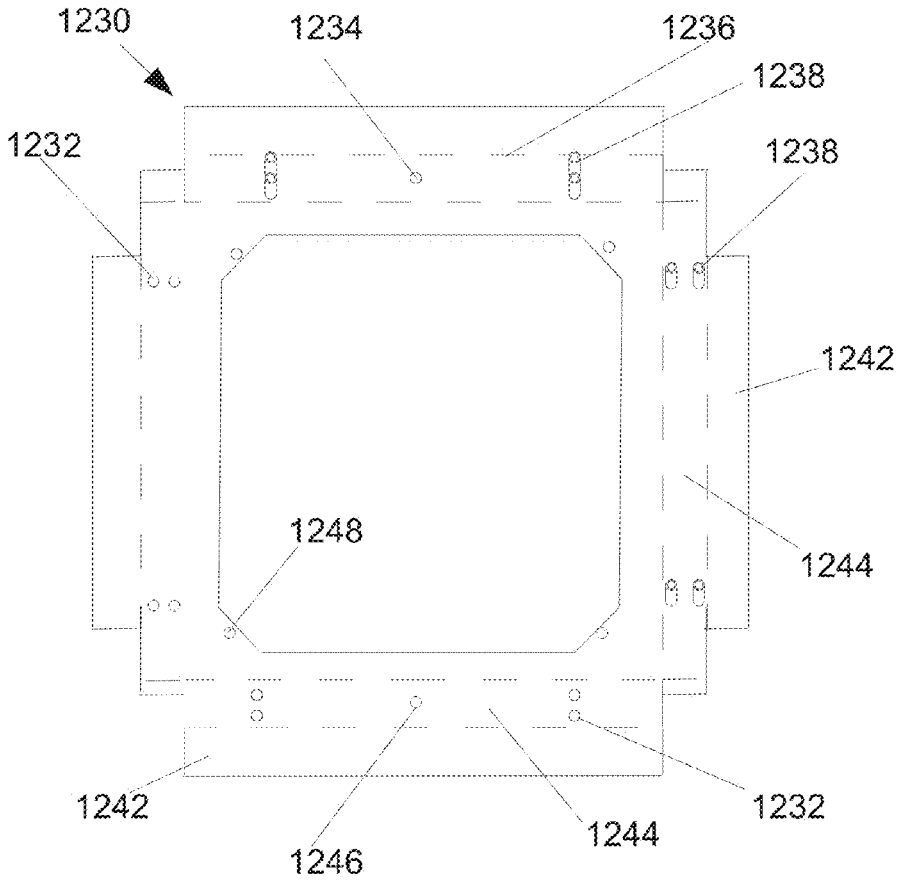
FIG. 12D shows an embodiment of an intermediate product for making the frame of the display panel.
Figure 12E:
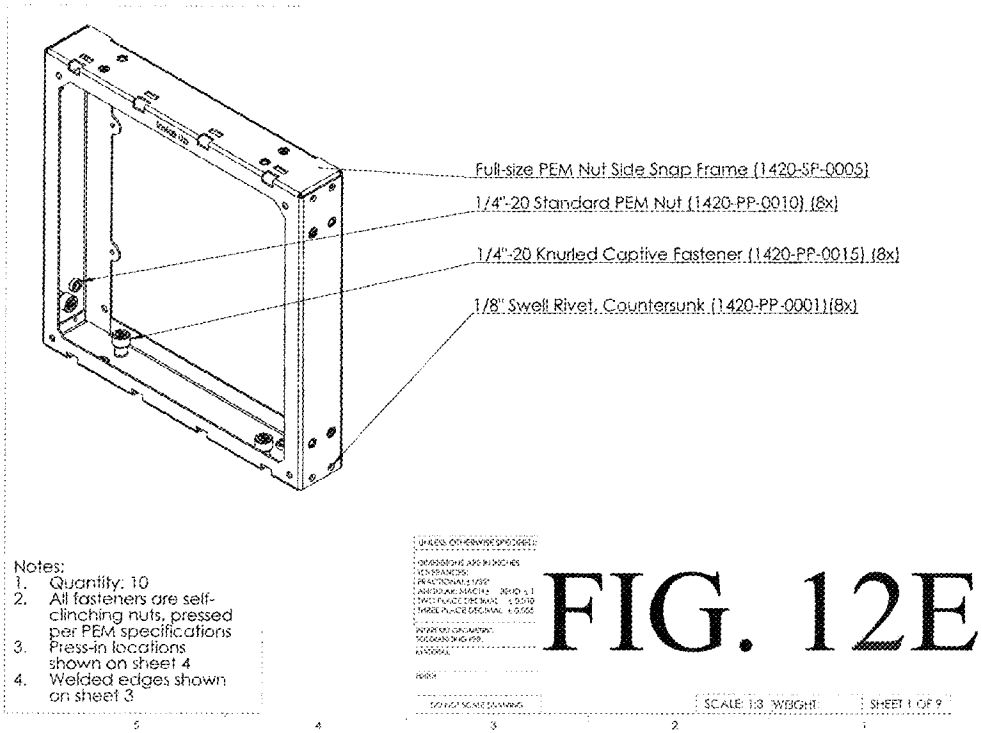
Figure 12F:
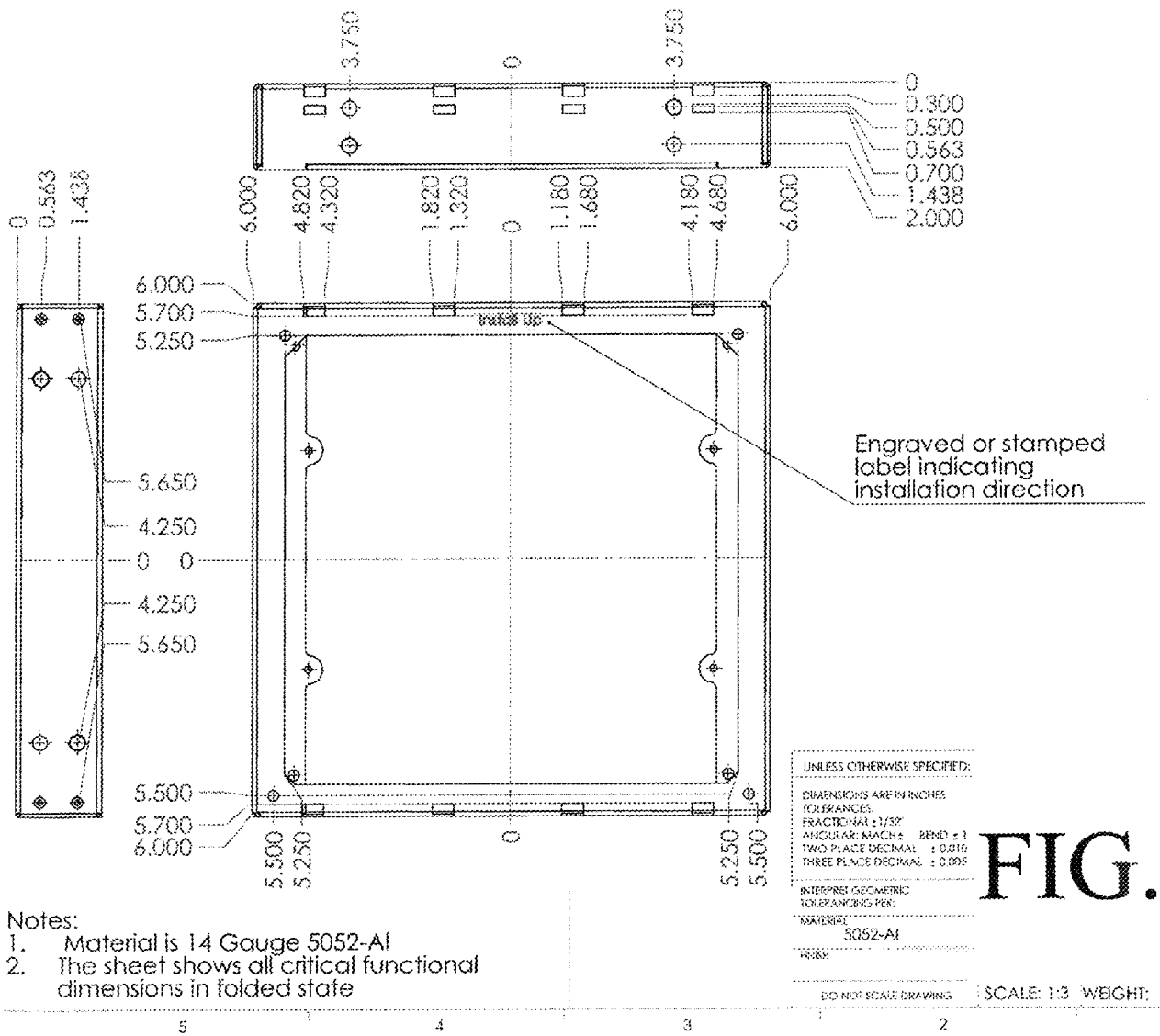
Figure 12G:
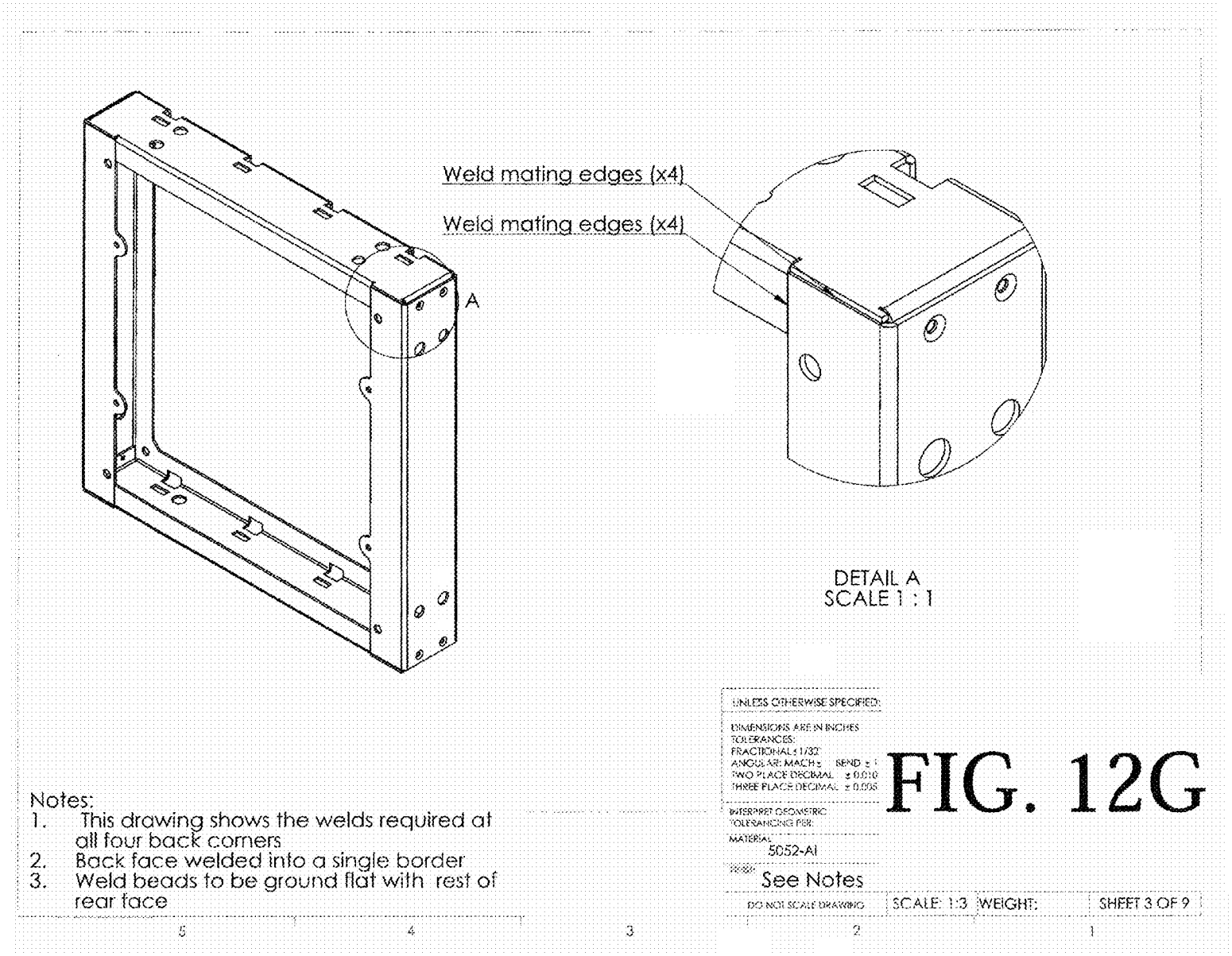
Figure 12K:
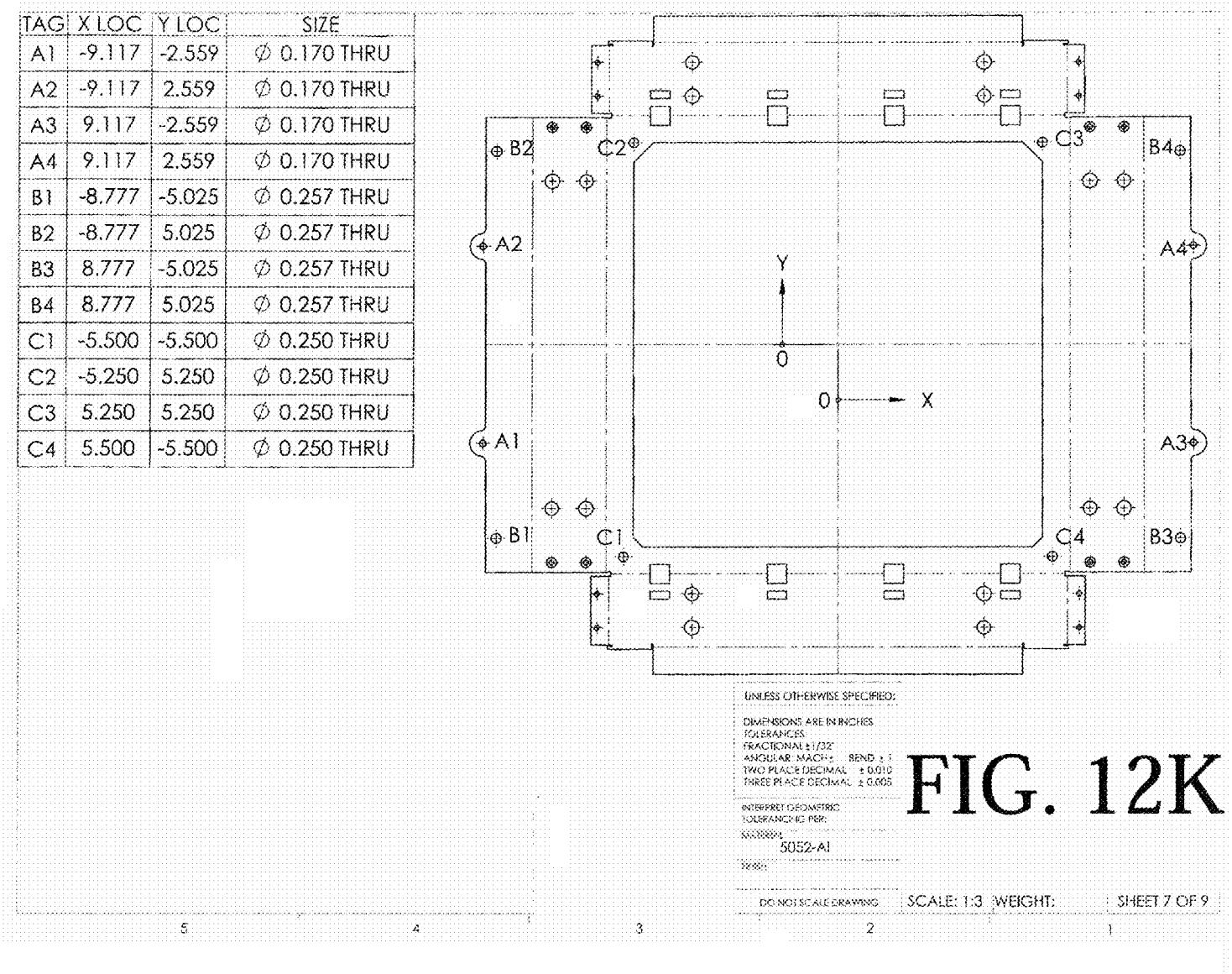
Figure 12L:
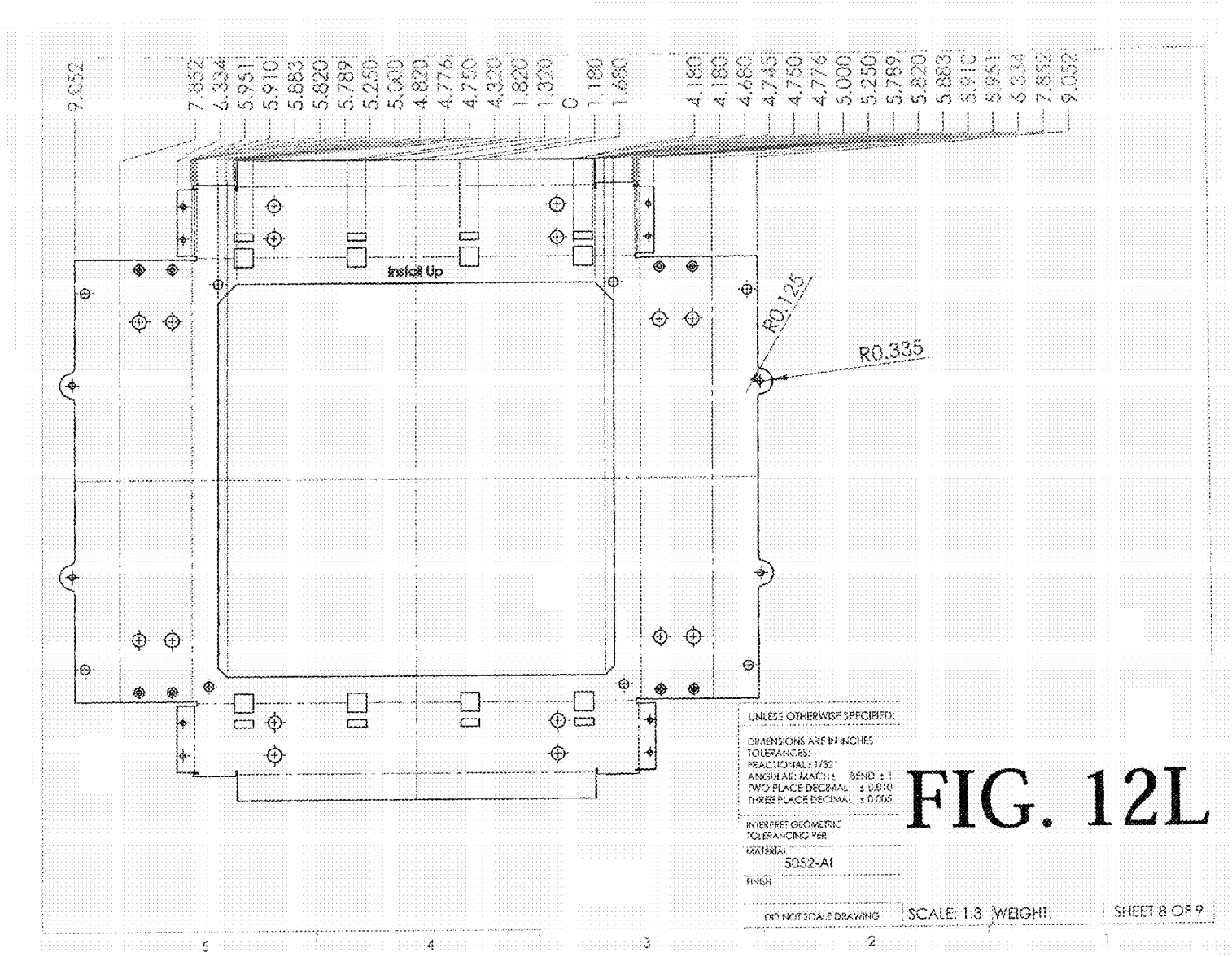
Figure 12M:
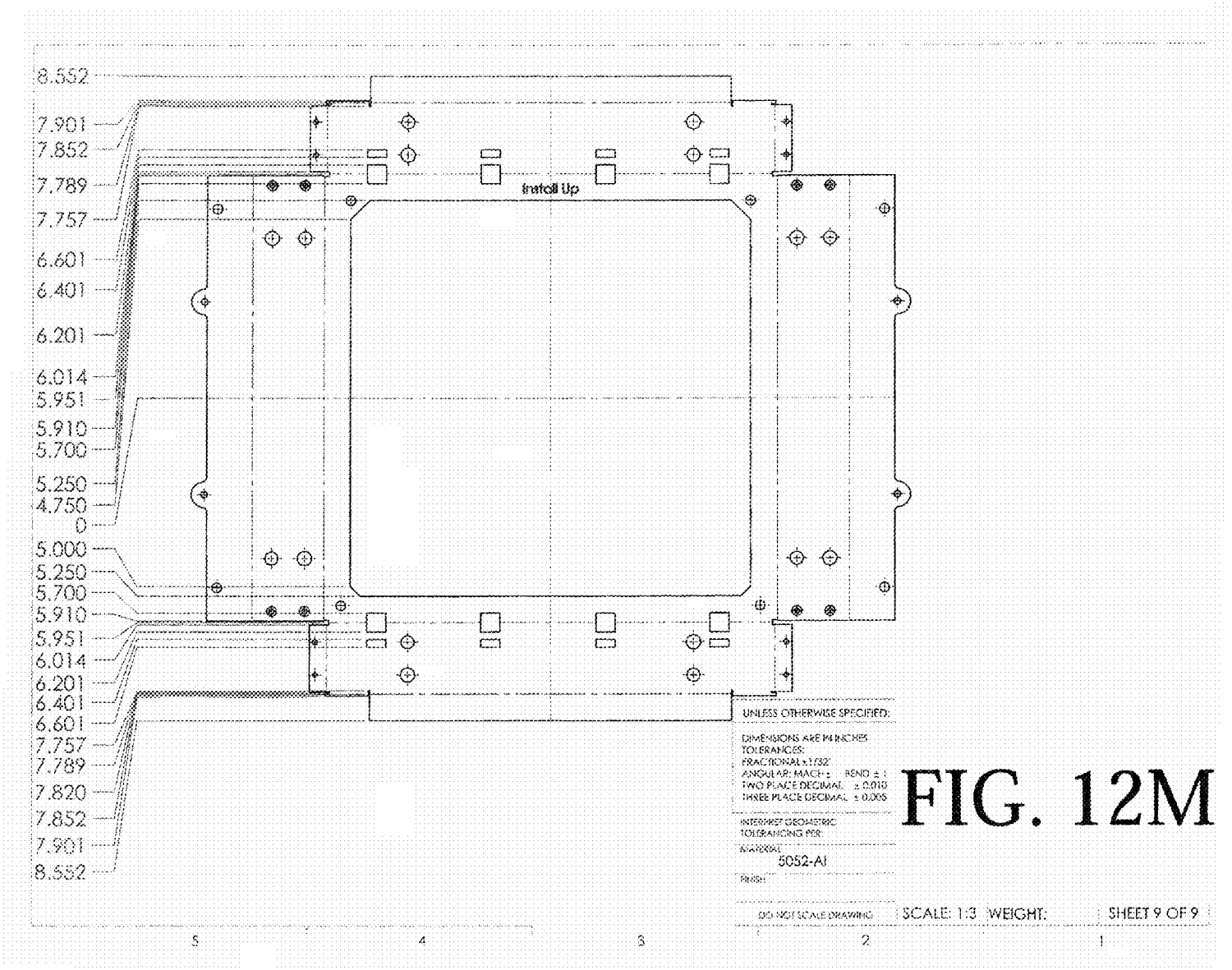

FIG. 12D shows an embodiment of an intermediate product 1230 for constructing another embodiment of frame 302. FIG. 12D shows intermediate product 370, screw holes 1232, top drain wholes 1234, fold lines 1236, tubes 1238, flanges 1242, frame side walls 1244, bottom drain whole 1246, and screw hole 1248. In other embodiments, intermediate product 1232 may not have all of the elements or components listed above and/or may have other elements or components instead of or in addition to those listed.

Intermediate product 1230 is folded to form frame 302. FIG. 12D shows the surface of intermediate product 1230 that is on the interior of the frame 302 once intermediate product 1230 is folded into frame 302. Screw holes 1232 are used to connect adjacent frames to one another. Top drain whole 1234 allows rainwater from a frame above the current frame to drain into frame 302 (so that the rain may drain out of the bottom drain whole. Fold lines 1236 are the location at which intermediate product 1230 is folded to form frame 302. Tubes 1238 are attached to screw holes, and may have threads for engaging screws. Tubes 1238 are located on the portion that becomes two sides of the frame 302 once intermediate product 1230 is folded. Flanges 1242 are the portions of intermediate product 1230 that become the flanges of the sidewalls of the frame 302. Frame sidewalls 1244 are the portions of intermediate product 1230 that become the sidewalls of the frame 302 once intermediate product 1230 is folded. Bottom drain whole 1246 allows rainwater to drain out of frame 302. The rainwater draining, via bottom drain 1246, may have come from another frame, via top frame hole 1234. Screw hole 388 may be used for connecting connection plate 320 to frame 302.

FIGS. 12E-12M show the dimensions of an embodiment of an intermediate product for making the frame of a display panel.

Another Embodiment

FIGS. 12N-12T

Figure 12N:
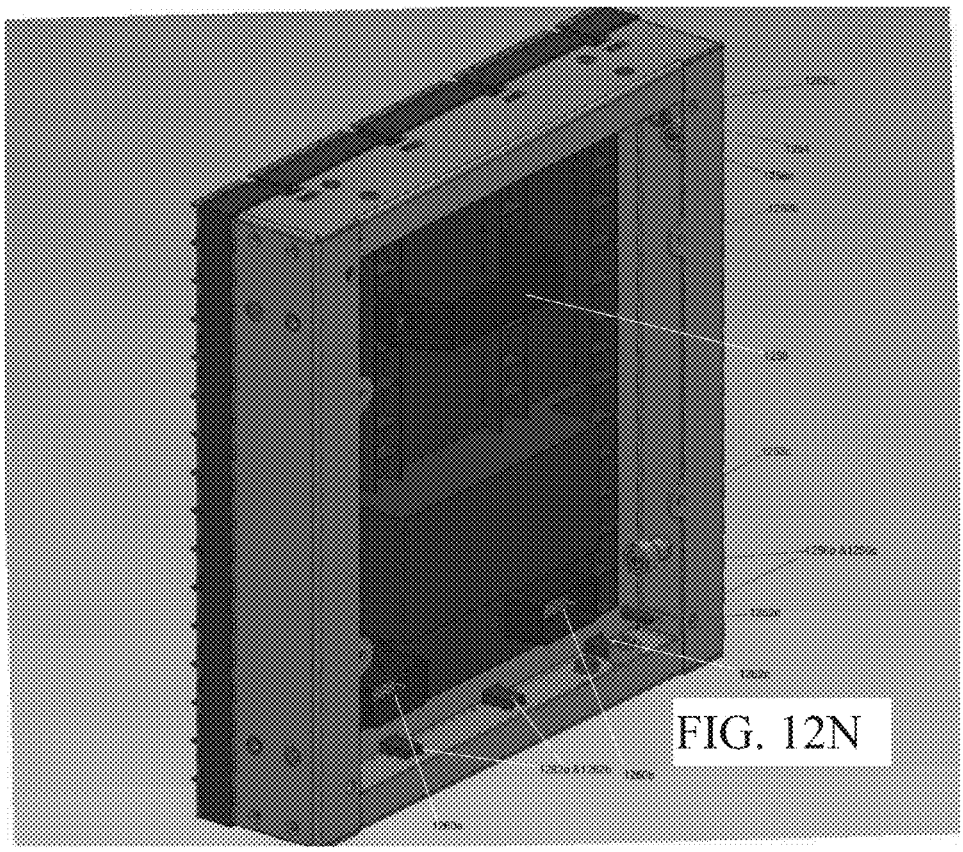
FIG. 12N shows an embodiment of the back of the display panel of FIGS. 12D-12M.

FIG. 12N shows an embodiment of the back of the display panel 1200 of FIGS. 12D-12M. As shows in FIG. 12N, display panel 1200 includes holes 1252*a-d*, nut 1254, fastener 1256, handle 1258, ports 1260*a* and 1260*b*, and tabs 1262*a-c*.

Holes 1252*a-d* may be used for attaching controllers to the back of the display panels. Nuts 1254 and fasteners 1256*a-c* may be used for attaching adjacent frames to one another. Although only one nut 1254 and three fasteners 1256*a-c* are shown, there may be more. In one embodiment, there may be four nuts 1254 and four fasteners for each frame, which engage bolts, screws or other fasteners in other frames. Handle 1258 may be used for inserting a presentation device into a frame prior to fastening the presentation device to the frame or to remove the presentation device from the frames after the presentation device has been unfastened from the frame. Ports 1260*a* and 1260*b* are for sending communication signals into the presentation device and out of the presentation device to an adjacent presentation device. Ports 1260*a* and 1260*b* also receive power for the powering the display panel and sending power to an adjacent display panel. Tabs 1262*a-c* aid in aligning the presentation device with the frame. Tabs 1262*a-c* may help prevent the presentation device from shaking while attached to the frame and/or may be used for holding the presentation device to the frame. Although only three tabs are shown, in an embodiment, there are four tabs at the bottom of the presentation device and four tabs at the top or the presentation device. In other embodiments, there may be other numbers of tabs, nuts, and fasteners.

Figure 12O:
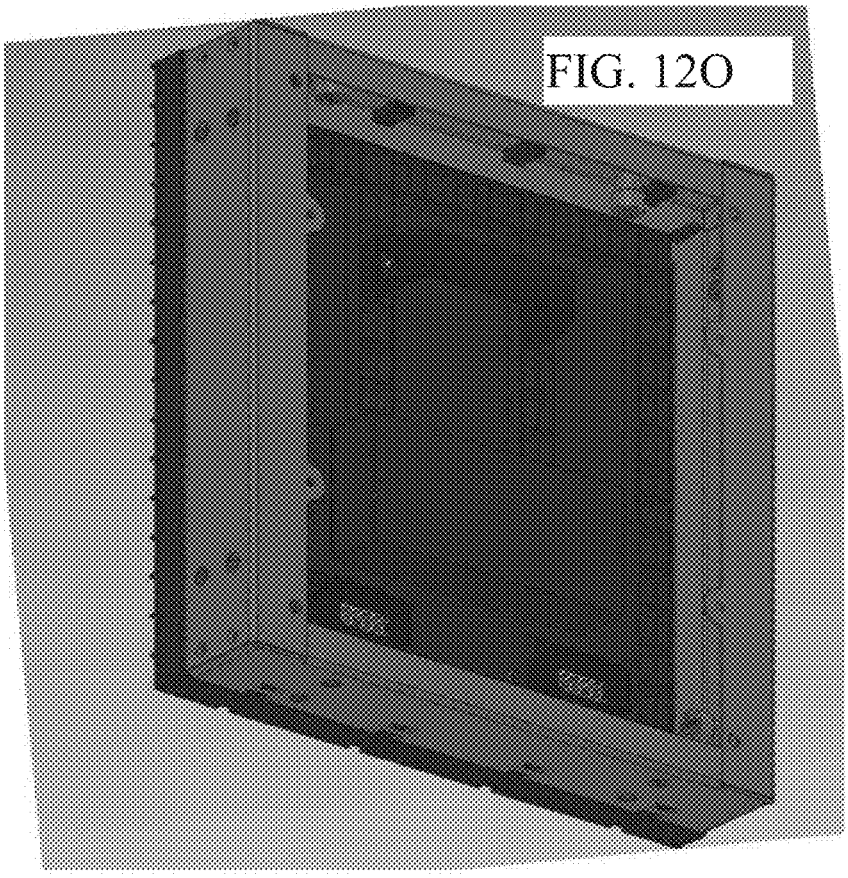
FIG. 12O shows another view of the back of the display of the embodiment of FIG. 12N.

FIG. 12O shows another view of the back of the display of the embodiment of FIG. 12N.

Figure 12P:
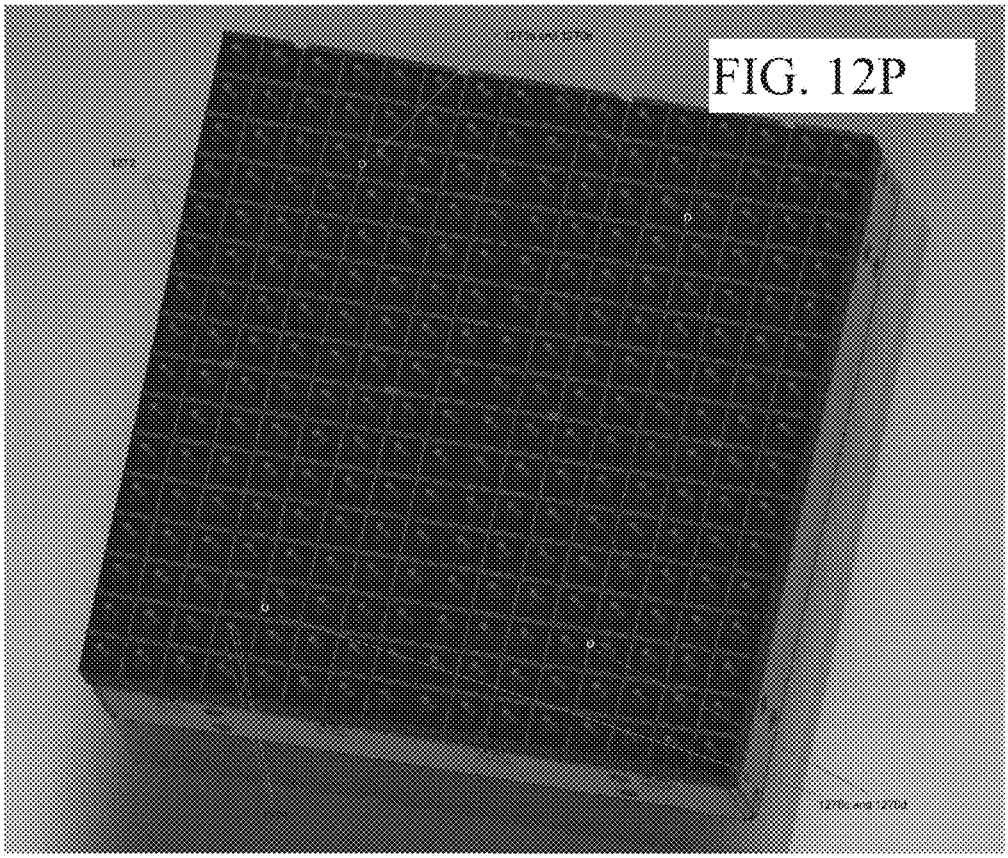
FIG. 12P shows an embodiment of the front of the display panel of FIG. 12N.

FIG. 12P shows an embodiment of the front of the display panel 1200 of FIG. 12N. The front of display panel 1200 may include holes 1270*a-d*, visors 1272 and colored lights 1274. Holes 1270*a-d* are optional. Holes 1270*a-d* may be an embodiment of holes 1182, which were described in conjunction with FIG. 11B. Visors 1272 may be an embodiment of flanges 301*b*, and colored lights 1274 may be an embodiment of lights 1180, which were described above in conjunction with FIGS. 3B1 and 11B.

Figure 12Q:
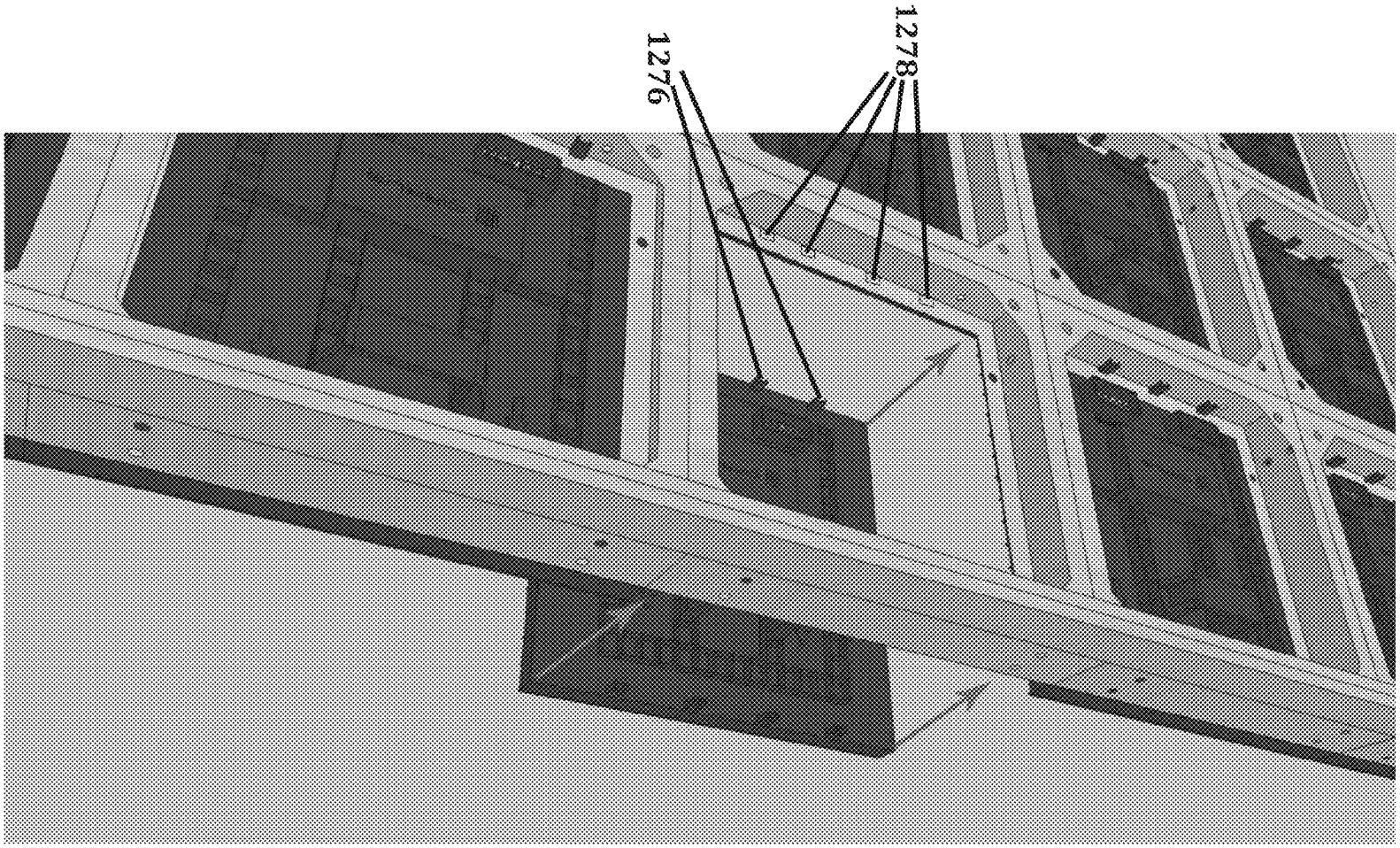
FIG. 12Q shows an embodiment of attaching a presentation device to the frame.

FIG. 12Q shows an embodiment of attaching a presentation device to the frame. FIG. 12Q includes tabs 1274 and rectangular holes 1276. Tabs 1274 are inserted into rectangular holes 1276 while inserting the presentation device into the frame. Tabs 1274 are embodiments of tabs 1262*a-c*.

Figure 12R:
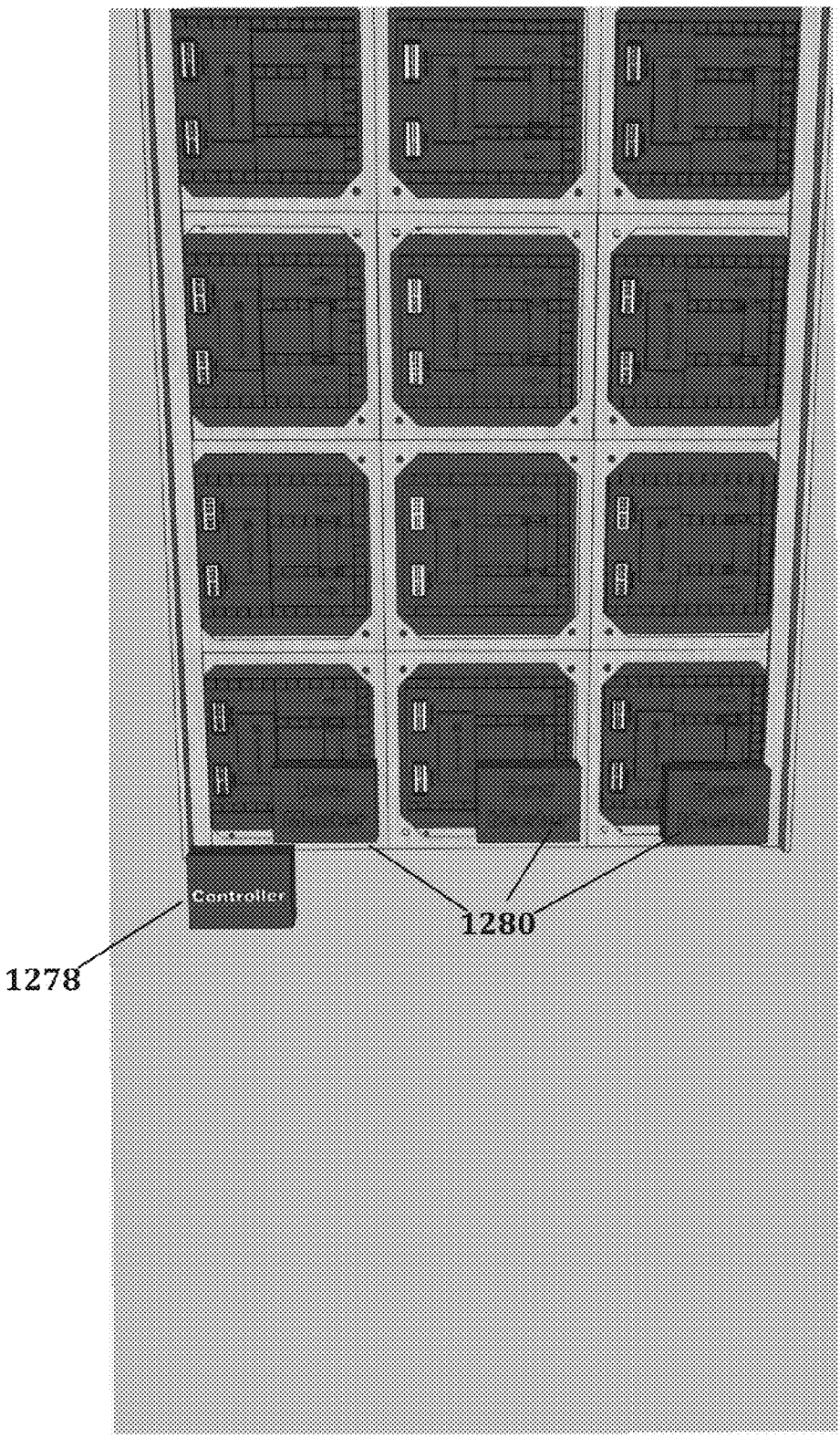
FIG. 12R shows an embodiment of a display having the presentation devices attached to the frame.

FIG. 12R shows an embodiment of a display having the presentation devices attached to the frame. FIG. 12R shows row controller 1280*a-c* and master controller 1282.

Row controllers 1280*a-c* power and control row of display panels. Row controllers determine which lights in each panel of each row of panels is lit and which is off. Optionally, the intensity of the individual lights may also be controlled by row controllers 1280*a-c*. Master controller 1282 powers and controls row controllers 1280*a-c*. Row controllers 1280*a-c* may have a role of slave controllers to master controller 1282. In an embodiment, each presentation device may be held to a frame by locking devices 306 (see FIGS. 3B5, 10E, and 11A).

Figure 12S:
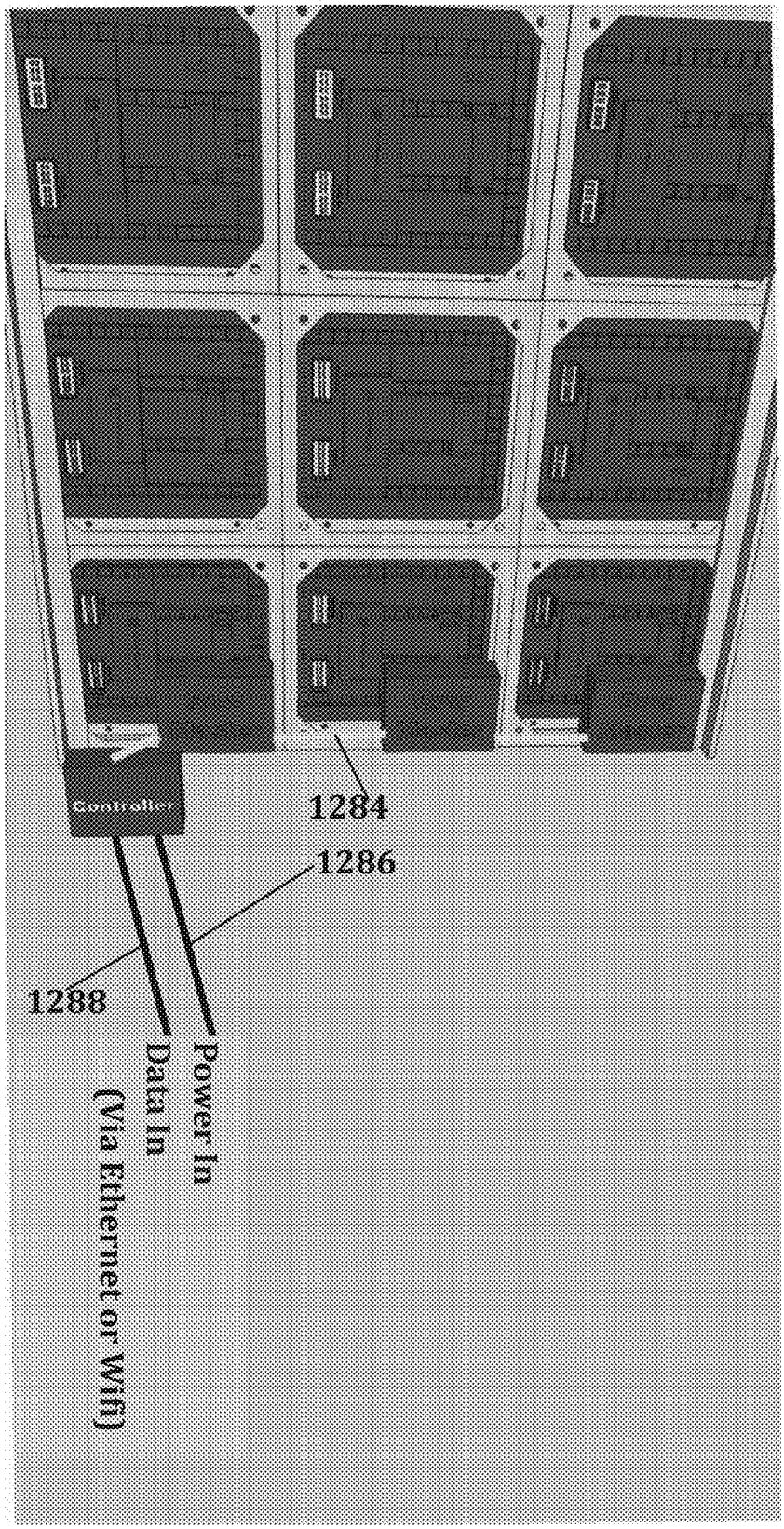
FIG. 12S shows an embodiment of a display with controller attached.

FIG. 12S shows an embodiment of a display with controller attached. FIG. 12S shows cables 1284, power cable 1286, and data cable 1288. Cables 1284 carry power and control signals from master controller 1284 to each of row controllers 1282*a-c*. In an embodiment, each of the row controllers are connected in series, via cable 1284, to the master controller. The control signals and power are sent, via cable 1284, from the master controller to the first row controller in the series. Then the control signals and power are sent, via cable 1284, from the first row controller in the series to the next row controller in the series. After a given controller receives the power and control signals, the power and control signals are sent, via cable 1284, from that controller to the next controller in the series until each controller in the series receives the control signals and power, which cause the row controllers to power and control the lights. Power cable 1286 send power to master controller, which the powers the master controller and which the master controller sends to the row controllers. Data cable 1288 carries information from a computer (e.g., computer 102) to master controller 1288. Optionally, the master controller receives control signals, via a network, from a remotely located computer.

Figure 12T:
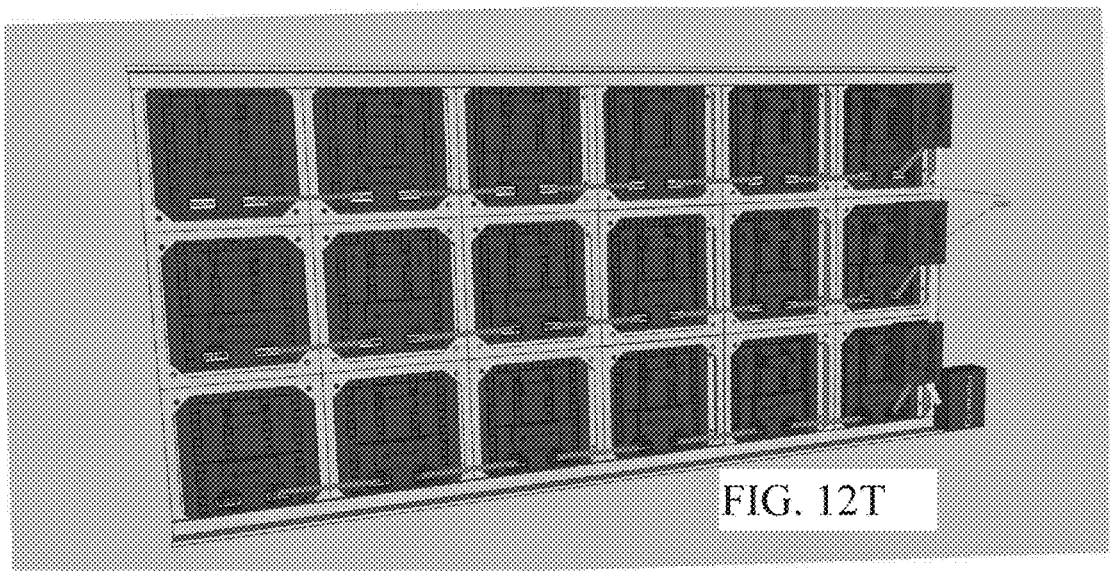
FIG. 12T shows an embodiment of a display with the cables connecting the presentation devices to one another.

FIG. 12T shows an embodiment of a display with the cables connecting the presentation devices to one another. FIG. 12T shows cables 1290, which connect adjacent display panels to one another in series. Cables 1290 carry both power and control signals to the lights. In an embodiment, the control signals sent by cables 1290 may power the lights. Cable 1290 may be an embodiment of cable 1202.

In an embodiment, each display panel of a given row is connected in series, via cables 1290, to a row controller. The control signals and power are sent, via cables 1290, from the row controller to the first display panel in the row. Then the control signals and power are sent, via cables 1290, from the first display panel in the row to the next display panel in the row. After a given display panel receives the power and control signals, the power and control signals are sent, via cables 1290, from that display panel to the next display panel in the row until each display panel in the row receives the control signals and power, which causes the individual lights to light up in a desired pattern.

Method of Assembly

FIG. 13

Figure 13:
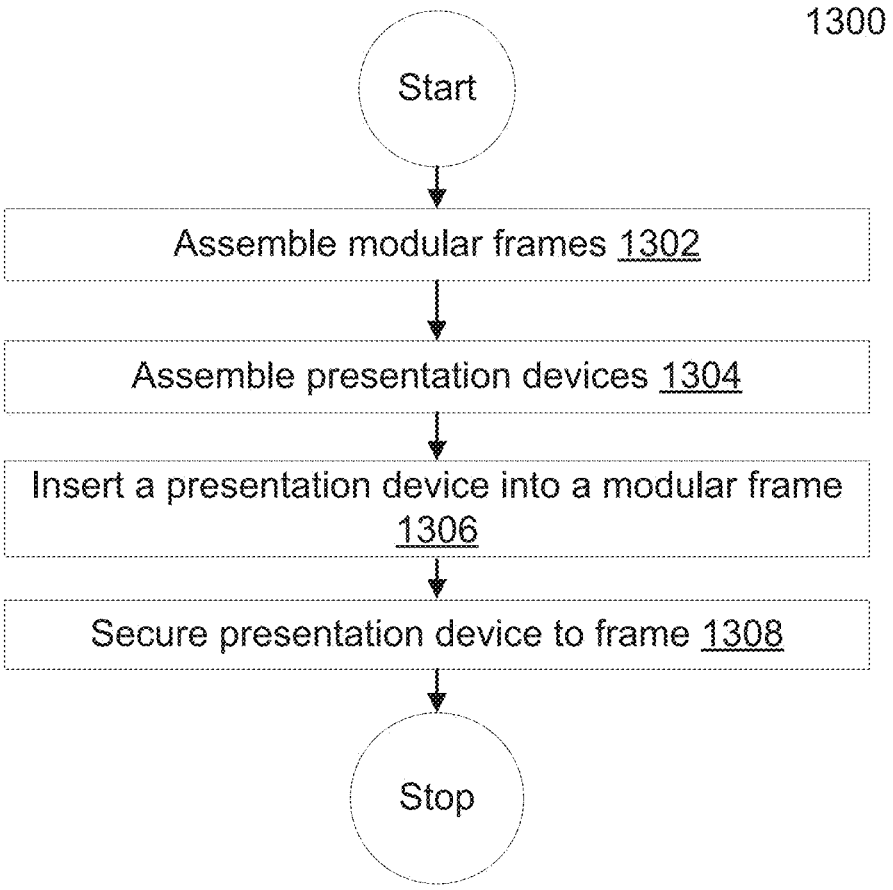
FIG. 13 illustrates a flowchart of an embodiment for a method of assembling a modular presentation device system.

FIG. 13 illustrates flowchart 1300 of an example describing a method of assembling a modular presentation device system.

In step 1302, one or more modular frames is constructed and assembled. Modular frame in step 1302 may be an example of frame 206 in FIGS. 2A-2E or frame 302 in FIGS. 3C1-3C9. In an embodiment, the modular frame may be composed of a top, bottom, left, and right frame walls, one or more corner brackets, and one or more grommets.

In step 1304, one or more presentation devices 216 are constructed and assembled. Presentation device 216 in step 1304 may be an example of display panel 108 in FIG. 1.

In step 1306, a presentation device is inserted into a modular frame 206 and 302. For example, the presentation device 216 constructed and assembled in step 1304 may be inserted into the modular frame 302 constructed and assembled in step 1302.

In step 1308, a presentation device 216 is attached to a modular frame, frame 302, and is secured. In an embodiment, a presentation device 216 is secured to a modular frame 206 or 302 using a locking device 306, such as the locking device 306 in FIGS. 10A-10F. After step 1308, the execution of flow chart 1300 terminates.

Method of Use

FIG. 14

Figure 14:
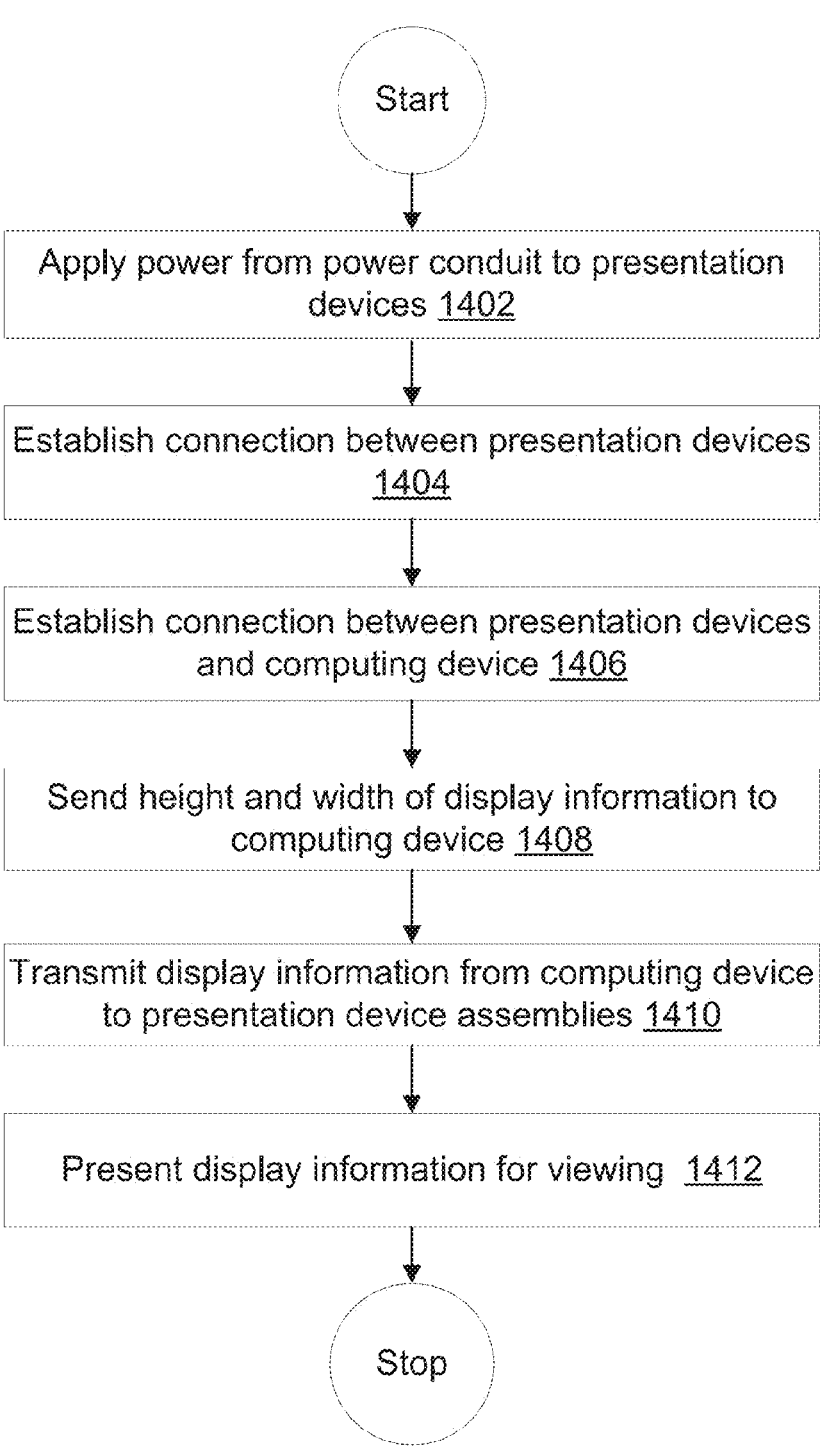
FIG. 14 illustrates a flowchart of an embodiment for a method of using a modular presentation device system.

FIG. 14 illustrates a flowchart of an example describing a method of using a modular presentation device system.

In step 1402, power from a power supply is sent to one or more presentation devices 216. In an embodiment, power is sent from a power supply to one or more presentation devices 216 secured to a modular frame 206 or 302 by a locking device 306.

In step 1404, a connection is established between more than one presentation devices. In an embodiment, a connection may be established using a communication cable as illustrated in FIGS. 12A1-12C5 between more than one presentation devices. In another embodiment, a communication cable may be attached to one or more presentation devices as illustrated in FIGS. 11A-11D.

In step 1406, a connection is established between one or more presentation devices 206 and one or more computing devices, such as controller 106 and/or computers 102. In an embodiment, one or more presentation devices 216 and one or more computing devices 102 may be connected using a network system 102.

In step 1408, the height and width of display information is sent to one or more computing devices 102. In an embodiment, the height and width of the display information is sent to one or more computing devices 102 by a user.

In step 1410, display information is transmitted from one or more computing devices 102 to one or more controllers 106. The information sent may depend on the number of panels 203 and shape of the assembled system 100.

In step 1412, one or more presentation devices 216 receives control signals from controllers 106 and the display information, thereby presenting the display information for viewing. After step 1412 the execution of flowchart 1400 terminates.

Block Diagrams of Computers

Figure 15:
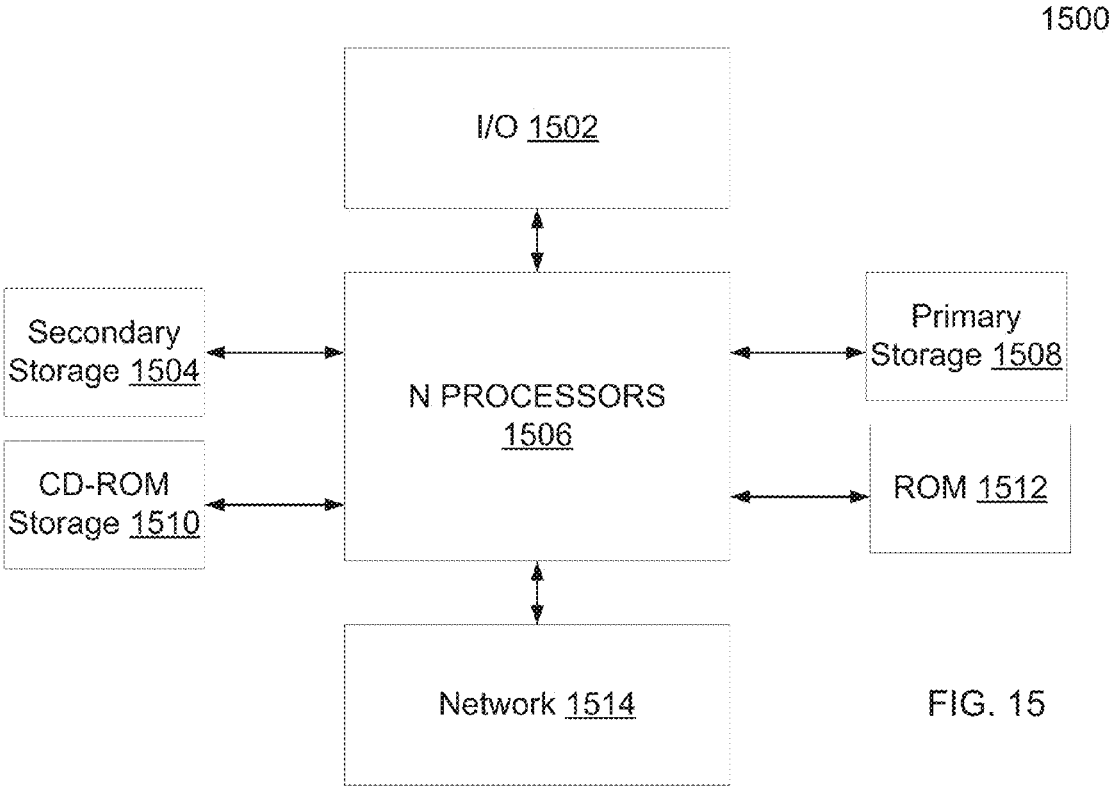
FIG. 15 illustrates a block diagram of an embodiment of a computer system that, when appropriately configured or designed, may serve as a computer system with reference to FIG. 1.

FIG. 15 illustrates a block diagram of an example of a computer system that, when appropriately configured or designed, may serve as a computer system 1500 with reference to FIG. 1. Computer system 1500 may be an embodiment of computer 102, controller 106 or controller 204. Computer system 1500 may include embodiments of I/O 1502, secondary storage 1504, N processors 1506, primary storage 1508, CD-ROM storage 1510, ROM 1512, and network 1514. In other embodiments, computer system 1500 may not have all of the elements or components listed above and/or may have other elements or components instead of or in addition to those listed.

I/O 1502 may have ports for connecting to one or more input/output devices such as video monitors, track balls, mice, keyboards, microphones, touch-sensitive displays, transducer card readers, magnetic or paper tape readers, tablets, styluses, voice or handwriting recognizers, controllers, and/or other input/output devices, such as other computers. In an embodiment I/O 1502 is connected to one or more controllers 106 for controlling groups of display pannels 108.

Computer system 1500 includes a one or more processors 1506 (also referred to as central processing units, or CPUs) that may be coupled to storage devices including a primary storage 1508 (typically a random access memory, or RAM), a primary storage (ROM) 1512 (typically a read-only memory, or ROM). CPU 1506 may be of various types including micro-controllers (e.g., with embedded RAM/ROM) and microprocessors such as programmable devices (e.g., RISC or SISC based, or CPLDs and FPGAs) and devices not capable of being programmed such as gate array ASICs (Application Specific Integrated Circuits) or general purpose microprocessors. Primary storage (ROM) 1512 acts to transfer data and instructions uni-directionally to the CPU and primary storage 1508 typically may be used to transfer data and instructions in a bi-directional manner. The primary storage 1508 discussed previously may include any suitable computer-readable media such as those described above. A mass storage device (secondary storage) 1504 may also be coupled bi-directionally to CPU 1506 and provides additional data storage capacity and may include any of the computer-readable media described above. Mass storage device (secondary storage) 1504 may be used to store programs, data and the like and typically may be used as a secondary storage medium such as a hard disk. The information retained within mass storage device (secondary storage) 1504, may, in appropriate cases, be incorporated in as part of primary storage 1508 as virtual memory. A specific mass storage device such as a CD-ROM 1510 may also pass data uni-directionally to the CPU.

N processors (CPU) 1506 may be coupled to an interface (I/O) 1502. N processors (CPU) 1506 may optionally be coupled to an external device such as a database or a computer or telecommunications or internet network using an external connection shown generally as a network 1514, which may be implemented as a hardwired or wireless communications link using suitable conventional technologies. With such a connection, the CPU might receive information from the network, or might output information to the network in the course of performing the method steps described in FIGS. 13 and 14, for exmple.

Figure 16:
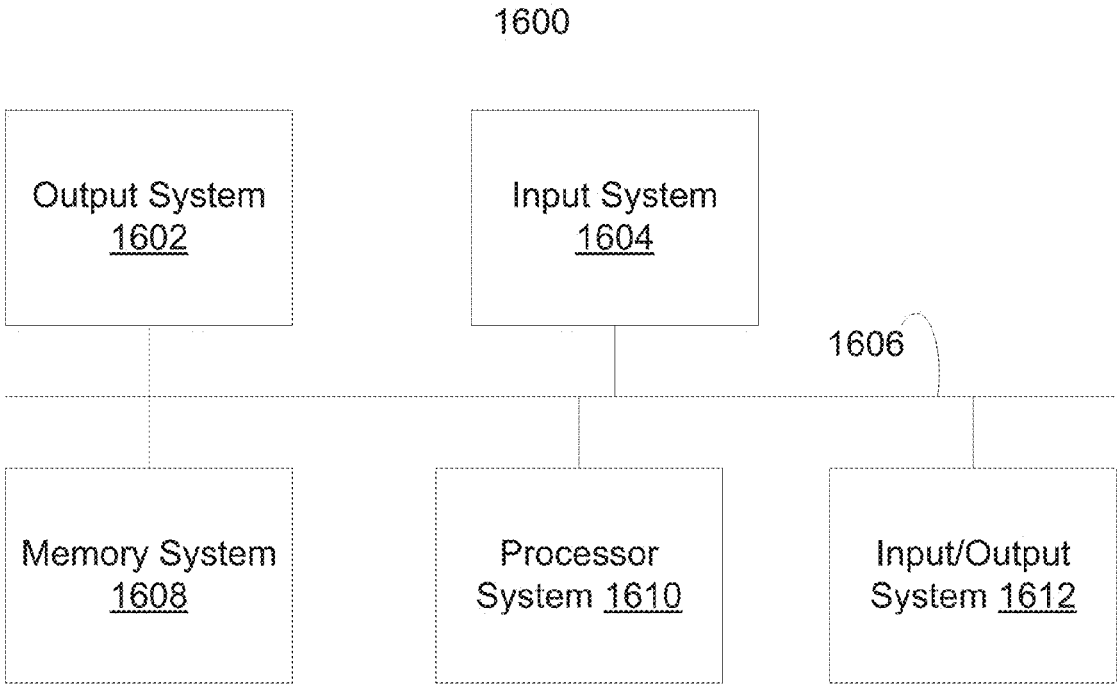
FIG. 16 illustrates an embodiment of a block diagram of a computer system with reference to FIG. 1.

FIG. 16 illustrates another example of a block diagram of computer system 1600 with reference to FIG. 1. Computer system 1600 may be an embodiment of computer 102, controller 106 or controller 204. Computer system 1600 may include embodiments of output system 1602, input system 1604, communications system 1606, memory system 1608, processor system 1610, and input/output system 1612. In other embodiments, computer system 1600 may not have all of the elements or components listed above and/or may have other elements or components instead of or in addition to those listed. Computer system 1600 is an example of a computer that may be used as computer 102 in FIG. 1.

Output system 1602 may include any one of, some of, any combination of, or all of a monitor system, a handheld display system, a printer system, a speaker system, a connection or interface system to a sound system, an interface system to peripheral devices and/or a connection and/or interface system to a computer system, intranet, and/or internet, for example.

Input system 1604 may include any one of, some of, any combination of, or all of a keyboard system, a mouse system, a track ball system, a track pad system, buttons on a handheld system, a scanner system, a microphone system, a connection to a sound system, and/or a connection and/or interface system to a computer system, intranet, and/or internet (e.g., IrDA, USB), for example.

Communications system 1606 communicatively links output system 1602, input system 1604, memory system 1608, processor system 1610, and/or input/output system 1612 to each other. Communications system 1606 may include any one of, some of, any combination of, or all of electrical cables, fiber optic cables, and/or means of sending signals through air or water (e.g. wireless communications), or the like. Some examples of means of sending signals through air and/or water include systems for transmitting electromagnetic waves such as infrared and/or radio waves and/or systems for sending sound waves.

Memory system 1608 may include, for example, any one of, some of, any combination of, or all of a long term storage system, such as a hard drive; a short term storage system, such as random access memory; a removable storage system, such as a floppy drive or a removable drive; and/or flash memory. Memory system 1608 may include one or more machine-readable mediums that may store a variety of different types of information. The term machine-readable medium is used to refer to any nontransitory machine readable medium capable carrying information that is readable by a machine. One example of a machine-readable medium is a computer-readable medium. Memory system 1608 may include control instructions for sending to controllers for controlling presentation panels 216.

Processor system 1610 may include any one of, some of, any combination of, or all of multiple parallel processors, a single processor, a system of processors having one or more central processors and/or one or more specialized processors dedicated to specific tasks. Processor 1620 carries out the machine instructions stored in memory system 1608.

Input/output system 1612 may include devices that have the dual function as input and output devices. For example, input/output system 1612 may include one or more touch sensitive screens, which display an image and therefore are an output device and accept input when the screens are pressed by a finger or stylus, for example. The touch sensitive screens may be sensitive to heat and/or pressure. One or more of the input/output devices may be sensitive to a voltage or current produced by a stylus, for example. Input/output system 1612 is optional, and may be used in addition to or in place of output system 1602 and/or input system 1604.

A Network Including Multiple Systems

FIG. 17

Figure 17:
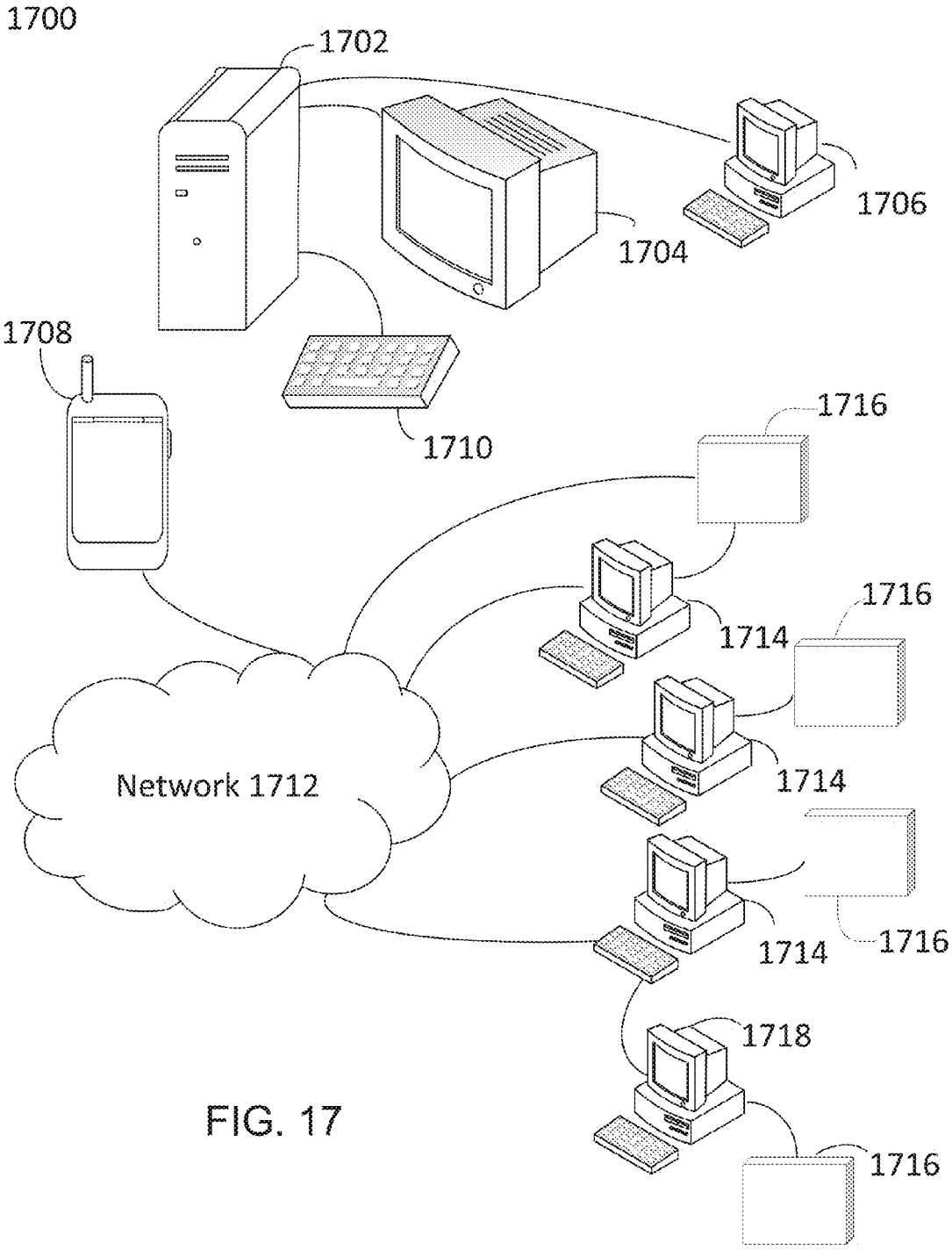
FIG. 17 illustrates an embodiment of a network system with reference to FIG. 1.

FIG. 17 illustrates an embodiment of a network system 1700 with reference to FIG. 1 which may include embodiments of a server system 1702, output system 1704, handheld device 1708, input system 1710, communications network 1712, a plurality of client systems 1706, 1714, and 1718, and display panel 1716. In other embodiments, network system 1700 may not have all of the elements or components listed above and/or may have other elements or components instead of or in addition to those listed.

Server system 1702 may include one or more servers. Input system 1710 may be used for entering input into server system 1702, and may include any one of, some of, any combination of, or all of a keyboard system, a mouse system, a track ball system, a track pad system, buttons on a handheld system, a scanner system, a wireless receiver, a microphone system, a connection to a sound system, and/or a connection and/or an interface system to a computer system, intranet, and/or the Internet (e.g., IrDA, USB), for example.

Output system 1704 may be used for receiving output from server system 1702, and may include any one of, some of, any combination of or all of a monitor system, a wireless transmitter, a handheld display system, a printer system, a speaker system, a connection or interface system to a sound system, an interface system to peripheral devices and/or a connection and/or an interface system to a computer system, intranet, and/or the Internet, for example.

Network system 1700 illustrates some of the variations of the manners of connecting to the server system 1702, which may be information provided to the site (not shown).

Server system 1702 may be directly connected and/or wirelessly connected to the plurality of client systems 1706, 1714, and 1718 and are connected via the communications network 1712. Client system 1714 may be connected to server system 1702 via client system 1718. Communications network 1712 may be any one of, or any combination of, one or more Local Area Networks (LANs), Wide Area Networks (WANs), wireless networks, telephone networks, the Internet and/or other networks. Communications network 1712 may include one or more wireless portals. Client systems 1706, 1714, and 1718 are any system that an end user may use to access the server system 1702. For example, client systems 1706, 1714, and 1718 may be personal computers, workstations, laptop computers, game consoles, handheld network enabled audio/video players and/or any other network appliance.

Client system 1718 accesses the server system 1702 via the combination of the communications network 1712 and another system, which in this example is client system 1714. Hand-held device 1708 is an example of a handheld wireless device, such as a mobile phone or a handheld network enabled audio/music player, which may also be used for accessing network content. In another embodiment, any combinations of client systems 1706, 1714, and 1718 may include a GPS system. Display panel 1716 may be embodiments of system 100 in FIG. 1.

Alternatives and Extensions

Those skilled in the art will readily recognize, in light of and in accordance with the teachings of the present invention, that any of the foregoing steps and/or system modules may be suitably replaced, reordered, removed and additional steps and/or system modules may be inserted depending upon the needs of the particular application, and that the systems of the foregoing embodiments may be implemented using any of a wide variety of suitable processes and system modules, and is not limited to any particular computer hardware, software, middleware, firmware, microcode and the like. For any method steps described in the present application that can be carried out on a computing machine, a typical computer system can, when appropriately configured or designed, serve as a computer system in which those aspects of the invention may be embodied.

Embodiments of the present invention are best understood by reference to the detailed figures and description set forth herein.

Embodiments of the invention are discussed below with reference to the figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods for a modular variable presentation system according to the present invention will be apparent to those skilled in the art. The invention has been described above by way of illustration, and the specific embodiments disclosed are not intended to limit the invention to the particular forms disclosed. For example, the particular implementation of the presentation devices may vary depending upon the particular type illumination device used. The illumination devices described in the foregoing were directed to LED implementations; however, similar techniques using.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means.

From reading the present disclosure, other variations and modifications will be apparent to persons skilled in the art. Such variations and modifications may involve equivalent and other features which are already known in the art, and which may be used instead of or in addition to features already described herein.

Although claims have been formulated in this application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

In the following description and claims, the terms "coupled" and "connected," along with their derivatives, may be substituted one for the other to obtain different embodiments.

A "computer" may refer to one or more apparatus and/or one or more systems that are capable of accepting a structured input, processing the structured input according to prescribed rules, and producing results of the processing as output. Examples of a computer may include: a computer; a stationary and/or portable computer; a computer having a single processor, multiple processors, or multi-core processors, which may operate in parallel and/or not in parallel; a general purpose computer; a supercomputer; a mainframe; a super mini-computer; a mini-computer; a workstation; a micro-computer; a server; a client; an interactive television; a web appliance; a telecommunications device with internet access; a hybrid combination of a computer and an interactive television; a portable computer; a tablet personal computer (PC); a personal digital assistant (PDA); a portable telephone; application-specific hardware to emulate a computer and/or software, such as, for example, a digital signal processor (DSP), a field-programmable gate array (FPGA), an application specific integrated circuit (ASIC), an application specific instruction-set processor (ASIP), a chip, chips, a system on a chip, or a chip set; a data acquisition device; an optical computer; a quantum computer; a biological computer; and generally, an apparatus that may accept data, process data according to one or more stored software programs, generate results, and typically include input, output, storage, arithmetic, logic, and control units.

"Software" may refer to prescribed machine instructions to operate a computer. Examples of software may include: code segments in one or more computer-readable languages; graphical and or/textual instructions; applets; pre-compiled code; interpreted code; compiled code; and computer programs.

A "computer-readable medium" may refer to any storage device used for non-transitorily storing data accessible by a computer. Examples of a computer-readable medium may include: a magnetic hard disk; a floppy disk; an optical disk, such as a CD-ROM and a DVD; a magnetic tape; a flash memory; a memory chip; and/or other types of media that can store machine-readable instructions thereon.

The term machine-readable medium is used to refer to any non-transitory medium capable storing information that is readable by a machine. One example of a machine-readable medium is a computer-readable medium, such as magnetic memory, optical memory, magneto-optical memory, punch cards, and solid state memory. Another example of a machine-readable medium is paper having holes that are detected that trigger different mechanical, electrical, and/or logic responses, which is configured to be read by a machine other than a computer (e.g., a piano).

A "computer system" may refer to a system having one or more computers, where each computer may include a computer-readable medium embodying software to operate the computer or one or more of its components. Examples of a computer system may include: a distributed computer system for processing information via computer systems linked by a network; two or more computer systems connected together via a network for transmitting and/or receiving information between the computer systems; a computer system including two or more processors within a single computer; and one or more apparatuses and/or one or more systems that may accept data, may process data in accordance with one or more stored software programs, may generate results, and typically may include input, output, storage, arithmetic, logic, and control units.

A "network" may refer to a number of computers and associated devices that may be connected by communication facilities. A network may involve permanent connections such as cables or temporary connections such as those made through telephone or other communication links. A network may further include hard-wired connections (e.g., coaxial cable, twisted pair, optical fiber, waveguides, etc.) and/or wireless connections (e.g., radio frequency waveforms, free-space optical waveforms, acoustic waveforms, etc.). Examples of a network may include: an internet, such as the Internet; an intranet; a local area network (LAN); a wide area network (WAN); and a combination of networks, such as an internet and an intranet.

Exemplary networks may operate with any of a number of protocols, such as Internet protocol (IP), asynchronous transfer mode (ATM), and/or synchronous optical network (SONET), user datagram protocol (UDP), IEEE 802.x, etc.

Embodiments of the present invention may include apparatuses for performing the operations disclosed herein. An apparatus may be specially constructed for the desired purposes, or it may comprise a general-purpose device selectively activated or reconfigured by a program stored in the device.

Embodiments of the invention may also be implemented in one or a combination of hardware, firmware, and software. They may be implemented as instructions stored on a machine-readable medium, which may be read and executed by a computing platform to perform the operations described herein.

In the following description and claims, the terms "computer program medium" and "computer readable medium" may be used to generally refer to media such as, but not limited to, removable storage drives, a hard disk installed in hard disk drive, and the like. These computer program products may provide software to a computer system. Embodiments of the invention may be directed to such computer program products.

An algorithm is here, and generally, considered to be a self-consistent sequence machine instructions for carrying out acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

Unless specifically stated otherwise, and as may be apparent from the following description and claims, it should be appreciated that throughout the specification descriptions utilizing terms such as "processing," "computing," "calculating," "determining," or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

In a similar manner, the term "processor" may refer to any device or portion of a device that processes electronic data from registers and/or memory to transform that electronic data into other electronic data that may be stored in registers and/or memory. A "computing platform" may comprise one or more processors.

A non-transitory computer readable medium includes, but is not limited to, a hard drive, compact disc, flash memory, volatile memory, random access memory, magnetic memory, optical memory, semiconductor based memory, phase change memory, optical memory, periodically refreshed memory, and the like; however, the non-transitory computer readable medium does not include a pure transitory signal.

Embodiments of the present invention will be described which provides means and methods for a presentation system configurable for a multiplicity of sizes and shapes. System provides frame for supporting presentation devices. Furthermore, system is composed of modular presentation devices which may be connected for generating a variety of sizes and shapes.

Each embodiment disclosed herein may be used or otherwise combined with any of the other embodiments disclosed. Any element of any embodiment may be used in any embodiment.

Although the invention has been described with reference to specific embodiments, it will be understood by those skilled in the art that various changes may be made and equivalents may be substituted for elements thereof without departing from the true spirit and scope of the invention. In addition, modifications may be made without departing from the essential teachings of the invention.

The invention claimed is:

1. A system comprising:

a frame comprising:

a set of walls defining a frame perimeter, the set of walls cooperatively defining a central axis extending substantially parallel the walls;

a set of front flanges extending from a first set of edges of the walls, the front flanges extending normal to the set of walls toward the central axis, the front flanges comprising an interior surface and an exterior surface opposing the interior surface;

a set of back flanges extending from a second set of edges of the walls opposing the first set of edges, the back flanges extending normal to the set of walls toward the central axis, the back flanges comprising an interior surface proximal the front flanges and an exterior surface distal the front flanges and opposing the interior surface of the back flanges; and a presentation device arranged proximal the exterior surface of the set of front flanges, the presentation device operable between a coupled mode, wherein the presentation device is retained against the frame, and a decoupled mode, wherein the presentation device is decoupled from the frame, the presentation device comprising:

an array of lights arranged along a display side of the presentation device;

a fastener mounted to a second broad face of the presentation device opposing the display side, the fastener comprising an extension member extending asymmetrically radially outward from the fastener operable between:

an extended position, wherein the extension member is coupled to the interior surface of the front flanges and retains the presentation device against the exterior surface of the front flanges in the coupled mode; and a retracted position, wherein the extension member is retracted from the frame.

2. The system of claim 1, wherein the presentation device comprises casing sides, wherein a portion of the casing sides extend beyond the frame perimeter along a vector parallel the walls in the coupled mode.

3. The system of claim 1, the lights being light emitting diodes.

4. The system of claim 1, the lights being arranged in picture elements, in which each picture element includes three lights, each light of the picture element being a different color.

5. The system of claim 1, wherein the presentation device further comprises a flange extending above each light to reduce glare.

6. The system of claim 1, the presentation device having two ports for control signal cables.

7. The system of claim 1, the presentation device having a port for a power cable.

8. The system of claim 1, the frame having a first and second drain hole, the first drain hole being located in a first wall of the frame and the second drain hole being located on second wall of the frame, the second wall of the frame being located opposite to and facing the first side of the frame.

9. The system of claim 1, two of the walls of the frame having screw holes with threads, and two of the walls having holes without threads; the screw holes with the threads and the holes without the threads being located such that when another frame having the same shape and having screw holes with threads and having holes in the same location as the frame is placed next to the frame the holes without threads of one frame aligns with screw holes with threads of the other frame.

10. The system of claim 1, the frame having a rectangular shape.

11. The system of claim 1, wherein each wall of the frame comprises a front and back flange, wherein of the front and back flanges extend from opposing edges the wall.

12. The system of claim 1, wherein the fastener further comprises a member control mechanism coupled to the extension member, the member control mechanism operable between:

a locked position, wherein the member control mechanism places the extension member in the extended position; and a unlocked position, wherein the member control mechanism places the extension member in the retracted position.

13. The system of claim 12, wherein the member control mechanism comprises a rotational axis, wherein the member control mechanism is in a first arcuate position in the locked position, and in a second arcuate position in the unlocked position.

14. The system of claim 13, the presentation device having a hole extending coaxially along the rotational axis, through the fastener, from the display side to the second broad face.

15. The system of claim 14, the fastener comprising an extension member asymmetrically mounted about the rotational axis to the member control mechanism.

16. The system of claim 15, wherein member control mechanism rotation about the rotational axis in a first angular direction rotates the extension member from the retracted position to the extended position, and member control mechanism rotation about the rotational axis in a second angular direction opposing the first angular direction rotates the extension member from the extended position to the retracted position.

17. The system of claim 13, wherein the extension member retains the front flange of the frame against the second broad face of the presentation device in the coupled mode.

18. A system comprising:

a set of frames, each frame comprising:

a set of contiguous walls;

a first and second back flange extending from a first set of proximal edges of a first and second opposing wall, the first back flange extending toward the second back flange, the first and second back flanges configured to mount to a mounting substrate;

a first and second front flange extending from a second set of proximal edges of the first and second opposing wall opposing the second set of proximal edges, the first front flange extending toward the second front flange;

a set of presentation devices configured to removably couple to the set of front flanges, each presentation device comprising:

a display side;

a back side opposing the display side, the back side comprising a central axis;

an array of lights arranged along the display side of the presentation device;

a light control system electrically connected to the array of lights and mounted to the presentation device proximal the back side;

a fastener system mounted to the back side, the fastener system comprising:

a first and second actuation member configured to rotate about a first and second rotational axis, respectively, each actuation member defining a lumen men coaxially extending along the respective rotational axis;

a first and second retention member statically mounted to and extending radially from the first and second actuation member, respectively, at angularly asymmetric positions relative to a first and second imaginary extending along the first and second rotational axes, respectively;

the fastener system operable between:

a locked mode, wherein the first and second actuation members are positioned in a first angular position and the first and second retention members are positioned at a first radial position relative to the central axis and cooperatively couple the first and second front flange against the back side, respectively; and an unlocked mode, wherein the first and second actuation members are positioned in a second angular position different from the first angular position and the first and second retention members are positioned at a second radial position relative to the central axis, the second radial position more proximal the central axis than the first radial position; and a first and second aperture defined by the presentation device, extending from the display side to the back side and substantially coextensive with the first and second lumens, respectively.

19. The system of claim 18, wherein the first and second retention members actuate within an imaginary plane substantially parallel to the back side.

20. The system of claim 18, wherein the first and second retention members extend beyond a presentation device perimeter in the locked mode and are retracted within the presentation device perimeter in the unlocked mode.

* * * * *